US006826380B2

(12) United States Patent
Karakama et al.

(10) Patent No.: US 6,826,380 B2
(45) Date of Patent: Nov. 30, 2004

(54) INFORMATION STORING MEDIUM, UNIT, PROCESS CARTRIDGE, DEVELOPING CARTRIDGE, AND ELECTROPHOTOGRAPHIC IMAGE FORMING APPARATUS

(75) Inventors: Toshiyuki Karakama, Shizuoka (JP); Tatsuya Shiratori, Kanagawa (JP); Shinji Goto, Shizuoka (JP); Hironobu Isobe, Shizuoka (JP); Shinya Noda, Shizuoka (JP); Fumito Nonaka, Shizuoka (JP); Tomonori Mori, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/170,594

(22) Filed: Jun. 14, 2002

(65) Prior Publication Data

US 2003/0215261 A1 Nov. 20, 2003

(30) Foreign Application Priority Data

May 17, 2002 (JP) ..... 2002/142301

(51) Int. Cl.[7] ..... G03G 21/16; G03G 15/08

(52) U.S. Cl. ..... 399/111; 399/90; 399/119; 439/862

(58) Field of Search ..... 399/111, 77, 90, 399/12, 119, 222, 227, 25; 439/862, 289, 341, 376

(56) References Cited

U.S. PATENT DOCUMENTS

| | | | | |
|---|---|---|---|---|
| 4,851,960 A | | 7/1989 | Nakamura et al. | 361/225 |
| 4,938,716 A | * | 7/1990 | Chabrolle et al. | 439/376 |
| 4,994,853 A | * | 2/1991 | Fukuchi et al. | 399/111 |
| 5,055,913 A | * | 10/1991 | Haghiri-Tehrani | |
| 5,242,314 A | * | 9/1993 | Di Giulio et al. | 439/289 |
| 5,260,742 A | * | 11/1993 | Kikkawa | |
| 5,485,245 A | * | 1/1996 | Kobayashi et al. | |
| 5,926,666 A | | 7/1999 | Miura et al. | 399/25 |
| 5,937,239 A | | 8/1999 | Watanabe et al. | 399/111 |
| 6,129,571 A | * | 10/2000 | Ikemoto | 439/862 |
| 6,512,894 B2 | * | 1/2003 | Takemoto et al. | |
| 2001/0038759 A1 | * | 11/2001 | Kawabe | |
| 2002/0051201 A1 | * | 5/2002 | Winter et al. | |

FOREIGN PATENT DOCUMENTS

| | | | | |
|---|---|---|---|---|
| EP | 0478019 A2 | * | 4/1992 | |
| JP | 63-149669 | | 6/1988 | |
| JP | 02144571 A | * | 6/1990 | G03G/15/01 |
| JP | 9-179476 | | 1/1997 | |
| JP | 10-123918 | | 5/1998 | |
| JP | 11-109836 | | 4/1999 | |
| JP | 2002-72782 | | 3/2002 | |
| JP | 2002-72783 | | 3/2002 | |
| JP | 2002-72784 | | 3/2002 | |
| JP | 2002-72823 | | 3/2002 | |
| JP | 2002-72824 | | 3/2002 | |
| JP | 2002-72825 | | 3/2002 | |

* cited by examiner

*Primary Examiner*—Susan Lee
(74) *Attorney, Agent, or Firm*—Fitzpatrick, Cella, Harper & Scinto

(57) ABSTRACT

The information storing medium has a substrate, a storing element, provided on the substrate, for storing information, a protecting portion, covering the storing element, for protecting the storing element, an electrical contact point that is provided beside the protecting portion on a side of the substrate, on which the storing element is provided, and is electrically connected to the storing element, and a sliding region that is provided on the electrical contact point. In the information storing medium, when the storing medium is mounted on the apparatus main body, the electrical contact point contacts a main body electrical contact point provided on the apparatus main body. Also, when the electrical contact point and the main body electrical contact point contact each other, the main body electrical contact point slides on the electrical contact point in the sliding region.

29 Claims, 37 Drawing Sheets

CONNECTOR ABUTTING CONDITION

CONNECTOR ABUTTING CONDITION

CONNECTOR SPACED CONDITION

INFORMATION STORING MEDIUM, UNIT, PROCESS CARTRIDGE, DEVELOPING CARTRIDGE, AND ELECTROPHOTOGRAPHIC IMAGE FORMING APPARATUS

BACKGROUND OF THE INVENTION

1. Field of the Invention

The present invention relates to an information storing medium mounted to a main body of an electrophotographic image forming apparatus, a unit that is detachably mountable to the electrophotographic image forming apparatus, a developing cartridge, a process cartridge, and the electrophotographic image forming apparatus.

Here, the electrophotographic image forming apparatus is an apparatus that forms an image on a recording medium using an electrophotographic image forming process. Examples of the electrophotographic image forming apparatus are an electrophotographic copying machine, an electrophotographic printer (for instance, a laser beam printer, an LED printer, and the like), a facsimile apparatus, a word processor, and the like.

Also, the process cartridge integrally combines a charging means, a developing means, and a cleaning means which each function as a process means, with an electrophotographic photosensitive body into a cartridge that is detachably mountable to a main body of the electrophotographic image forming apparatus. The process cartridge also integrally combines the electrophotographic photosensitive body with at least one of the charging means, the developing means, and the cleaning means that each function as a process means into a cartridge that is detachably mountable to the main body of the electrophotographic image forming apparatus. Further, the process cartridge integrally combines at least the developing means functioning as a process means with an electrophotographic photosensitive body into a cartridge that is detachably mountable to the main body of the apparatus main body.

The developing cartridge integrally combines a developing means for developing an electrostatic latent image formed on an electrophotographic photosensitive body with a developer container (hereinafter referred to as a "toner containing portion") for containing a developer (hereinafter referred to as "toner") into a cartridge that is detachably mountable to the main body of the electrophotographic image forming apparatus.

Also, the unit includes an electrophotographic photosensitive body solely. Alternatively, the unit includes at least one process means like a developing means and a cleaning means. In some cases, the unit includes a fixing means and the like. This unit is detachably mountable to the main body of the electrophotographic image forming apparatus.

It is possible for a user to attach and detach the unit, the process cartridge, and the developing cartridge to and from the apparatus main body by himself/herself, which allows the user to perform maintenance on the apparatus main body without difficulty.

2. Related Art

Conventionally, in an electrophotographic image forming apparatus that uses an electrophotographic image forming process, there has been adopted a process cartridge system integrally combining an electrophotographic photosensitive body with a process means acting on this electrophotographic photosensitive body into a cartridge that is detachably mountable to the main body of the image forming apparatus. With this process cartridge system, a user can perform maintenance on the apparatus without depending on a serviceman, whereby a substantial improvement can be achieved in terms of operability. Thus, the process cartridge system is widely used for electrophotographic image forming apparatuses.

Also, in recent years, there has been developed a product in which a memory (storing element) for storing various kinds of service information and process information is mounted in a cartridge. As to the electrophotographic image forming apparatus, the image quality and the ease of maintenance of a cartridge are further improved by utilizing memory information of this cartridge. Also, in some cases, there are performed telecommunications with the memory of the cartridge through electrical connection with a connector provided on the main body of the electrophotographic image forming apparatus.

However, in the case where there is used a conventional contact connector, to realize reliable electrical connection, the communication mechanism of the main body of the electrophotographic image forming apparatus and the contact point of the memory on the cartridge side become complicated, and it becomes difficult to reduce the size and cost of an apparatus like a printer.

The present invention has been made in view of the unsolved problems of the background art.

SUMMARY OF THE INVENTION

An object of the present invention is to provide an information storing medium, a unit, a process cartridge, a developing cartridge, and an electrophotographic image forming apparatus in which when the information storing medium is mounted to the main body of the electrophotographic image forming apparatus, a main body electrical contact point provided on the apparatus main body contacts an electrical contact point of the information storing medium with stability and reliability.

Also, another object of the present invention is to provide an information storing medium, a unit, a process cartridge, a developing cartridge, and an electrophotographic image forming apparatus that save space and are of a reduced size.

Also, still another object of the present invention is to provide an information storing medium, a unit, a process cartridge, a developing cartridge, and an electrophotographic image forming apparatus that are capable of maintaining a contact condition with stability when an electrical contact point of the information storing medium contacts a main body electrical contact point provided on the apparatus main body.

Also, yet another object of the present invention is to provide an information storing medium, a unit, a process cartridge, a developing cartridge, and an electrophotographic image forming apparatus that are capable of ensuring a reliable electrical connection, even if scattered developer or the like adheres to the main body electrical contact point or the electrical contact point, by removing this adhering matter.

Also, yet another object of the present invention is to provide an information storing medium to be mounted to a main body of an electrophotographic image forming apparatus, comprising:

a substrate;

a storing element, provided on the substrate, for storing information;

a protecting portion, covering the storing element, for protecting the storing element;

an electrical contact point that is provided beside the protecting portion on a side of the substrate, on which the storing element is provided, and is electrically connected to the storing element, wherein when the storing medium is mounted on the apparatus main body, the electrical contact point contacts a main body electrical contact point provided on the apparatus main body; and a sliding region that is provided on the electrical contact point, wherein when the electrical contact point and the main body electrical contact point contact each other, the main body electrical contact point slides on the electrical contact point in the sliding region.

Also, yet another object of the present invention is to provide a unit detachably mountable to a main body of an electrophotographic image forming apparatus, comprising:

an information storing medium including: a substrate; a storing element, provided on the substrate and, for storing information; a protecting portion, covering the storing element, for protecting the storing element; an electrical contact point that is provided beside the protecting portion on a side of the substrate, on which the storing element is provided, and is electrically connected to the storing element, wherein when the unit is mounted on the apparatus main body, the electrical contact point contacts a main body electrical contact point provided on the apparatus main body; and a sliding region that is provided on the electrical contact point, wherein when the electrical contact point and the main body electrical contact point contact each other, the main body electrical contact point slides on the electrical contact point in the sliding region; and an information storing medium mounting portion in which the information storing medium is mounted.

Also, yet another object of the present invention is to provide a process cartridge that is detachably mountable to a main body of an electrophotographic image forming apparatus, composing:

an electrophotographic photosensitive body;

process means for acting on the electrophotographic photosensitive body;

an information storing medium including: a substrate; a storing element provided on the substrate, for storing information; a protecting portion, covering the storing element for protecting the storing element; an electrical contact point that is provided beside the protecting portion on a side of the substrate, on which the storing element is provided, and is electrically connected to the storing element, wherein when the process cartridge is mounted on the apparatus main body, the electrical contact point contacts a main body electrical contact point provided on the apparatus main body; and a sliding region that is provided on the electrical contact point, wherein when the electrical contact point and the main body electrical contact point contact each other, the main body electrical contact point slides on the electrical contact point in the sliding region; and an information storing medium mounting portion in which the information storing medium is mounted.

Also, yet another object of the present invention is to provide a developing cartridge detachably mountable to a main body of an electrophotographic image forming apparatus, comprising:

developing means for developing an electrostatic latent image formed on an electrophotographic photosensitive body with a developer; an information storing medium including: a substrate; a storing element provided on the substrate, for storing information; a protecting portion, covering the storing element, for protecting the storing element; an electrical contact point that is provided beside the protecting portion on a side of the substrate, on which the storing element is provided, and is electrically connected to the storing element, wherein when the developing cartridge is mounted on the apparatus main body, the electrical contact point contacts a main body electrical contact point provided on the apparatus main body; and a sliding region that is provided on the electrical contact point, wherein when the electrical contact point and the main body electrical contact point contact each other, the main body electrical contact point slides on the electrical contact point in the sliding region; and an information storing medium mounting portion in which the information storing medium is mounted.

Also, yet another object of the present invention is to provide an electrophotographic image forming apparatus, to which a process cartridge is detachably mountable and which forms an image on a recording medium, comprising:

(i) a main body electrical contact point;

(ii) mounting means for dismountably mounting the process cartridge, including:

an electrophotographic photosensitive body;

process means for acting on the electrophotographic photosensitive body;

an information storing medium, the information storing medium having: a substrate; a storing element provided on the substrate, for storing information; a protecting portion, covering the storing element, for protecting the storing element; an electrical contact point that is provided beside the protecting portion on a side of the substrate, on which the storing element is provided, and is electrically connected to the storing element, wherein when the process cartridge is mounted on an apparatus main body, the electrical contact point contacts the main body electrical contact point; and a sliding region that is provided on the electrical contact point, wherein when the electrical contact point and the main body electrical contact point contact each other, the main body electrical contact point slides on the electrical contact point in the sliding region; and an information storing medium mounting portion in which the information storing medium is mounted; and (iii) convey means for conveying the recording medium.

Also, yet another object of the present invention is to provide an electrophotographic image forming apparatus, to which a developing cartridge is detachably mountable and which forms an image on a recording medium, comprising:

(i) a main body electrical contact point;

(ii) mounting means for dismountably mounting the developing cartridge, including:

an electrophotographic photosensitive body;

process means for acting on the electrophotographic photosensitive body, an information storing medium, the information storing medium having: a substrate; a storing element provided on the substrate, for storing information; a protecting portion, covering the storing element, for protecting the storing element; an electrical contact point that is provided beside the protecting portion on a side of the substrate, on which the storing element is provided, and is electrically connected to the storing element, wherein when the developing cartridge is mounted on an apparatus main body, the electrical contact point contacts the main body electrical contact point; and a sliding region that is provided on the electrical contact point, wherein when the electrical contact point and the main body electrical contact point contact each other, the main body electrical contact point slides on the electrical contact point in the sliding region; and an information storing medium mounting portion in which the information storing medium is mounted; and (iii) convey means for conveying the recording medium.

DESCRIPTION OF THE PREFERRED EMBODIMENTS

Embodiments of the present invention will be described with reference to the drawings.

First Embodiment

Figure 1:
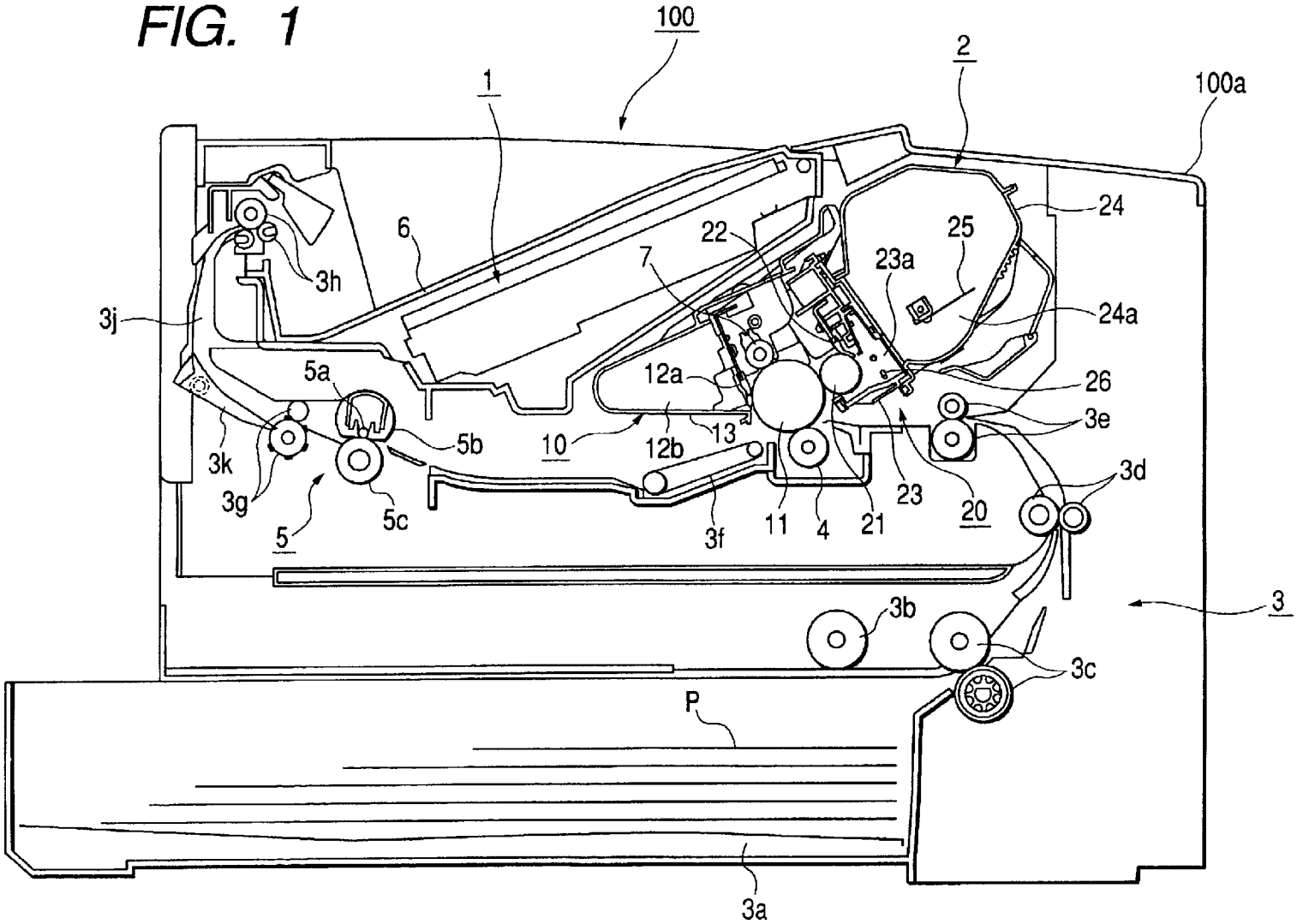
FIG. 1 is a vertical cross-sectional view showing an electrophotographic image forming apparatus according to a first embodiment of the present invention.

FIG. 1 shows an electrophotographic image forming apparatus according to the first embodiment. This apparatus includes an optical means 1 having a laser diode, a-polygon mirror, a lens, and a reflection mirror, and irradiates a photosensitive body drum 11 with laser light in accordance with image information obtained from the optical means 1. As a result of this irradiation, an electrostatic latent image is formed on the photosensitive body drum 11, which is an electrophotographic photosensitive body having a drum shape, in accordance with the image information. This latent image is developed by a developing means.

(Overall Construction of Electrophotographic Image Forming Apparatus)

A developing means that is one of process means for forming an image includes a developing roller 21 for supplying toner to the photosensitive body drum 11 and a developing blade 22 for regulating the amount of a developer adhering to the surface of the developing roller 21. Also, a developing unit 20 that is a developing device is constructed by coupling the developing roller 21, the developing blade 22, a developing frame 23 that holds these components 21 and 22, and a toner container 24 having a toner containing portion 24*a* containing the developer.

The developing frame 23 includes a developing chamber 23*a*. Toner in the toner containing portion 24*a* adjacent to the developing chamber 23*a* is fed to the developing roller 21 of the developing chamber 23*a* by the rotation of a toner feeding member 25. The developing frame 23 includes a rotatable toner agitating member 26 in the vicinity of the developing roller 21. This developing frame 23 also circulates the toner in the developing chamber 23*a* fed from the toner containing portion 24*a*. Also, the toner has magnetism and a stationary magnet is embedded in the developing roller 21. With this construction, the toner adheres onto the developing roller 21.

Also, by rotating the developing roller 21, the toner is carried and is given triboelectrification charges by the developing blade 22. Then, a toner layer having a predetermined thickness is formed on the developing roller 21 and is carried to a developing region of the photosensitive body drum 11. The toner supplied to this developing region is transferred onto the latent image on the photosensitive body drum 11, thereby forming a toner image on the photosensitive body drum 11. Note that the developing roller 21 is connected to a developing bias circuit provided on the apparatus main body. Then, in usual cases, there is applied a developing bias voltage in which a DC voltage is superimposed on an AC voltage.

On the other hand, a sheet feeding system 3 conveys a recording medium P set in a sheet feeding cassette 3*a* to a transferring position using a pickup roller 3*b* and conveying roller pairs 3*c*, 3*d*, and 3*e* in synchronization with the formation of the toner image. A transferring roller 4 functioning as a transferring means is arranged at the transferring position and the toner image on the photosensitive body drum 11 is transferred onto the recording medium P by the application of a voltage.

The recording medium P, on which the toner image has been transferred, is conveyed to a fixing means 5 by a conveying guide 3*f*. The fixing means 5 includes a driving roller 5*c* and a fixing roller 5*b* in which there is embedded a heater 5*a*, and fixes the transferred toner image on the recording medium P by applying heat and pressure onto the recording medium P passing between these rollers.

The recording medium P is conveyed by discharging roller pairs 3*g* and 3*h*, and is discharged to a discharging tray 6 through a reversing path 3*j*. This discharging tray 6 is provided on the upper surface of the apparatus main body. Note that when a rockable flapper 3*k* is operated, it is also possible to discharge the recording medium P by bypassing the reversing path 3*j*. As described above, the sheet conveying system 3 is constructed from the pickup roller 3*b*, the conveying roller pairs 3*c*, 3*d*, and 3*e*, the conveying guide 3*f*, and the discharging roller pairs 3*g* and 3*h*.

After the toner image is transferred onto the recording medium P by the transferring roller 4, toner residing on the photosensitive body drum 11 is removed by a cleaning means 12. Following this, the photosensitive body drum 11 is used for the next image forming process. The cleaning means 12 scrapes off the residual toner on the photosensitive body drum 11 using a cleaning blade 12*a* that is provided so as to be abutted against the photosensitive body drum 11. The scraped-off toner is collected in a waste toner reservoir 12*b*.

(Construction of Process Cartridge)

Figure 2:
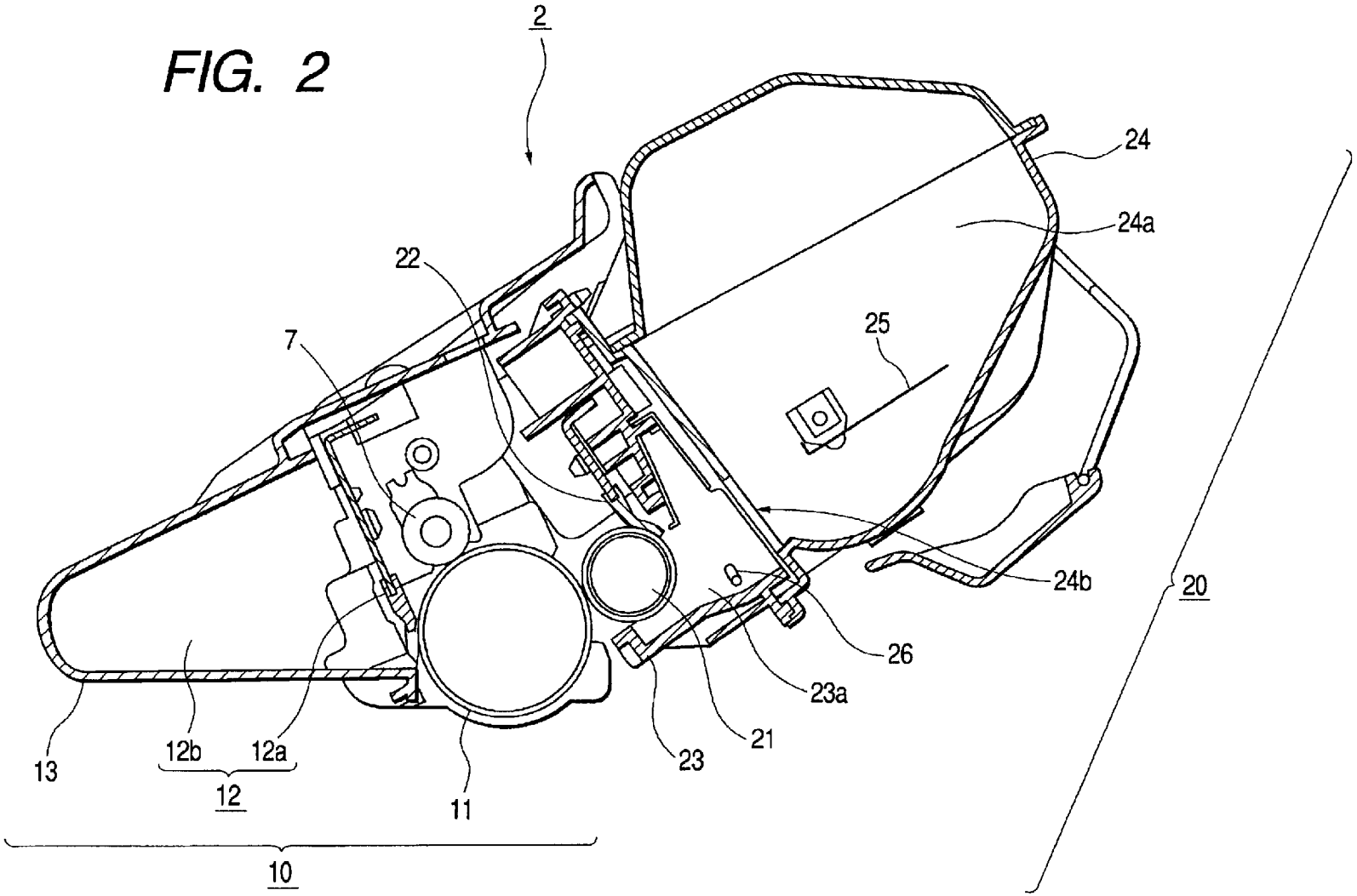
FIG. 2 is a cross-sectional view showing a process cartridge in FIG. 1.

As to the process cartridge 2, as shown in FIG. 2, the toner container 24 is welded to the developing frame 23 supporting the developing roller 21 and integrally forms the developing unit 20 (developing device). The toner container 24 forms the toner containing portion 24*a* containing the toner and a toner supplying opening 24*b* for supplying the toner in the toner containing portion 24*a* to the developing chamber 23*a*, and rotatably supports the toner feeding member 25 in the toner containing portion 24*a*. Note that the toner supplying opening 24*b* is sealed with a developer seal (not shown) until the process cartridge 2 is used. The first time the processing cartridge 2 is used, a user pulls out the developer seal, thereby making it possible to supply the toner. The developing frame 23 supports the developing roller 21 and the developing blade 22.

Also, the cleaning blade 12*a*, the photosensitive body drum 11, and a charging roller 7 are supported by a drum frame 13, thereby forming a cleaning unit 10.

Also, the process cartridge 2 integrally combines the developing unit 20 with the cleaning unit 10 into a cartridge.

Figure 3:
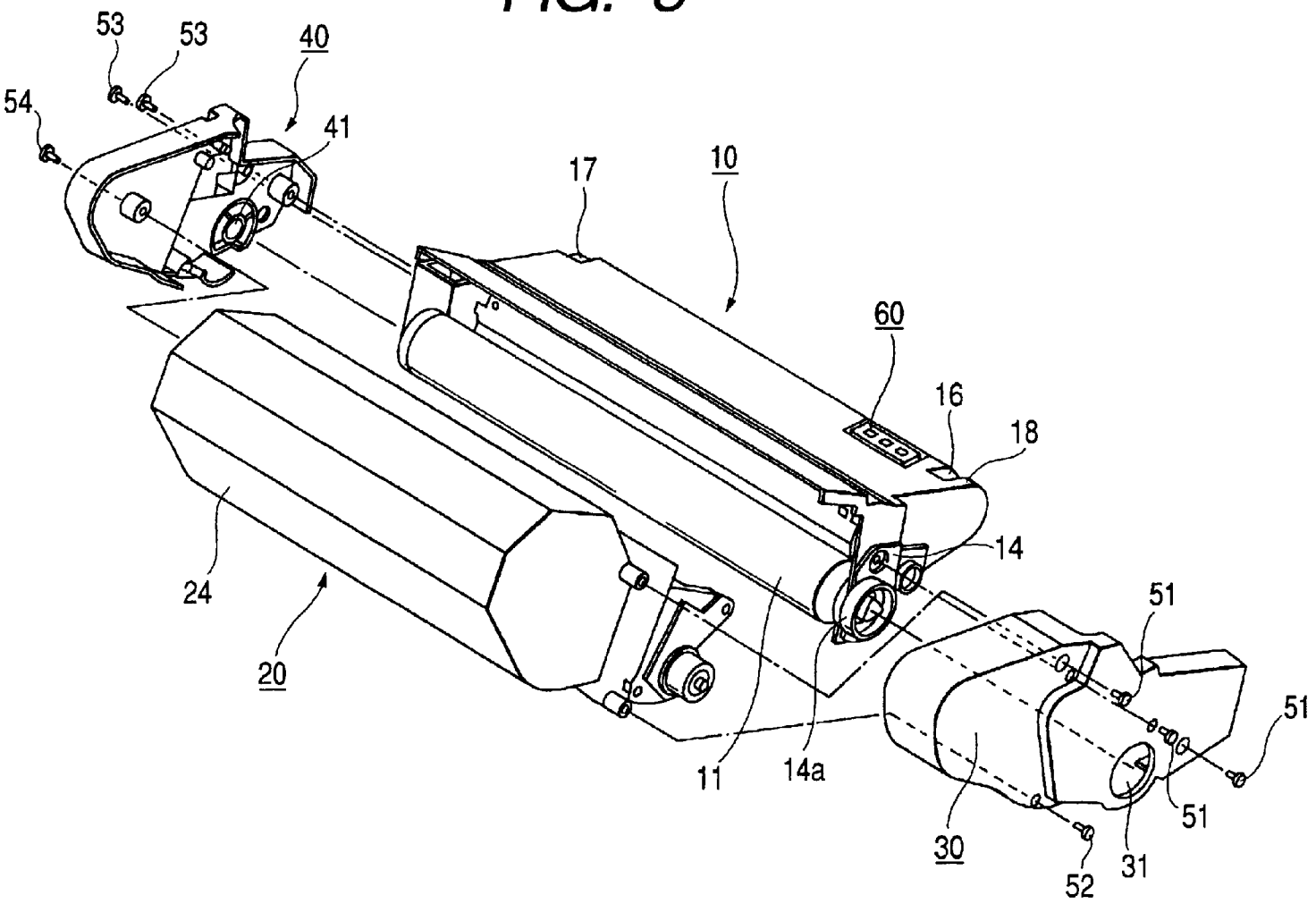
FIG. 3 is a disassembled perspective view showing the process cartridge in FIG. 2 under a disassembled condition.
Figure 4:
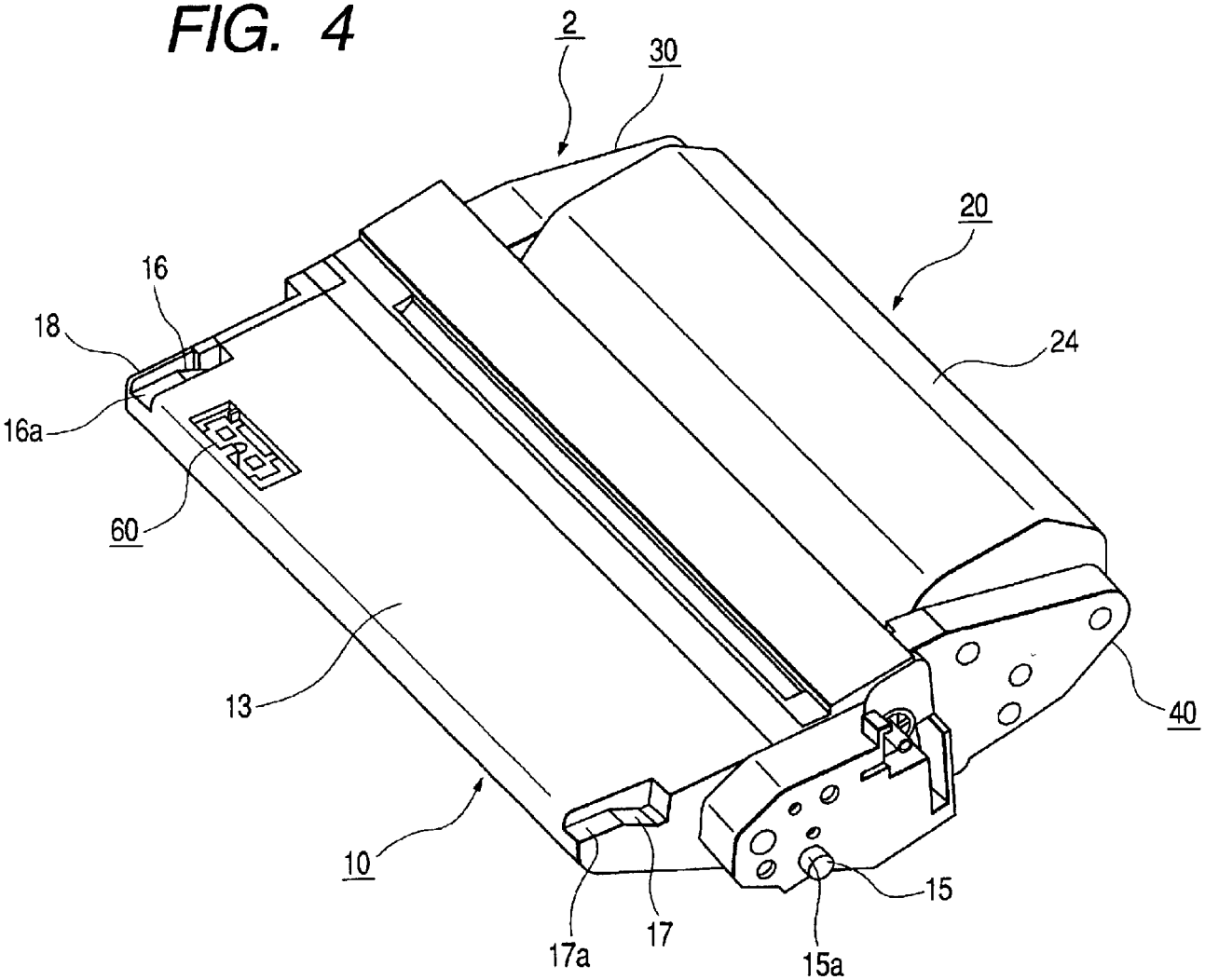
FIG. 4 is a perspective view of the process cartridge in FIG. 2 as viewed from the left side.

As shown in FIG. 3, a gear flange is attached to each end of the photosensitive body drum 11, with one of the gear flanges being rotatably supported by a drum bearing 14 and the other of the gear flanges being rotatably supported by a drum axis 15 shown in FIG. 4. Then, the drum bearing 14 and the drum axis 15 are attached to the drum frame 13, thereby constructing the cleaning unit 10.

(Coupling of Cleaning Unit and Developing Unit)

Next, there will be described a construction for coupling the cleaning unit 10 to the developing unit 20. As shown in FIG. 3, the cleaning unit 10 and the developing unit 20 are coupled to each other by side covers 30 and 40 on both sides. In the FIG. 3, the side cover 30 on the right side is positioned against the cleaning unit 10 by fitting a cylindrical portion 14*a* of the drum bearing 14 into a reference hole 31 and is fixed with screws 51. Then, by fitting a reference boss of the side cover 30 into a reference hole of the developing unit 20, the developing unit 20 is positioned and is fixed with a screw 52 in the same manner as above.

On the other hand, the side cover 40 on the left side is positioned against the cleaning unit 10 by fitting a cylindrical portion 15*a* of the drum axis 15 of the photosensitive body drum 11 into a reference hole 41, and is fixed with screws 53. Also, the developing unit 20 is fixed with a screw 54 in the same manner as the opposite side.

(Construction of Guide Means for Process Cartridge)

Figure 14:
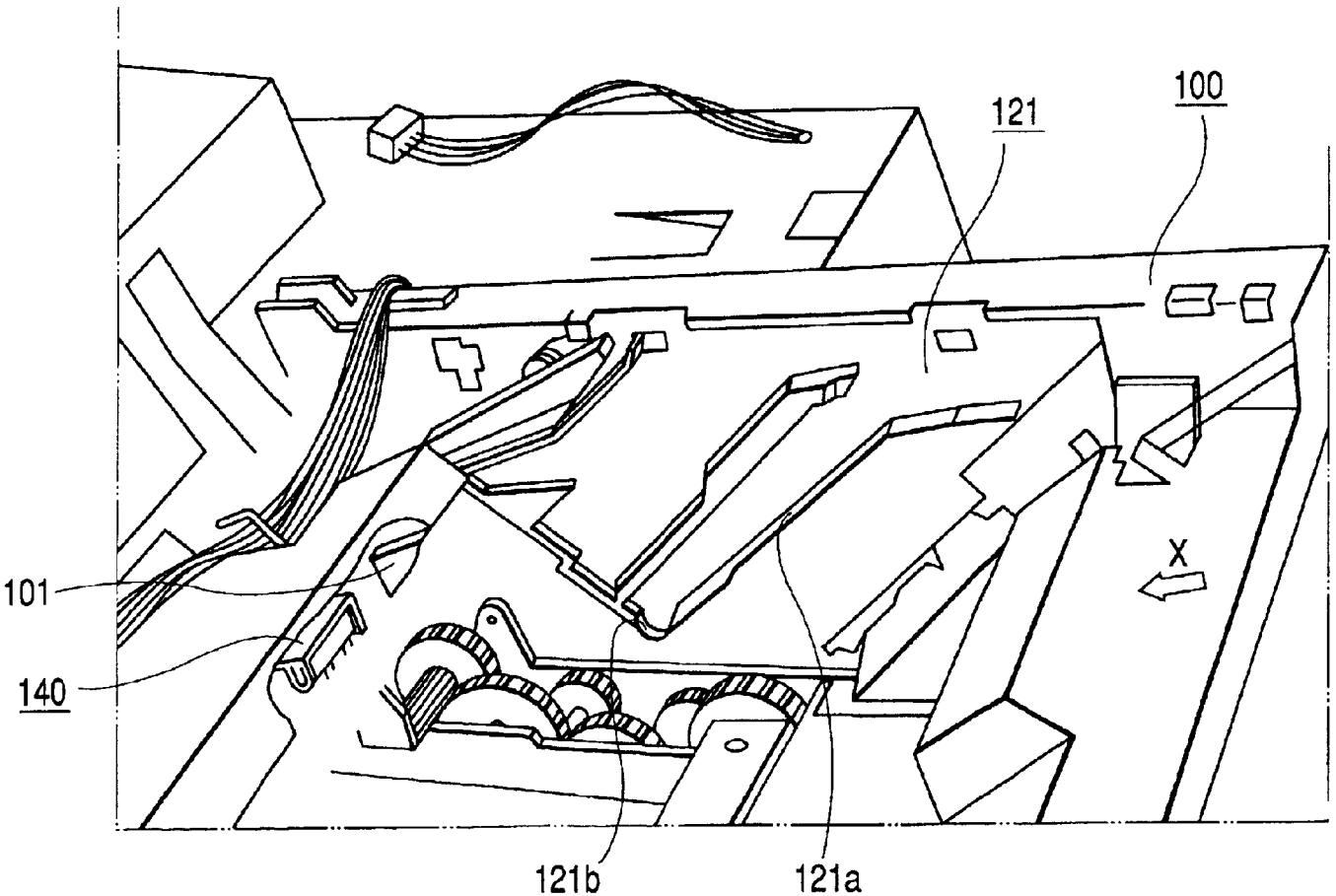
FIG. 14 is a perspective view showing a guide portion of the electrophotographic image forming apparatus main body on the right side.
Figure 15:
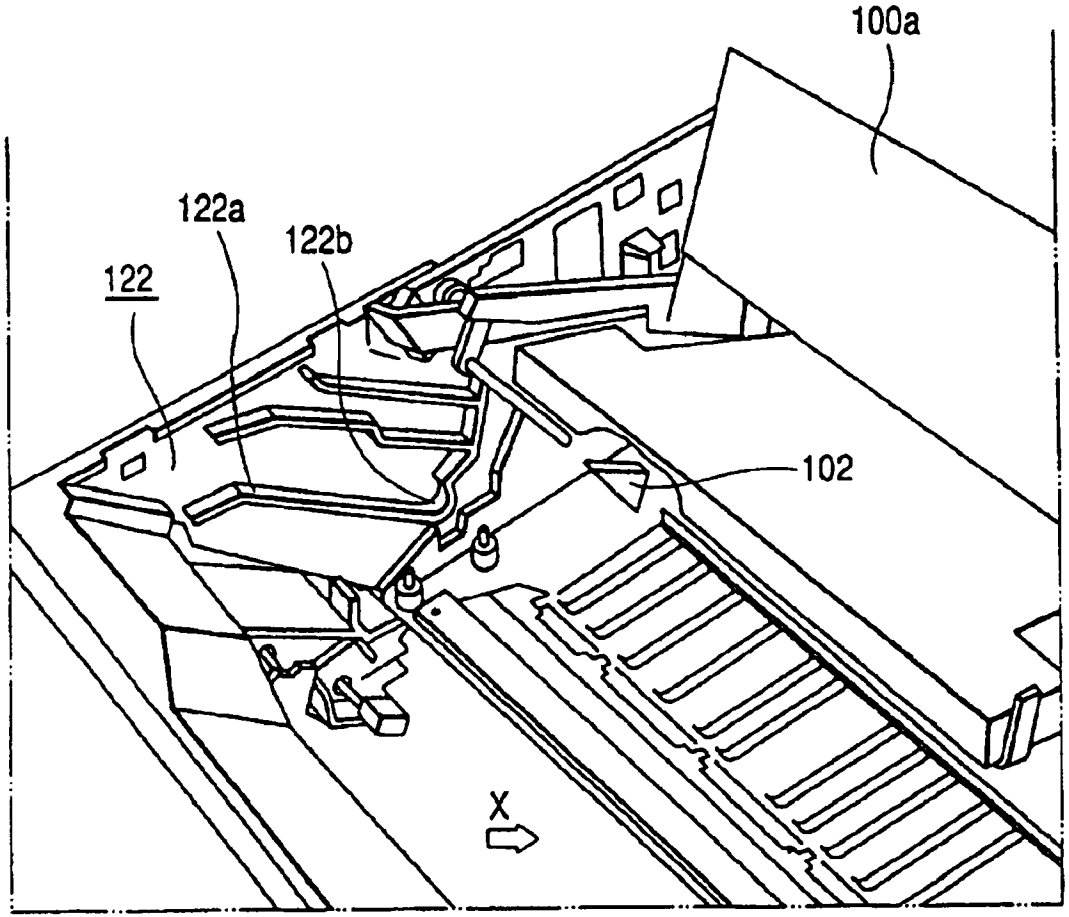
FIG. 15 is a perspective view showing a guide portion of the electrophotographic image forming apparatus main body on the left side.

Next, a guide means used to attach and detach the process cartridge 2 to and from the apparatus main body 100 will be described with reference to FIGS. 14 and 15. FIG. 14 is a perspective view showing a part of the apparatus main body 100 positioned on the right side of the developing unit 20 when viewed in a direction (direction of arrow X) in which the process cartridge 2 is mounted to the apparatus main body 100. FIG. 15 is a perspective view similarly showing a part of a main body frame 100 positioned on the left side of the developing unit 20.

On both of outer side surfaces of the cleaning unit 10, the outside diameter of the cylindrical portion 14*a* of the drum bearing 14 and the outside diameter of the cylindrical portion 15*a* of the drum axis 15 shown in FIGS. 3 and 4 constitute a guide means (guide member) on the process cartridge side used to attach and detach the process cartridge 2 to and from the apparatus main body 100.

As shown in FIGS. 3 and 4, on the upper surface of the drum frame 13 constituting the cleaning unit 10, that is, on the surface positioned upward when the process cartridge 2 is mounted to the apparatus main body 100, regulating abutting portions 16 and 17 are respectively provided at end portions in a longitudinal direction perpendicular to the direction in which the process cartridge is mounted. Both of these abutting portions 16 and 17 regulate the position of the process cartridge 2 when the process cartridge 2 is mounted to the apparatus main body 100.

That is, when the process cartridge 2 is mounted to the apparatus main body 100, the abutting portions 16 and 17 are respectively abutted against fixed members 101 and 102 provided on the apparatus main body 100, as shown in FIGS. 14 and 15. As a result, there is regulated the rotation position of the process cartridge 2 whose center is the cylindrical portion 14*a* of the drum bearing 14 and the cylindrical portion 15*a* of the drum axis 15.

Next, there will be described a guide means for guiding the process cartridge 2 (guide wall) provided on the apparatus main body 100 side. When an opening/closing member 100*a* of the apparatus main body 100 shown in FIG. 1 is rotated in a counterclockwise direction about its fulcrum, the upper portion of the apparatus main body 100 is opened. FIGS. 14 and 15 are partial perspective views showing mounting guide portions on both of the left and right ends of the process cartridge 2 under this condition, with the mounting guide portions guiding the process cartridge 2 to the apparatus main body 100. FIGS. 14 and 15 respectively show the right side and the left side of the internal wall of the apparatus main body 100 viewed through the opening portion obtained by opening the opening/closing member 100*a* in the direction (X direction) in which the process cartridge 2 is attached or detached in the manner described above.

A guide member 121 is arranged on the right side of the internal wall of the apparatus main body 100 as shown in FIG. 14, while a guide member 122 is formed on the left side of the internal wall as shown in FIG. 15.

The guide members 121 and 122 respectively include guide portions 121*a* and 122*a* that are provided so as to be inclined downward from the front when viewed from the direction of arrow X that is the direction in which the process cartridge 2 is inserted. The guide members 121 and 122 also respectively include half-round positioning grooves 121*b* and 122*b* that are respectively connected to these guide portions 121*a* and 122*a*, with the cylindrical portion 14*a* of the drum bearing 14 and the cylindrical portion 15*a* of the drum axis 15 of the process cartridge 2 being just fitted into the positioning grooves 121*b* and 122*b*. The peripheral walls of these positioning grooves 121*b* and 122*b* have a cylindrical shape and the centers of these positioning grooves 121*b* and 122*b* respectively coincide with the centers of the cylindrical portion 14*a* of the drum bearing 14 and the cylindrical portion 15*a* of the drum axis 15 of the process cartridge 2 when the process cartridge 2 is mounted to the apparatus main body 100, and also coincide with the center line of the photosensitive body drum 11.

The width of the guide members 121 and 122 is set so that the cylindrical portion 14*a* of the drum bearing 14 and the cylindrical portion 15*a* of the drum axis 15 are loosely fitted when viewed from the direction in which the process cartridge 2 is attached and detached. Also, under a condition where the process cartridge 2 is mounted to the apparatus main body 100, the cylindrical portion 14*a* of the drum bearing 14 and the cylindrical portion 15*a* of the drum axis 15 of the process cartridge 2 are respectively fitted into the positioning grooves 121*b* and 122*b* of the guide members 121 and 122 of the apparatus main body. Also, the abutting portions 16 and 17 on the both sides of the drum frame 13 of the process cartridge 2 are abutted against the fixed members 101 and 102 of the apparatus main body.

(Construction of Laser Shutter)

Figure 16:
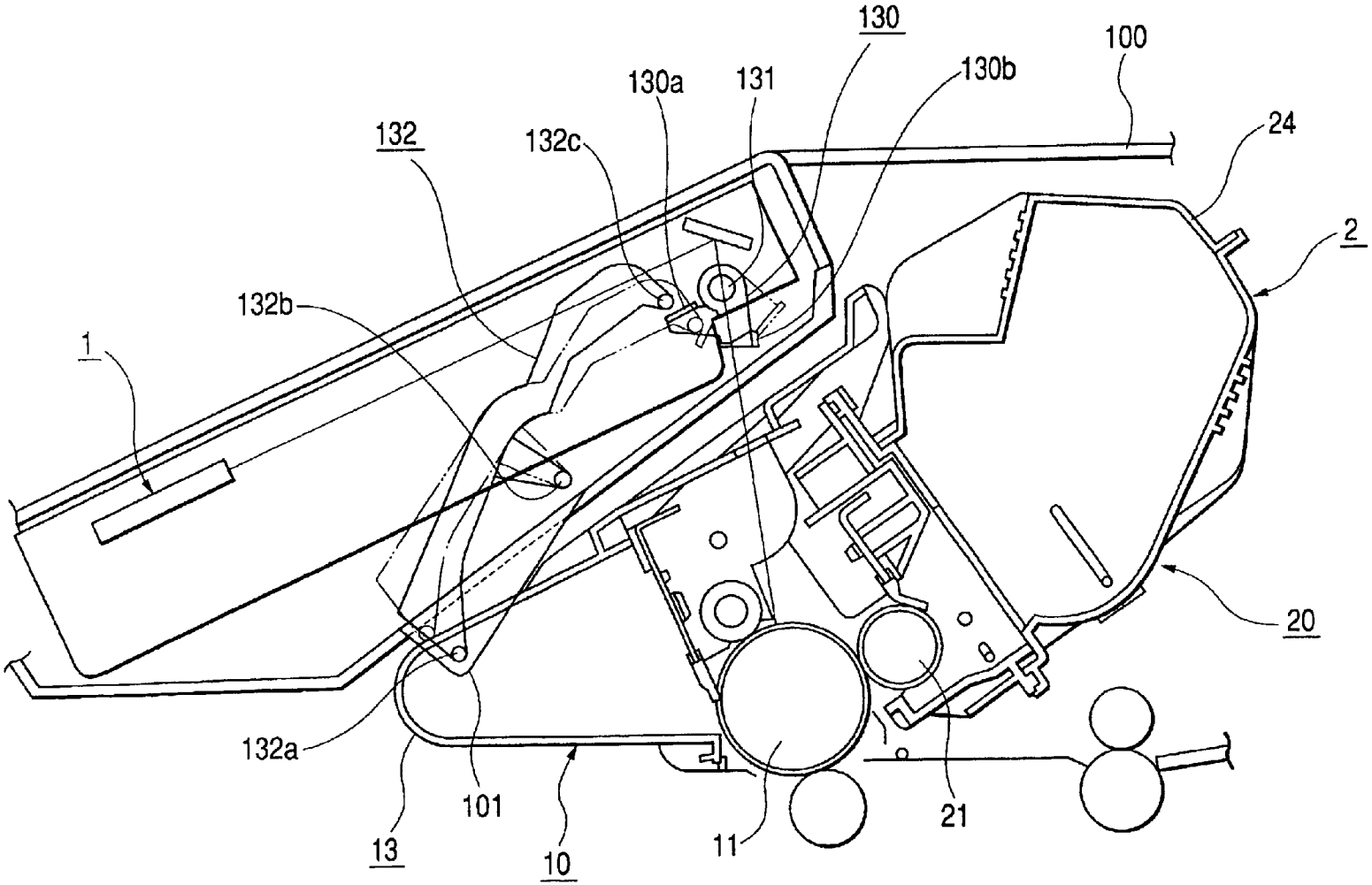
FIG. 16 illustrates a laser shutter.

As shown in FIG. 16, to prevent the leakage of laser light from the optical means 1 under a condition where the process cartridge 2 is not mounted to the apparatus main body 100, there is provided a laser shutter 130 for blocking a laser light path.

Figure 18:
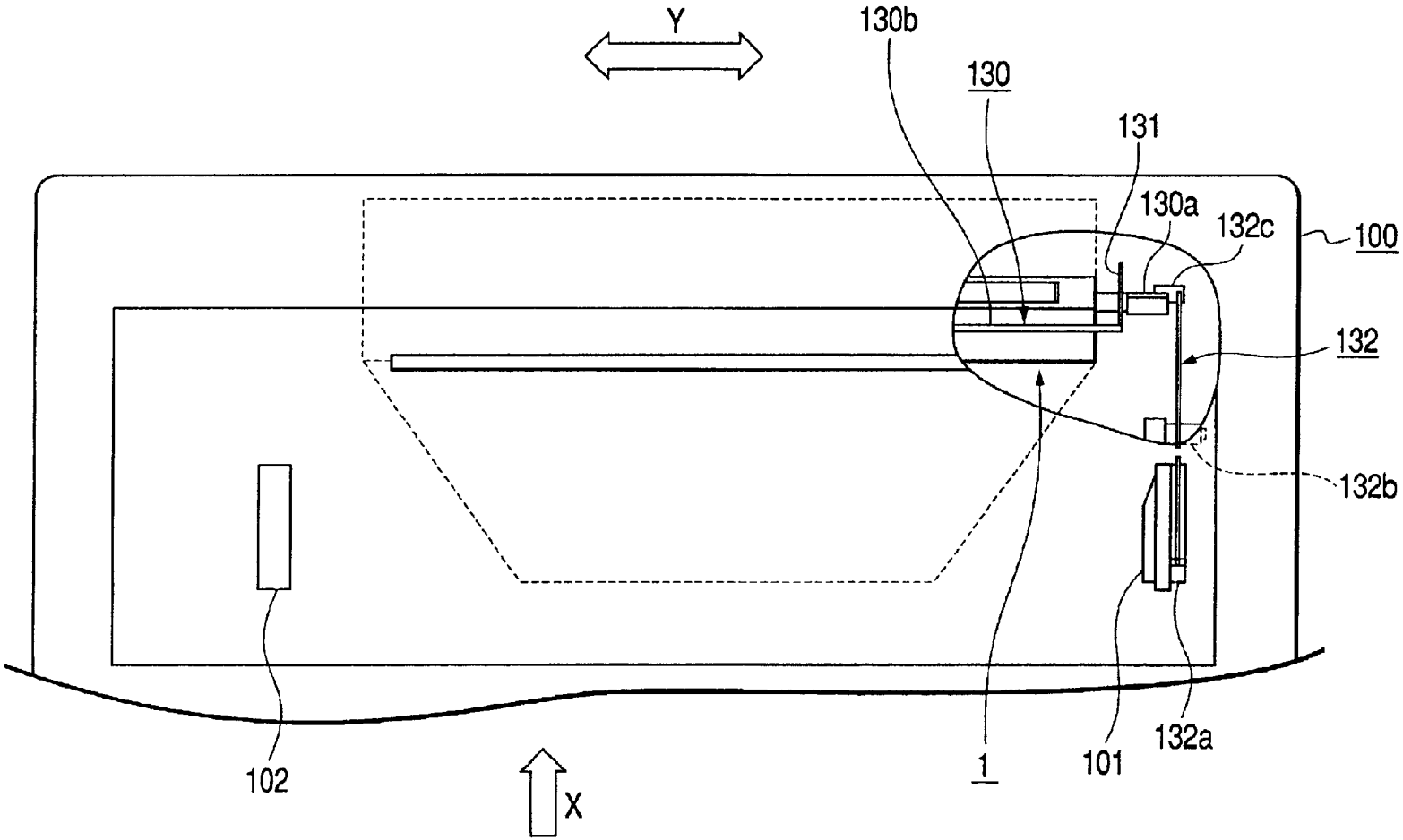
FIG. 18 illustrates the arrangement of the laser shutter.

The laser shutter 130 is rotatably provided about a shutter fulcrum 131 of the apparatus main body 100 by a spindle or the like (not shown). A shutter link 132 for rotating the laser shutter 130 is rotatably provided on the main body frame 100 by a bearing or the like (not shown). Further, as shown in FIG. 18, this shutter link 132 is arranged between the fixed member 101, against which the abutting portion 16 of the drum frame 13 is abutted when the process cartridge 2 is mounted, and the right side wall of the apparatus main body 100 in a direction of Y perpendicular to the direction of arrow X (direction from the front to the back in the drawing) in which the process cartridge 2 is mounted. Further, in the direction in which the process cartridge 2 is mounted, this shutter link 132 is arranged on a back side of the fixed member 101.

Next, there will be described how the laser shutter 130 and the shutter link 132 operate.

Figure 17:
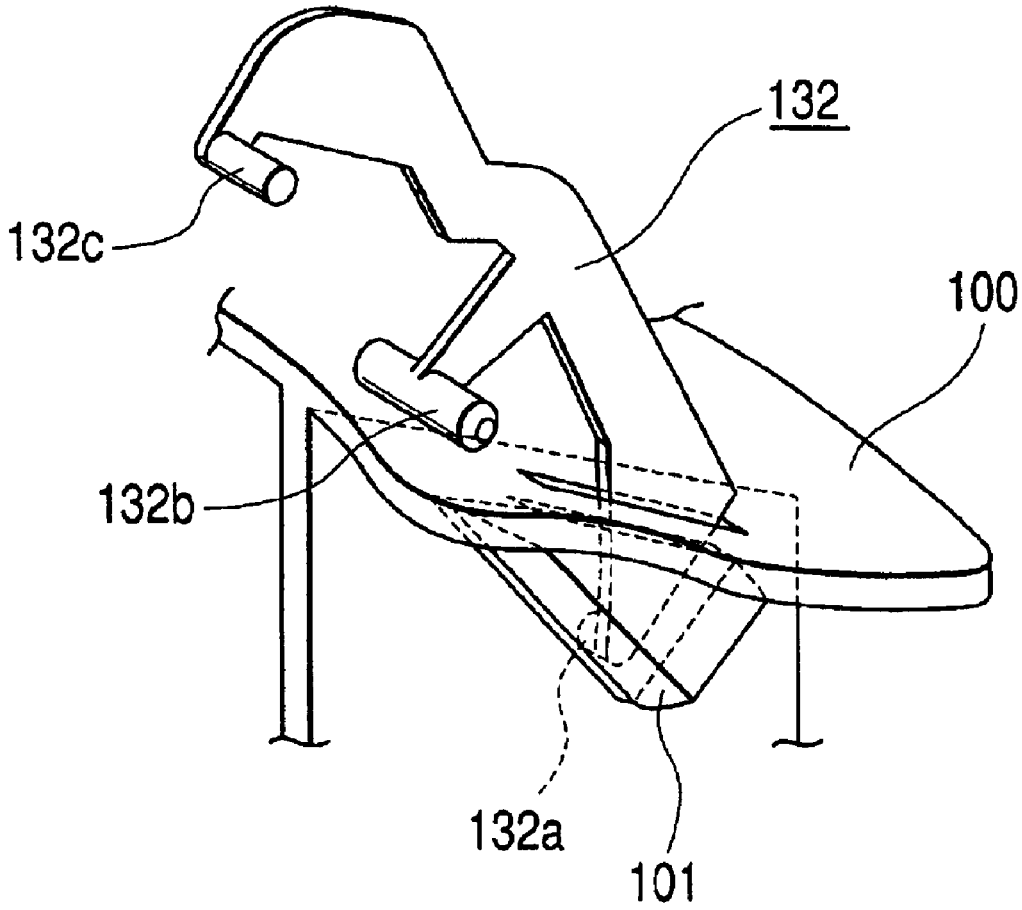
FIG. 17 illustrates a drive portion of the laser shutter.

When the process cartridge 2 is not mounted to the apparatus main body 100, the laser shutter 130 is urged by a spring or the like (not shown) in a clockwise direction in FIG. 16 about the shutter fulcrum 131. At a position at which a shutter portion 130*a* is abutted against the optical means 1, the laser shutter 130 blocks a laser light path. Also, in a step for mounting the process cartridge 2 to the apparatus main body 100, a rib 18, that is a wall member provided beside the abutting portion 16 of the drum frame 13 of the process cartridge 2, is abutted against an abutting portion 132*a* of the shutter link 132 (see FIGS. 4 and 17). As described above, when the rib 18 of the drum frame 13 of the process cartridge 2 is abutted against the abutting portion 132*a* of the shutter link 132, the shutter link 132 rotates in the clockwise direction in FIG. 16 about a spindle 132*b*.

Under this condition, a boss 132*c* of the shutter link 132 is abutted against and is pressed by the abutting portion 130*a* of the laser shutter 130. As a result, the laser shutter 130 is rotated in a counterclockwise direction about the shutter fulcrum 131 and a shutter portion 130*b* is retracted from the laser light path as indicated by a broken line.

As a result, when the process cartridge 2 is mounted to a predetermined position of the apparatus main body, the laser light path is not blocked by the shutter portion 130*b* of the laser shutter 130, which makes it possible to reliably irradiate the photosensitive body drum 11 with laser light.

(Construction of Memory Tag)

Figure 5:
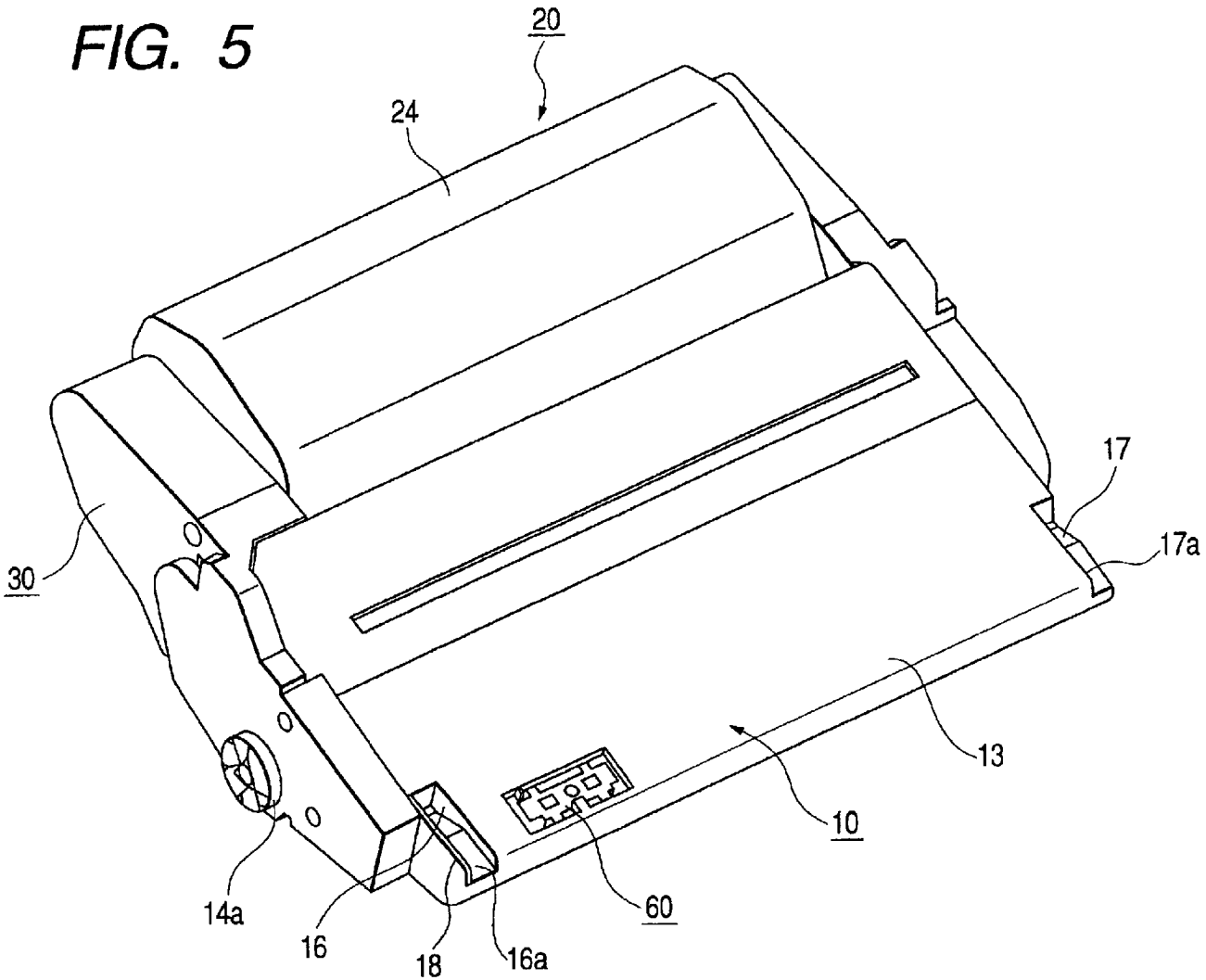
FIG. 5 is a perspective view of the process cartridge in FIG. 2 as viewed from the right side.
Figure 6:
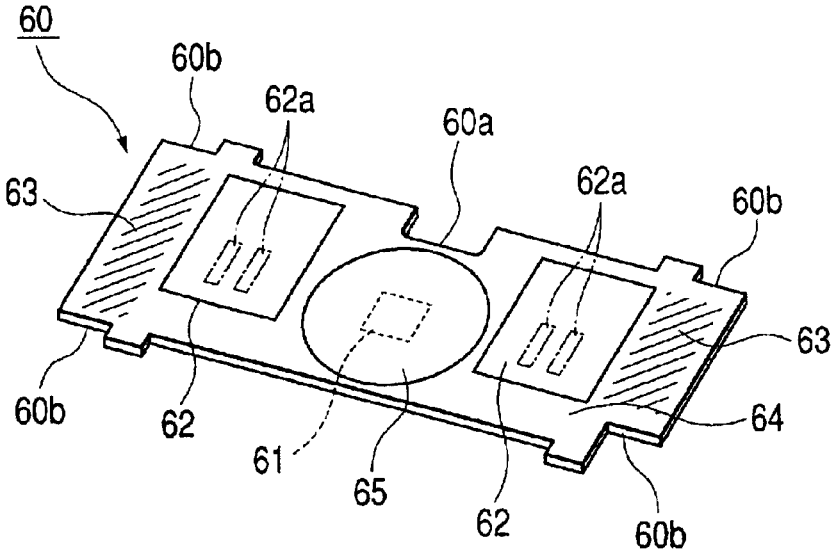
FIG. 6 is a perspective view showing a memory tag.
Figure 7:
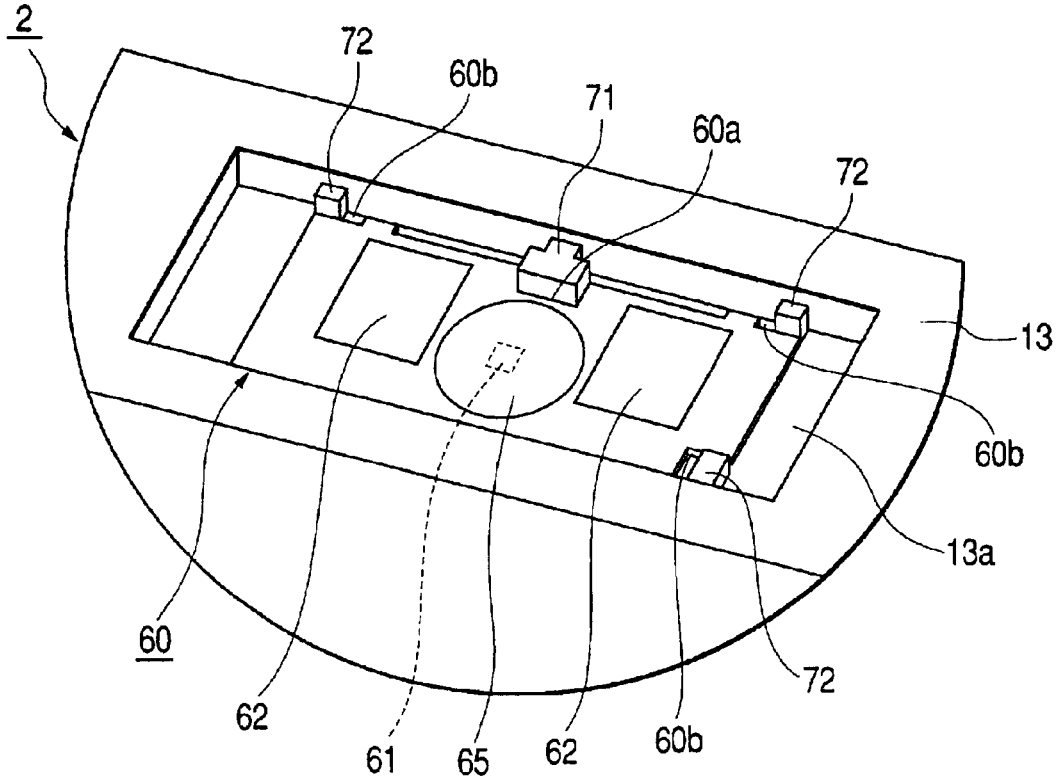
FIG. 7 is a perspective view showing a state where the memory tag is attached to the process cartridge.

As shown in FIGS. 4 and 5, a memory tag 60 that is an information storing medium is attached to the surface of the drum frame 13 of the cartridge 2. As shown in FIGS. 6 and 7, the memory tag 60 is a tag-shaped member obtained by arranging a storing element 61, contact points 62, and abutting portions 63, against which a main body bumping member or portion 141 of a connector 140 to be described later is abutted, on a substrate (printed board) 64 that is a base body.

The storing element 61 is arranged at the center and is protected with a coating layer 65 (protecting portion) made of a resin. Also, the contact points 62 are arranged in parallel on the same plane as the storing element 61 and on both sides of the coating layer 65 protecting the storing element 61. Further, in the vicinity of each contact point 62, there is arranged in parallel an abutting portion 63 against which the bumping portions 141 of the connector 140 shown in FIG. 10 are abutted.

Figure 10:
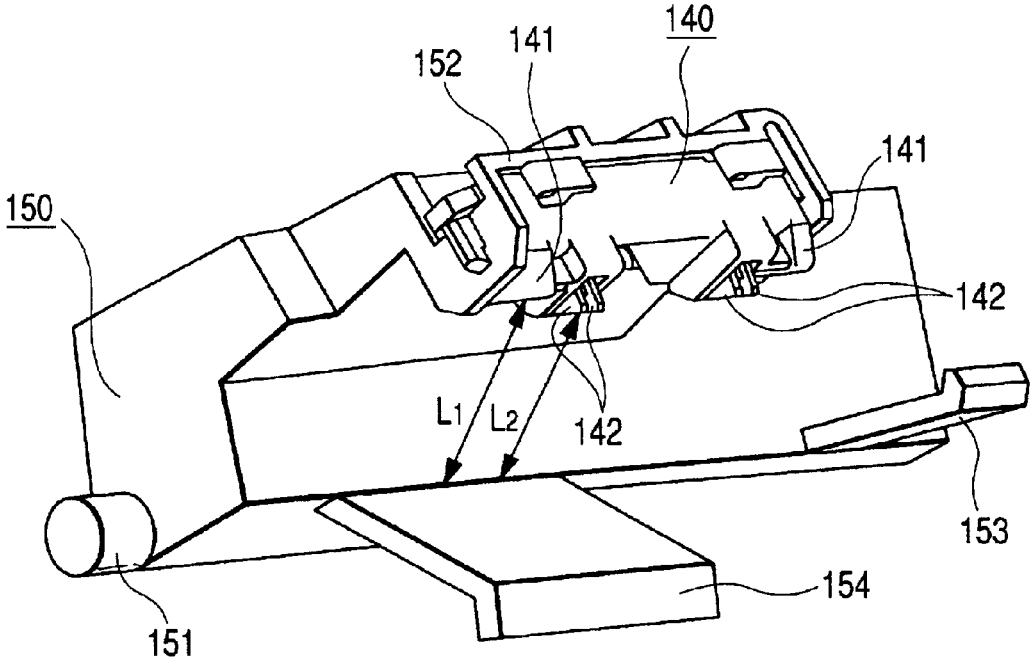
FIG. 10 is a perspective view showing the connector.
Figure 11:
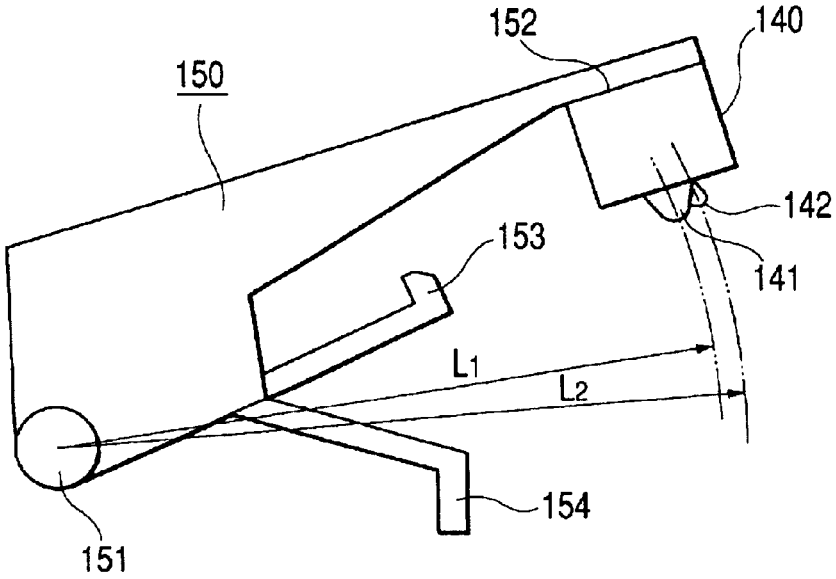
FIG. 11 is a side view showing the connector.
Figure 12A:
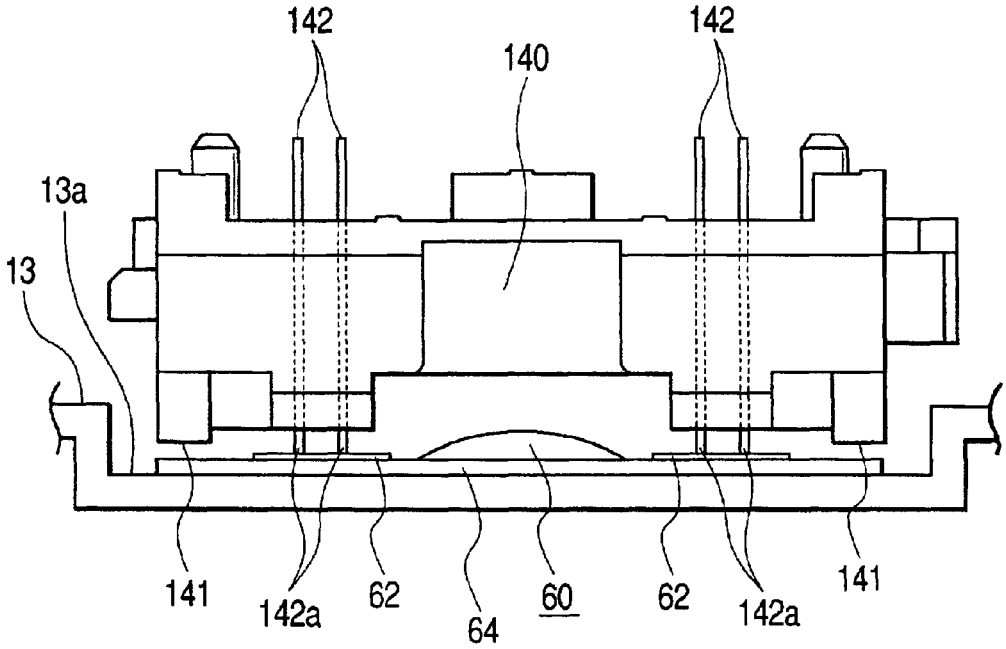
FIGS. 12A and 12B are partial views showing abutting portions of the memory tag and the connector.
Figure 12B:
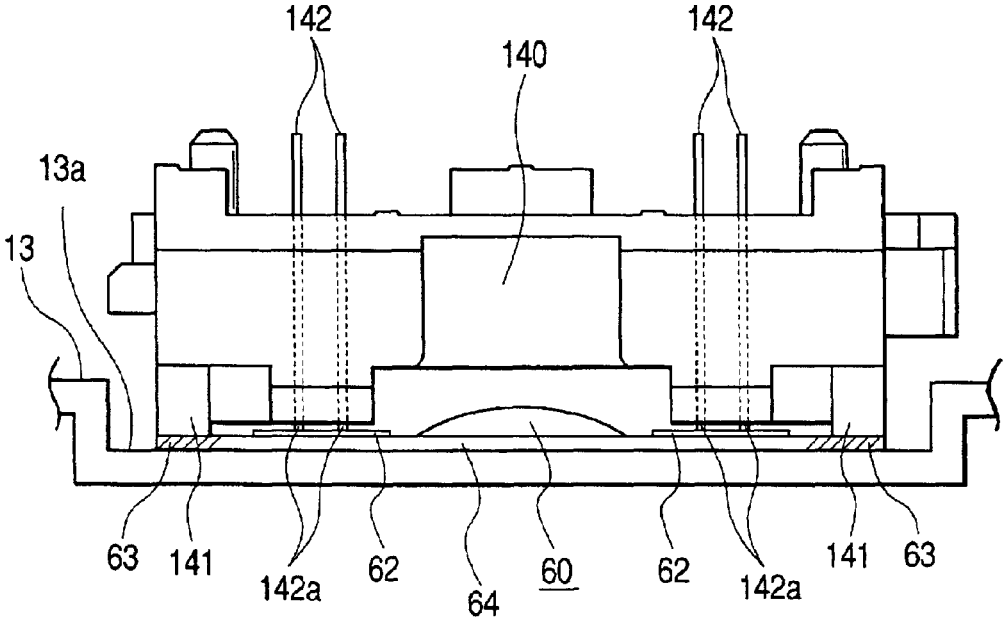

As shown in FIGS. 10 and 11, the connector 140 is provided with electrical contact points 142 (main body electrical contact points) made of a metal, which generate contact pressure by utilizing their elastic deformation. Also, as shown in FIG. 12A, when the cartridge 2 is mounted to the apparatus main body, a leading end 142*a* of each electrical contact point 142 is first abutted against a corresponding contact point 62 (electrical contact point) of the memory tag 60. Next, as shown in FIG. 12B, each bumping portion 141 is abutted against a corresponding abutting portion 63 of the memory tag 60. As a result, the amount of deflection of each electrical contact point 142 becomes constant, thereby setting the contact pressure exerted on each contact point 62 of the memory tag 60 at a desired contact pressure and stabilizing the electrical connection.

Further, the abutting portions 63 of the memory tag 60 are provided on the same surface side of the substrate 64 as the contact points 62, so that the size accuracy in a height direction of the abutting portions 63 and the contact points 62 in the memory tag 60 is enhanced. As a result, it becomes possible to further enhance the stability of the contact pressure of the electrical contact points 142 of the connector 140. Also, as to the contact points 62 of the memory tag 60 of this embodiment, a copper foil surface is given Ni plating and is further given gold plating. By giving multi-layered plating in this manner, there is prevented corrosion and abrasion of the contact points 62.

Also, the contact points 62 are provided on both sides of the coating layer 65 (protecting portion) protecting the storing element 61 of the memory tag 60, and the abutting portions 63 are arranged in a plane manner on an extension line of both of the contact points 62, as well being arranged as adjacent to the contact points 62.

By providing the abutting portions 63 like this, it becomes possible to obtain a distance $L_1$ from a rotation axis 151 of a connector holder 150 shown in FIGS. 10 and 11 to the bumping portion 141 of the connector 140 that is virtually equal to a distance $L_2$ therefrom to the electrical contact point 142. This reduces the influences of variations in height size between the bumping portions 141 and makes it possible to stabilize the contact pressure of the electrical contact points 142.

Also, the abutting portions 63 of the memory tag 60 are provided parallel to the contact points 62 and the distances from the abutting portions 63 to the bumping portions of the connector 140 are virtually equal to the distances therefrom to the electrical contact points 142. As a result, a uniform pressure balance is obtained and it becomes possible to prevent poor conduction due to insufficient contact pressure on the contact points 62 or the like.

It should be noted here that in this embodiment, as shown in FIG. 6, the abutting portions 63 are provided parallel to the contact points 62 with the coating layer 65 being sandwiched therebetween. However, the present invention is not limited to this, and the abutment may be performed against the outer peripheral parts of the contact points 63 or the contact points 62.

Next, there will be described a construction for attaching the memory tag 60.

As shown in FIGS. 6 and 7, the memory tag 60 is attached to a mounting portion 13*a* (information recording medium mounting portion) of the drum frame 13 that is a frame of the cartridge 2. On one end side of the memory tag 60 in a widthwise direction, there is provided a groove portion 60*a* that is a concave shaped notched portion between the contact points 62 in the longitudinal direction. Also, a rib 71 (process cartridge positioning member) that is a contact point positioning portion perpendicular to the longitudinal direction of the memory tag 60 is formed for the cartridge 2. By fitting the rib 71 into the concave shaped groove portion 60*a* of the memory tag 60, the positioning in the longitudinal direction is performed. Also, the positioning in the widthwise direction is performed by abutting bumping portions 60*b* of the memory tag 60 against positioning portions 72 provided on the mounting portion 13*a* (information recording medium mounting portion).

As described above, the positioning is performed using the concave shaped notched portion, so that even if the direction, in which the mold used to form the attaching portion of the cartridge 2 for the memory tag 60 is pulled out, is not parallel to the surface including the contact points 62 of the memory tag 60, it becomes possible to perform the positioning in the longitudinal direction. As a result, the construction of the mold does not influence the positioning of the memory tag 60 in the longitudinal direction and is able to be used for a plurality of products, which contributes to the reduction of costs due to the advantages generated by mass production.

Also, if the positioning is performed using a hole (round hole, square hole), the size of the memory tag is increased. However, because the concave shaped notched portion described above is used, it becomes possible to prevent the increase of the size of the memory tag.

Further, if the positioning is performed using a hole (round hole, square hole), there is the possibility that there occurs prying when a positioning boss is fitted into a positioning hole, which risks degrading the ability to assemble the apparatus. In particular, in this embodiment, there is used a thin substrate having a thickness of around 0.6 mm, which increases the possibility that there occurs the prying and risks degrading the ability to assemble the apparatus. However, the concave shape described above precludes the possibility of the prying and therefore precludes the degradation of the assembly of the apparatus.

Also, if an attempt is made to attach the memory tag 60 to the process cartridge 2 in an irregular direction, the rib 71 (process cartridge positioning member) is abutted against the substrate 64 of the memory tag 60, which hinders the mounting. This means that the rib 71 also carries out a function of preventing the inverted attachment of the memory tag 60.

Next, there will be described a construction of the connector provided on the apparatus main body 100.

As shown in FIG. 10, one or two electrical contact points 142 made of a metal that generates contact pressure by utilizing its elastic deformation are arranged on the connector 140 for each connection point 62 of the memory tag 60. In the case where there are used two electrical contact points 142, the interval between these electrical contact points 142 is set to around 2 mm. Also, beside the electrical contact points 142, the bumping portions 141 that are each abutted against the abutting portions 63 of the memory tag 60 are provided in the vicinity of both ends in the longitudinal direction. On a side of each electrical contact point 142 opposite to a contact portion with the memory tag 60, there is connected a lead wire, thereby establishing connection with a control portion (not shown) of the apparatus main body 100.

The connector holder 150 includes a rotation axis 151, a connector attaching portion 152, a longitudinal positioning lever 153, and an abutting rotary lever 154.

Figure 9:
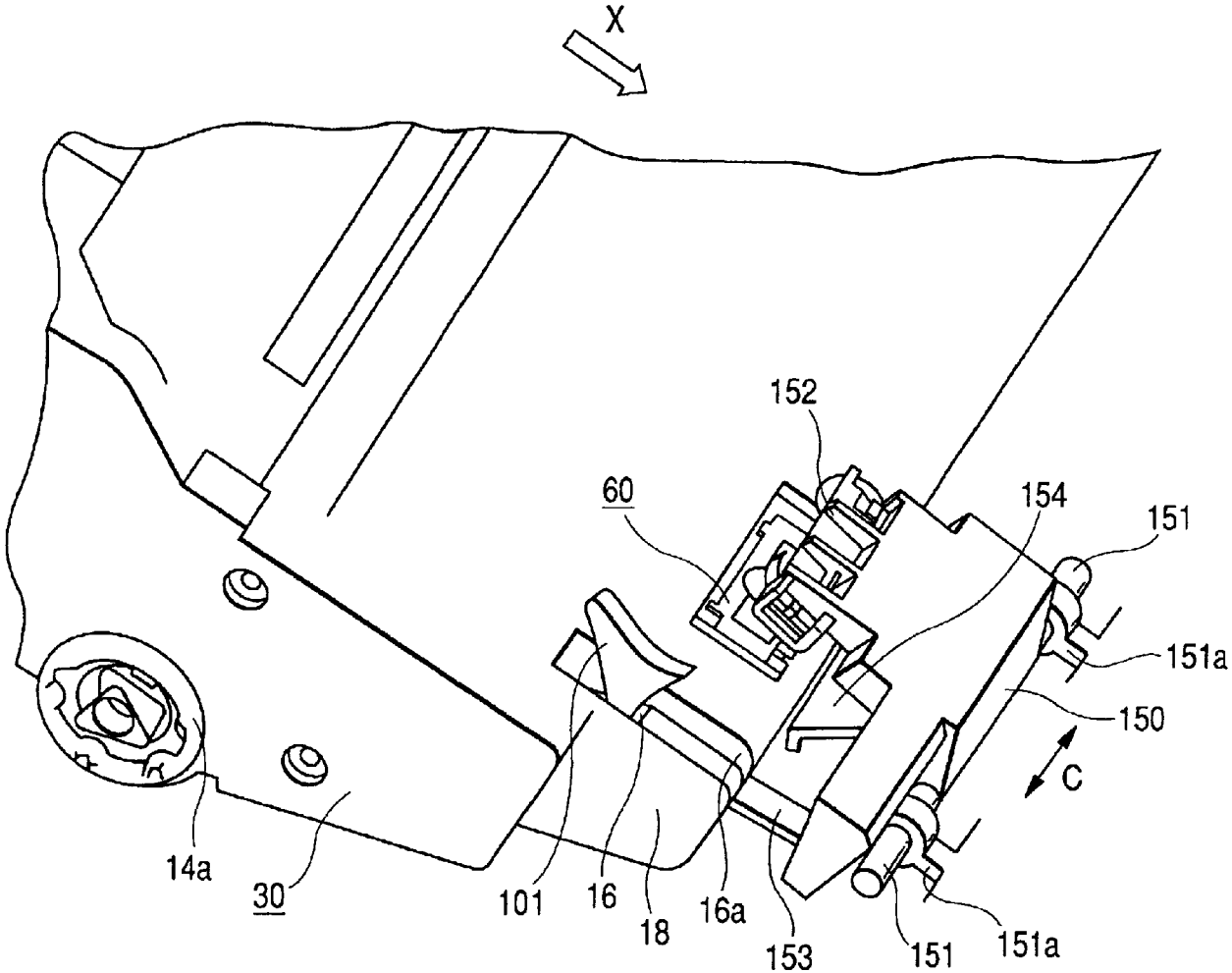
FIG. 9 is a magnified perspective view showing the arrangement of the memory tag and the connector.

The connector 140 is fixed to the connector holder 150 with a snap fit connection, a screw, or the like (not shown). Also, as has been described above, the connector holder 150 rotates about the rotation axis 151. Further, as shown in FIG. 9, the rotation axis 151 is held by the apparatus main body 100 through the bearings 151*a* so as to be slidable in the longitudinal direction (direction of arrow C).

Next, the connection between the connector 140 and the memory tag 60 will be described by following the procedure for mounting the cartridge 2 to the apparatus main body 100.

The abutting portion 16 on the right side of the cartridge 2 is provided within a groove 16*a* that is a mounting guide portion whose one end is the rib 18 that opens/closes the laser shutter 130 that is a laser light blocking member (exposure light blocking member) of the apparatus main body 100. Also, the abutting portion 17 on the left side is provided within the groove 17*a* that is a mounting guide portion whose outer side is opened. As shown in FIG. 9, if the cartridge 2 is inserted into the apparatus main body 100 in a direction of arrow X, the fixed members 101 and 102 of the apparatus main body 100 are respectively nipped by the grooves 16*a* and 17*a* that are the mounting guide portions during the insertion, thereby performing the guiding in the direction in which the cartridge 2 is mounted. When the cartridge is further inserted, the longitudinal positioning lever 153 of the connector holder 150 that is arranged so as to be movable in the longitudinal direction also enters into the end portion of the groove 16*a*, so that the connector 140 and the cartridge 2 are positioned in the longitudinal direction.

Figure 8:
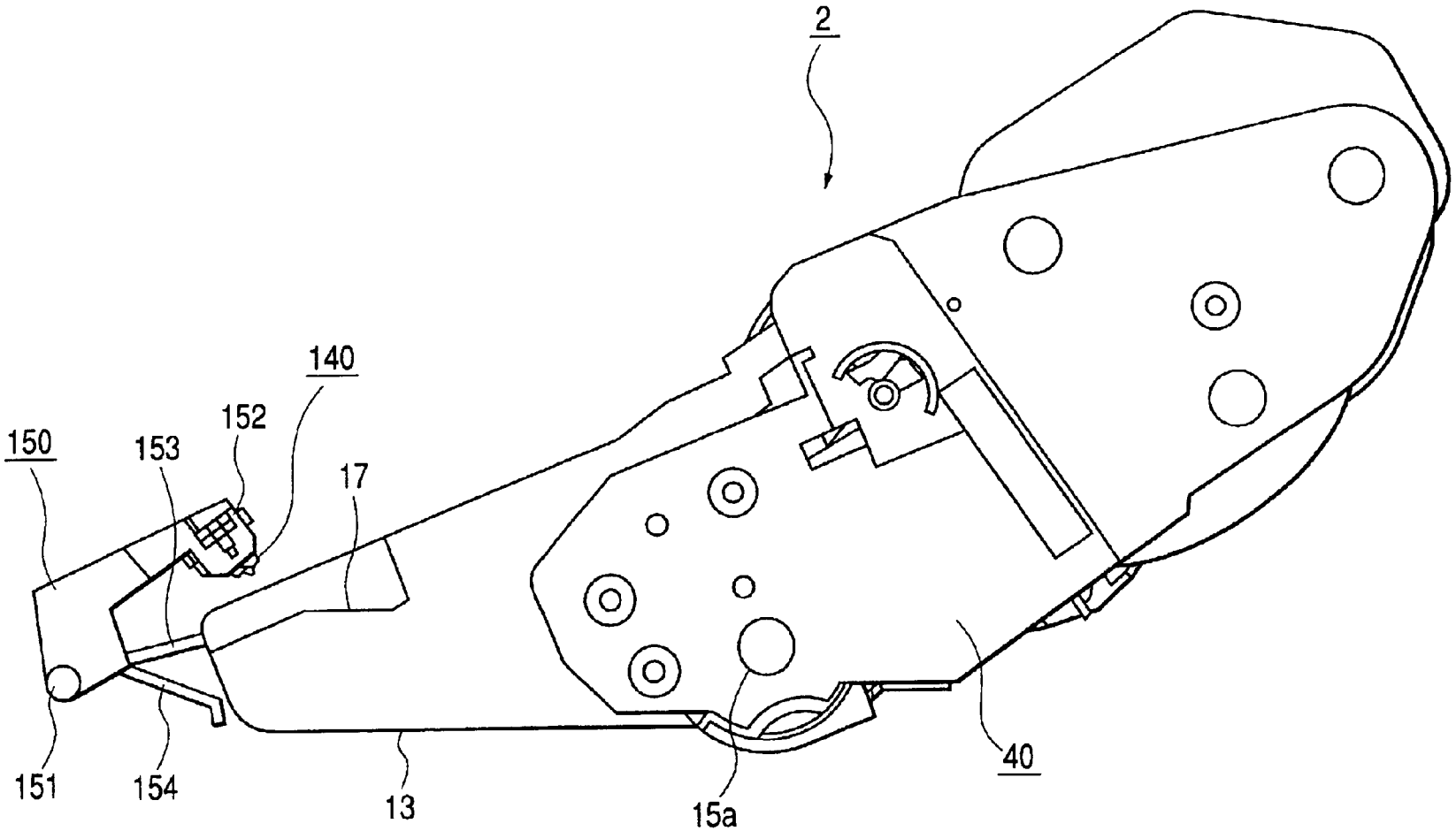
FIG. 8 is a side view showing the arrangement of the memory tag and a connector.

That is, the end portion of the groove 16*a* that is the mounting guide portion constitutes the longitudinal positioning portion of the cartridge 2 that performs the positioning of the memory tag 60 and the connector 140 attached to the cartridge 2 in the longitudinal direction. When the cartridge 2 is still further inserted, the leading end portion of the cartridge 2 in the insertion direction is abutted against the abutting rotary lever 154 of the connector holder 150, and the connector 140 rotates to the memory tag 60 side about the rotation axis 151 of the connector holder 150 (in the clockwise direction in FIG. 8).

Following this, the cylindrical portion 14*a* of the drum bearing 14 of the cartridge 2 and the cylindrical portion 15*a* of the drum axis 15 reach the positioning grooves 121*b* and 122*b* of the apparatus main body (see FIGS. 14 and 15).

If the cartridge 2 is divided into the cleaning unit 10 side and the developing unit 20 side with reference to a center line connecting the centers of the cylindrical portion 14*a* of the drum bearing 14 and the cylindrical portion 15*a* of the drum axis 15, the weight of the cartridge 2 is distributed so that the developing unit 20 side generates a larger primary moment than the cleaning unit 10 side when this center line is horizontally maintained. As a result, the cartridge 2 rotates in a clockwise direction on a line connecting the cylindrical portion 14*a* of the drum bearing 14 and the cylindrical portion 15*a* of the drum axis 15, and the abutting portions 16 and 17 of the cartridge 2 are abutted against the fixed members 101 and 102, thereby finishing the operation for inserting the cartridge 2. Also, at the same time, the connector 140 is abutted against the memory tag 60.

Figure 13A:
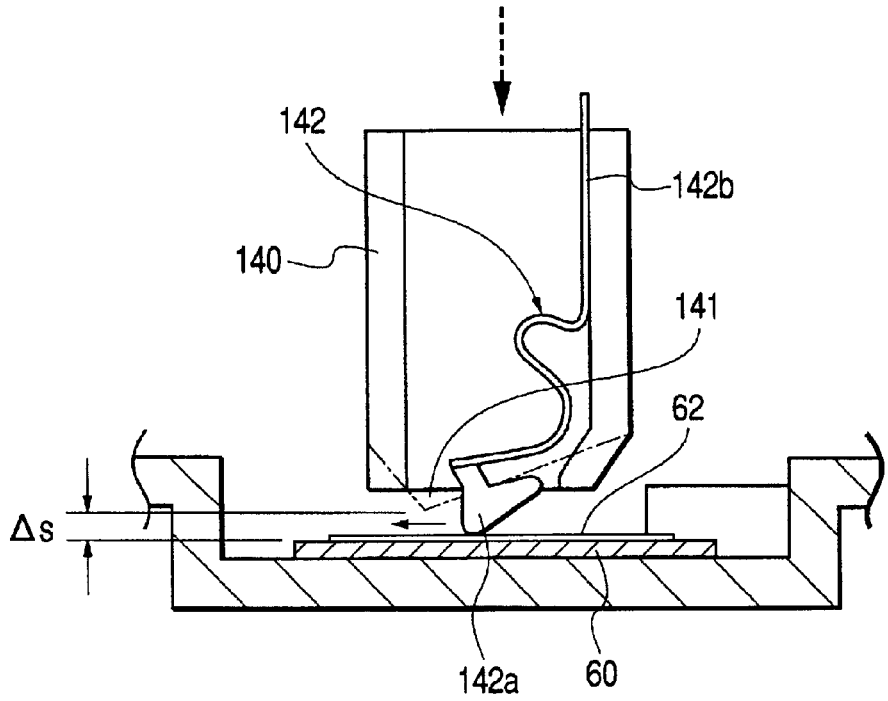
FIGS. 13A and 13B illustrate the deformation of a contact pin according to the first embodiment of the present invention.
Figure 13B:
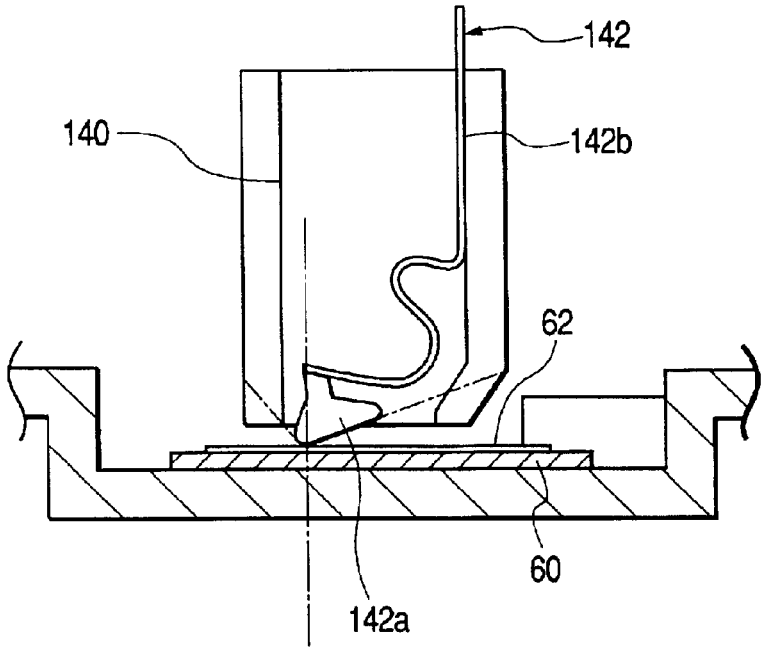

FIG. 13A shows a state before the connector 140 is completely abutted against the memory tag 60, while FIG. 13B shows a state where the connector 140 is completely abutted against the memory tag 60.

As shown in FIG. 13A, when the leading end portion 142*a* of the electrical contact point 142 (main body electrical contact point) is abutted against the contact point 62, this leading end portion is elastically deformed only by an amount As. Then, the leading end portion 142*a* slidably moves on the surface of the contact point 62 by a predetermined amount. As a result, there is obtained a state shown in FIG. 13B. That is, as shown in FIG. 6, each contact point 62 has a sliding region 62*a* in which the leading end portion 142*a* slidably moves. Also, in this embodiment, each contact point 62 is provided with two sliding regions 62*a* in each of which the electrical contact point 142 slides while contacting the region. With the construction described above, the reliability of electrical connection between each contact point 62 and the electrical contact point 142 is improved. Also, the length of each sliding region 62*a* in a sliding direction in which the leading end portion 142*a* slides is in a range of from 0.2 mm to 5 mm.

Further, the electrical contact point 142 has a construction where the leading end portion 142*a* elastically deforms and performs wiping on the surface of the contact point 62 of the memory tag 60.

That is, the electrical contact point 142 is an elastic member and its base portion 142*b* is fixed to the connector 140. Also, the leading end portion 142*a* is bent. Accordingly, when the leading end portion 142*a* is abutted against the contact point 62, the electrical contact point 142 is shifted from a state shown in FIG. 13A to a state shown in FIG. 13B (the electrical contact point 142 is elastically deformed in a digging direction). Also, the leading end portion 142*a* slides on the sliding region 62*a*. Note that the electrical contact point 142 is constructed using a metallic spring material (phosphor bronze) that is an elastic member, although it is possible to construct this electrical contact point using a conductive resin material or the like having elasticity.

Consequently, even if scattered toner or the like adheres to the contact point 62 of the memory tag or the leading end portion 142*a*, also called pin 142*a*, it is possible to clean these components by scraping off the adherents thereto. This makes it possible to ensure a stable electrical connection at all times.

The deformation amount As of the leading end portion 142*a* is precisely managed by the height of the bumping portion 141 formed at each end of the connector 140. The displacement amount of the leading end portion 142*a* of the electrical contact point 142 is adjusted by the bumping of this bumping portion 141 against the abutting portion 63 of the memory tag 60.

The connector 140 has been designed so that when the electrical contact point 142 is displaced by a predetermined amount, the top of the leading end portion 142*a* is positioned on the same virtually straight line as the top of the bumping portion 141 formed on each end of the connector 140. Note that the present invention includes any other construction so long as the electrical contact point includes the sliding region on which the main body electrical contact point slides. For instance, the present invention includes a case where a mark is formed in the sliding region as well as a case where no mark is formed.

Also, as shown in FIG. 12A, at positions far from the outside of the electrical contact point 142, that is, at each end of the connector 140, there is arranged the bumping portion 141, so that even if the height size of the protruding portion varies within tolerance, there is prevented a situation where the connector 140 is greatly inclined. Accordingly, the influence of a situation where the electrical connection becomes unstable because the contact pressure of four electrical contact points 142 becomes uneven between the right side and the left side is supposed.

It should be noted here that in this embodiment, the leading end portion 142*a* is displaced by 0.5 to 2 mm in a bumping direction and performs wiping by 0.5 to 2 mm in the widthwise direction of the electrical contact point. The contact pressure in this case becomes 40 to 80 g/pin.

In order to completely clean adherents only with the wiping of the leading end portion 142*a*, it is required to take any measure, such as an increase of the abutting pressure of the electrical contact point 142 or an increase of the moving amount during the wiping. However, if such a measure is taken, the peeling off of the plating of the contact points of the memory tag is prompted. As a result, it is conceived that there exists the possibility that there occurs poor conduction before the lifetime of the developing cartridge expires.

In this embodiment, the bumping portion 141 is bumped against the abutting portion 63 that is provided separately from the electrical contact point 142 on the same plane. This makes it possible to establish contact with precision without increasing the width of the electrical contact point 142. Also, the powder generated by abrasion of the bumping portion 141 does not adhere to the electrical contact point 142, so that it becomes possible to prevent an increase in contact resistance.

Also, as described above, the groove 16*a* is arranged in the vicinity of the memory tag 60 of the cartridge 2, and the connector holder 150, to which the connector 140 of the apparatus main body 100 is attached, is positioned by the groove 16*a*. Therefore, it becomes possible to abut the memory tag 60 against the connector 140 with a high degree of precision. This makes it possible to prevent the displacements of the contact points of the memory tag 60 and to reduce the size of the connector unit.

Further, the groove 16*a* doubles as the mounting guide portion used to mount the cartridge 2 to the apparatus main body 100, so that the movable width of the connector unit in the longitudinal direction is reduced, which makes it possible to reduce the space occupied by the apparatus main body 100 including the movable width of the connector unit.

Also, the wall of the groove 16*a* on one side is the rib 18 that opens/closes the laser shutter 130 of the apparatus main body 100. As a result, space is effectively used. Further, the groove 16*a* doubles as the guide during the mounting of the cartridge 2, which improves the positional accuracy of the apparatus main body 100 with reference to the opening/closing mechanism of the shutter 130 and reduces the size of the portion that opens/closes the shutter 130 of the apparatus main body 100.

With the technique of this embodiment, the coating layer 65 protecting the storing element 61 of the memory tag and the contact points 62 are arranged on a virtually straight line, which makes it possible to reduce the size of the memory tag 60 and increases the flexibility concerning the attaching position to the cartridge.

There is used a construction where the contact point 62 is provided on each side of the coating layer 65 protecting the storing element 61 and the abutting portion 63 is provided parallel to the contact point on an extension line of both contact points. As a result, the distance from the connector to the bumping portion becomes equal to the distance therefrom to the contact point and the pressure balance becomes even, so that there is prevented with more reliability the poor conduction due to insufficient contact pressure or the like.

Further, as to shapes, by performing positioning using the concave shaped notched portion provided at a side edge of the memory tag, even if the direction, in which the mold for forming the attaching portion of the memory tag of the cartridge is pulled out, is not parallel to the surface including the contact point of the memory tag, it becomes possible to perform the positioning in the longitudinal direction. As a result, the construction of the mold does not influence the positioning of the memory tag in the longitudinal direction and is able to be used for a plurality of products, which contributes to the reduction of costs due to the advantages generated by mass production.

Also, if the positioning is performed using a hole (round hole, square hole), the size of the memory tag is increased. However, with the use of a concave shape, it becomes possible to prevent the increase of the size of the memory tag.

Further, if the positioning is performed using a hole (round hole, square hole), there is the danger that there occurs prying when a positioning boss is fitted into a positioning hole, which risks degrading the ability of the apparatus to be assembled. In particular, in the case where there is used a thin substrate, there is a high possibility of prying and there is the risk of degrading the ability of the apparatus to be assembled. However, with the concave shape, there is no possibility of the prying and therefore the degradation of assembly of the apparatus is avoided.

Second Embodiment

Figure 19:
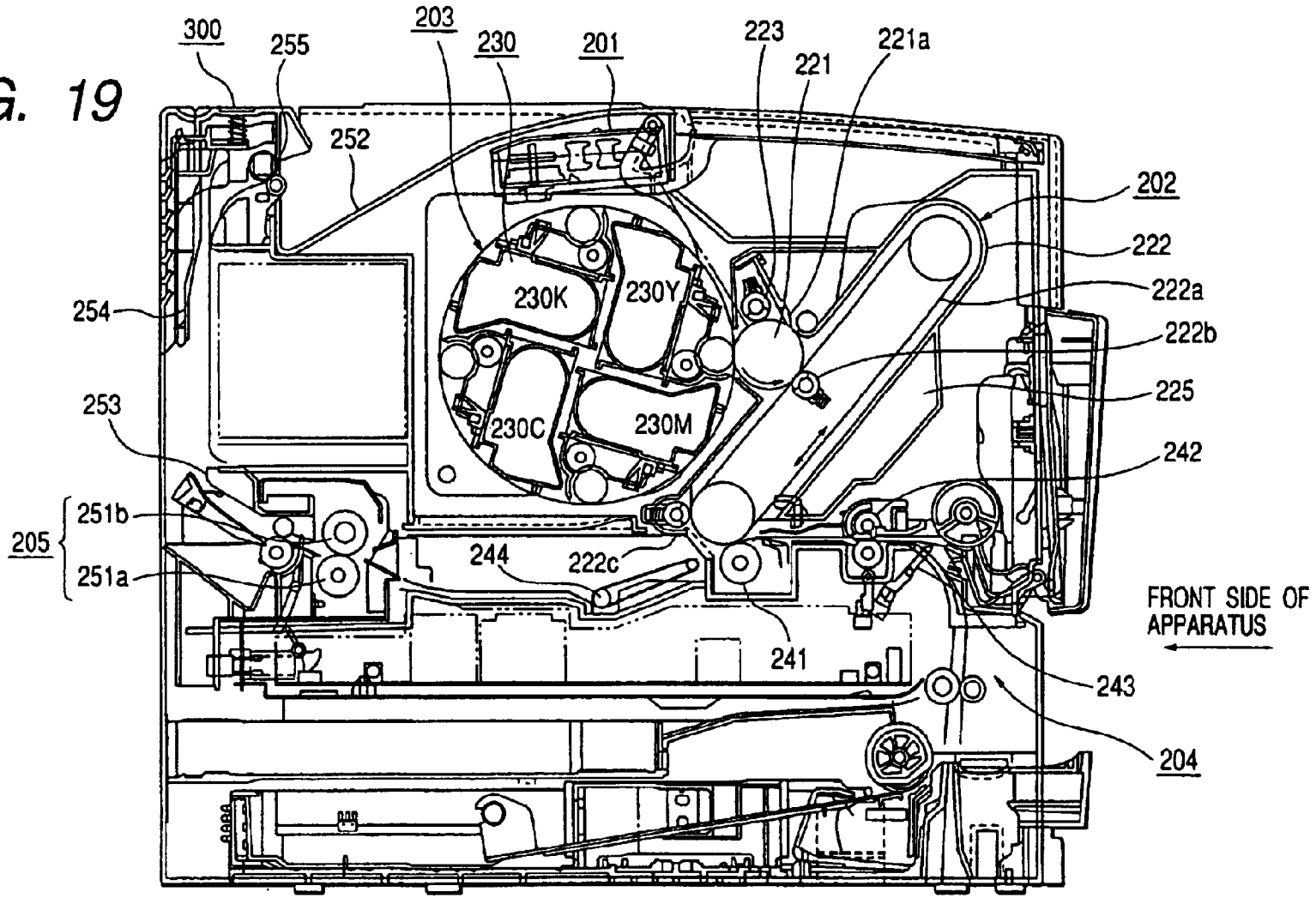
FIG. 19 is a vertical cross-sectional view showing an electrophotographic image forming apparatus according to a second embodiment of the present invention.

FIG. 19 shows an electrophotographic image forming apparatus according to the second embodiment. In the following description, the front side of the apparatus is the upstream side (right side in FIG. 19) with reference to the conveying of a recording medium (transferring material) from a transferring process to a fixing process. Also, the left and right concerning the apparatus main body, the developing cartridge, and the cartridge are respectively the left and right when viewed from the apparatus front side. Also, the longitudinal direction is a direction that is parallel to the surface of a recording medium and intersects (approximately perpendicular to) the direction in which the recording medium is conveyed.

{Outline of Image Forming Operation of Electrophotographic Image Forming Apparatus}

FIG. 19 is a vertical cross-sectional view showing the outline of the construction of a full-color laser beam printer using four colors that is a color electrophotographic image forming apparatus using an electrophotographic system. This apparatus includes an optical means 201 for generating light that is based on image information, a cartridge 202 in which a photosensitive body drum 221, which is an electrophotographic photosensitive body, an intermediate transferring unit 222 also called an intermediate transferring body unit 222, and the like are combined into a unit, and a developing device 203 having developing cartridges 230 for four colors (230Y, 230M, 230C, and 230K).

There is obtained a construction where an image (toner image) is formed on the photosensitive body drum 221 that is an image bearing member by irradiating light based on image information from the optical means 201. Then, a transferring material (recording medium) is conveyed by a convey means 204 in synchronization with the formation of the toner image. The toner image formed on the photosensitive body drum 221 is transferred onto an intermediate transferring belt 222*a* of the intermediate transferring unit 222. Further, the toner image on the intermediate transferring belt 222*a* is transferred onto the transferring material by a secondary transferring roller 241. This transferring material is conveyed to a fixing means 205 having a pressuring roller 251*a* and a heating roller 251*b*, the transferred toner image is fixed, and the transferring material is discharged to a discharging portion 252.

The image forming step described above will be described in more detail.

In synchronization with the rotation of the intermediate transferring belt 222*a*, the photosensitive body drum 221 is rotated in a counterclockwise direction in FIG. 19 and the surface of the photosensitive body drum 221 is evenly charged by the charging device 223. Then, for instance, the irradiation of light for a yellow image is performed by the optical means 201. In this manner, there is formed a yellow electrostatic latent image on the photosensitive body drum 221.

The optical means 201 irradiates the photosensitive body drum 221 with a light image on the basis of image information read from an external apparatus or the like. To do so, the optical means 201 contains a laser diode, a polygon mirror, a scanner motor, an imaging lens, and a reflection mirror.

Also, when an image signal is given from the external apparatus or the like, the laser diode emits light in accordance with the image signal and irradiates the polygon mirror with the emitted light as image light. This polygon mirror is rotated at a high speed by the scanner motor. The image light reflected by this polygon mirror irradiates the photosensitive body drum 221 via the imaging lens and the reflection mirror and selectively exposes the surface of the photosensitive body drum 221, thereby forming an electrostatic latent image.

Concurrently with the formation of this electrostatic latent image, the developing device 203 is driven to rotationally move the developing cartridge 230Y for developing a yellow image to a developing position and a predetermined bias is applied to have yellow toner adhere to the electrostatic latent image, thereby developing the latent image. After that, a voltage having a polarity opposite to that of the toner is applied to a primary transferring roller 222*b* that is a pressing roller of the intermediate transferring belt 222*a*, thereby primarily transferring the yellow toner image on the photosensitive body drum 221 onto the intermediate transferring belt 222*a*.

After the primary transferring of the yellow toner image is finished in this manner, the next developing cartridge 230M is rotated and moved to be positioned at a position opposing the photosensitive body drum 221. The same step as in the case of the yellow image is repeated for respective colors of magenta, cyan, and black, thereby superimposing toner images in four colors on the intermediate transferring belt 222*a*.

During this operation, the secondary transferring roller 241 is placed in a state where this roller 241 does not contact the intermediate transferring belt 222*a*. At this point in time, a cleaning charging roller 222*c* functioning as the cleaning unit is also placed in a state where this roller does not contact the intermediate transferring belt 222*a*.

Then, after the formation of the toner images in four colors on the intermediate transferring belt 222*a* is finished, the secondary transferring roller 241 is brought into pressure contact with the intermediate transferring belt 222*a*, as shown in FIG. 19. Further, in synchronization with the pressure contact of the secondary transferring roller 241, the transferring material waiting at a predetermined position in the vicinity of a registration roller pair 242 of the convey means 204 is sent to a nip portion between the intermediate transferring belt 222*a* and the secondary transferring roller 241.

Here, immediately before the registration roller pair 242, there is provided a sensor 243 that detects the leading edge of the transferring material, blocks the driving force for rotating the registration roller pair 242, and has the transferring material wait at the predetermined position.

A bias voltage having a polarity opposite to that of toner is applied to the secondary transferring roller 241 and the toner images on the intermediate transferring belt 222*a* are secondary transferred onto the surface of the conveyed transferring material by one operation.

The transferring material, onto which the toner images have been secondary transferred in this manner, is conveyed to the fixing means 205 via a conveying belt unit 244. After fixation is performed, the transferring material is conveyed along a sheet discharging guide 254 by a sheet discharging roller pair 253, is discharged to the discharging portion (tray) 252 existing in the upper portion of the apparatus by a discharging roller pair 255. In this manner, the image formation operation is finished.

On the other hand, after the secondary transferring, the cleaning charging roller 222*c* is brought into pressure contact with the intermediate transferring belt 222*a*. As to the residual toner that resides on the surface of the intermediate transferring belt 222*a* even after the secondary transferring, residual electric charges are diselectrified by the application of a predetermined bias voltage.

The diselectrified residual toner is electrostatically re-transferred onto the photosensitive body drum 221 from the intermediate transferring belt 222*a* via a primary transferring nip and the surface of the intermediate transferring belt 222*a* is cleaned. Note that the residual toner residing even after the secondary transferring that has been retransferred onto the photosensitive body drum 221 is removed and collected by a cleaning blade 221 a for the photosensitive body drum 221.

The collected residual toner takes a carrying path to be described below that carries this toner as waste toner, and is collected and accumulated in a waste toner box 225.

{Outline of Construction of Developing Cartridge}

Figure 31:
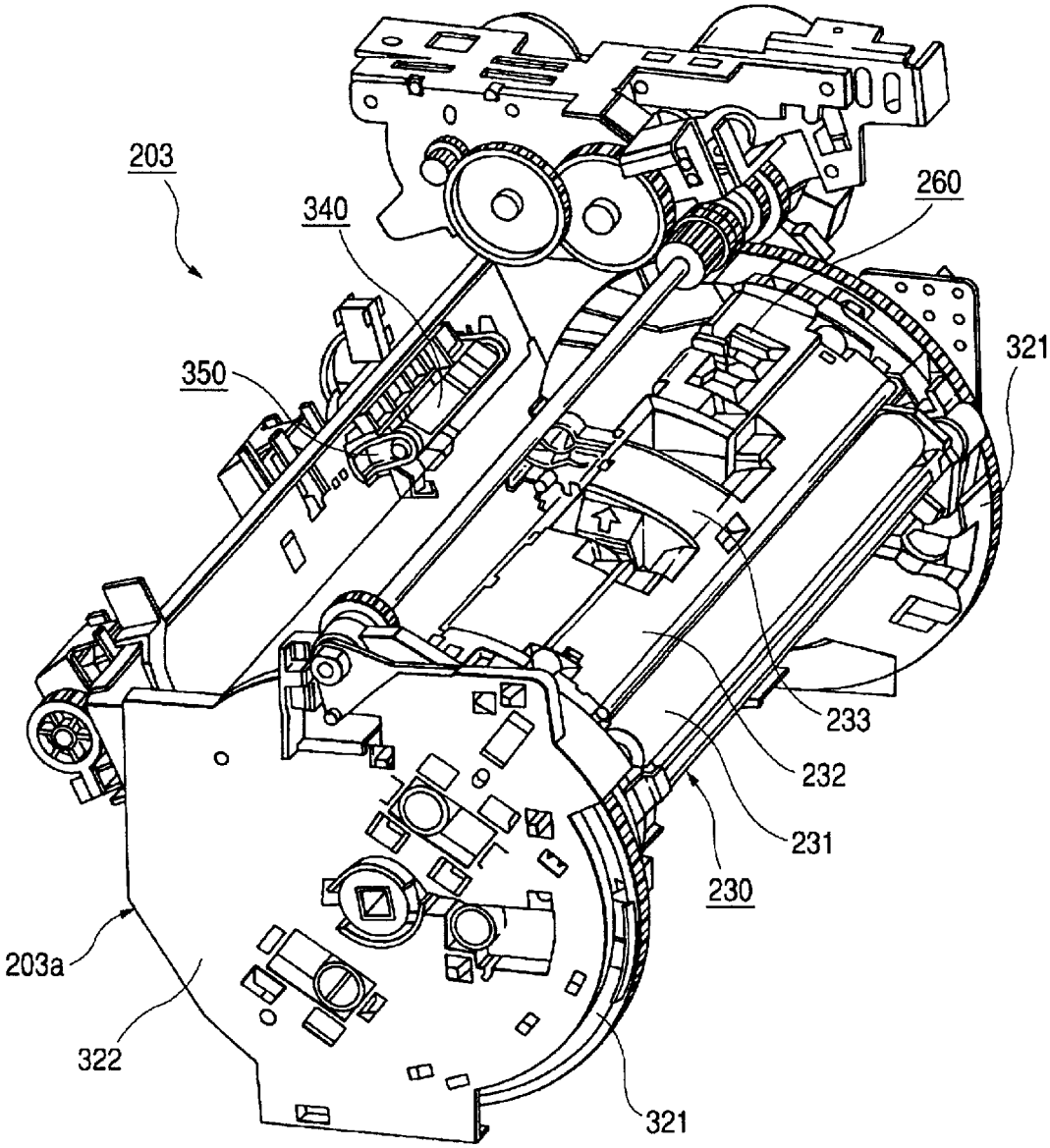
FIG. 31 is a perspective view showing the developing cartridge and a rotary device.
Figure 32:
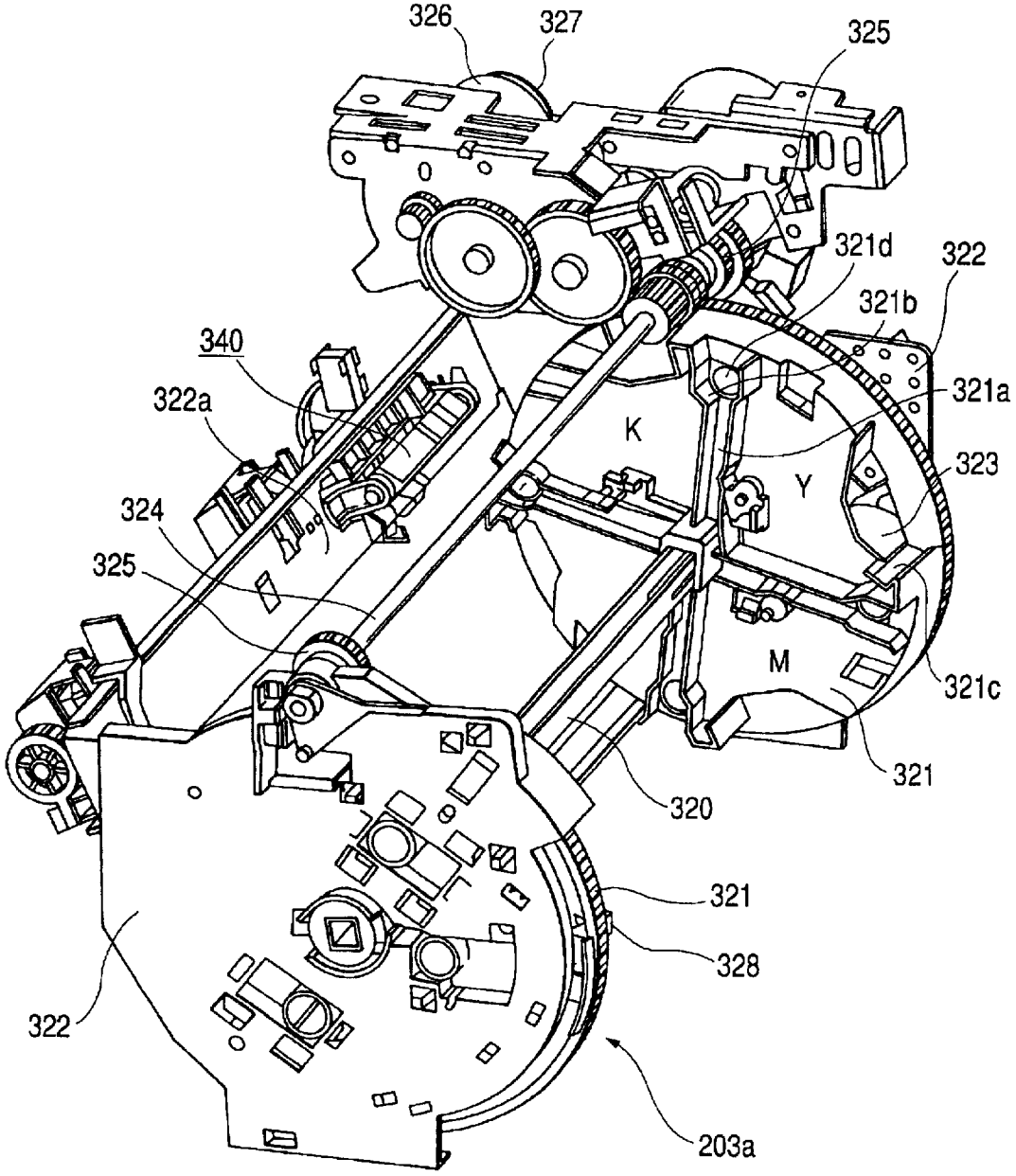
FIG. 32 is a perspective view showing a portion for driving the rotary device and the connector.

As shown in FIG. 31, the developing cartridges 230 (230Y, 230M, 230C, and 230K) containing toner in the respective colors of yellow, magenta, cyan, and black are fixed at predetermined positions within a rotary device 203*a* of the developing device 203. As shown in FIG. 32, the rotary device 203*a* includes a pair of rotary flanges 321 having a circular plate shape that rotate about an axis 320 supported by an apparatus main body 300 (see FIG. 19). Each developing cartridge 230 is fixed to and supported by these rotary flanges 321 and is constructed so as to prevent a situation where the developing cartridge 230 is separated from the rotary device 203*a* during the rotation of the rotary device 203*a*.

To extract the developing cartridge 230 from the apparatus main body 300 to the outside of the apparatus main body 300, a user grabs a grip 233 on the upper surface and pulls out the developing cartridge 230 upward from the rotary device 203*a*. Each developing cartridge 230 is locked to the rotary flanges 321 by, for instance, a helical coil spring or a stopper and it is possible to mount and demount the developing cartridge 230 by a user's operation.

Figure 20A:
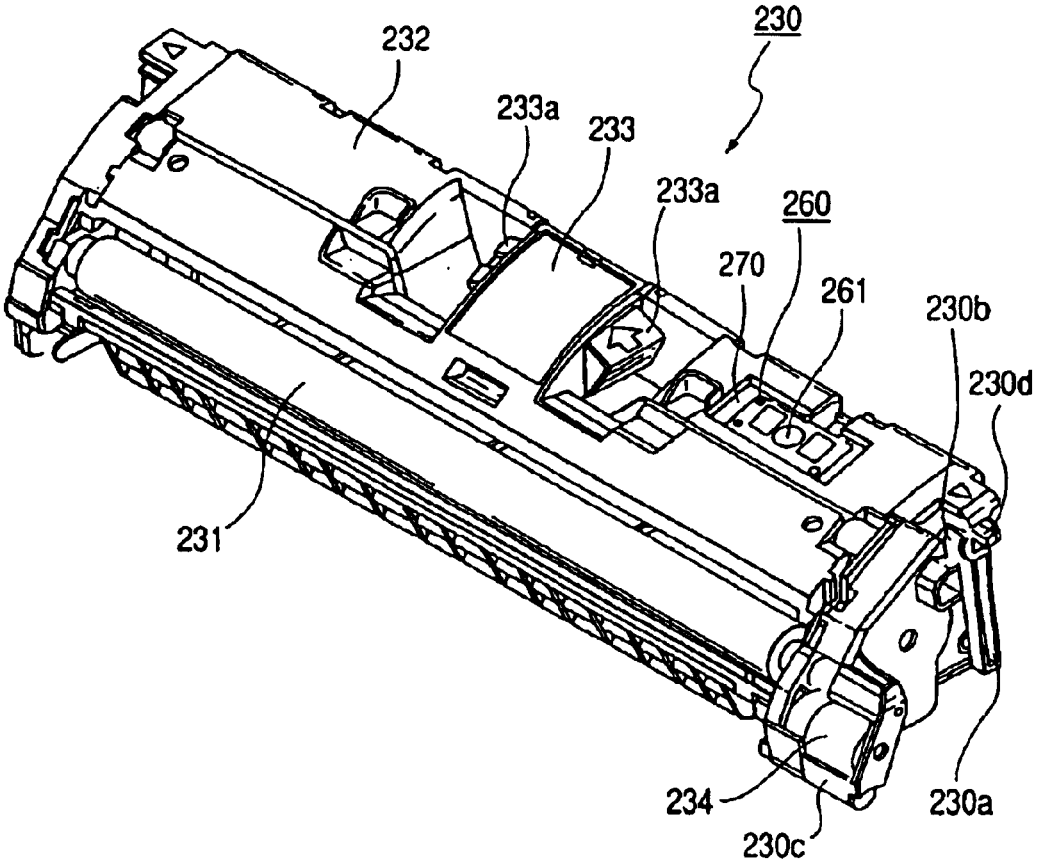
FIGS. 20A and 20B show a developing cartridge of the apparatus in FIG. 19, with FIG. 20A being a perspective view thereof and FIG. 20B being a cross-sectional view showing its internal construction.
Figure 20B:
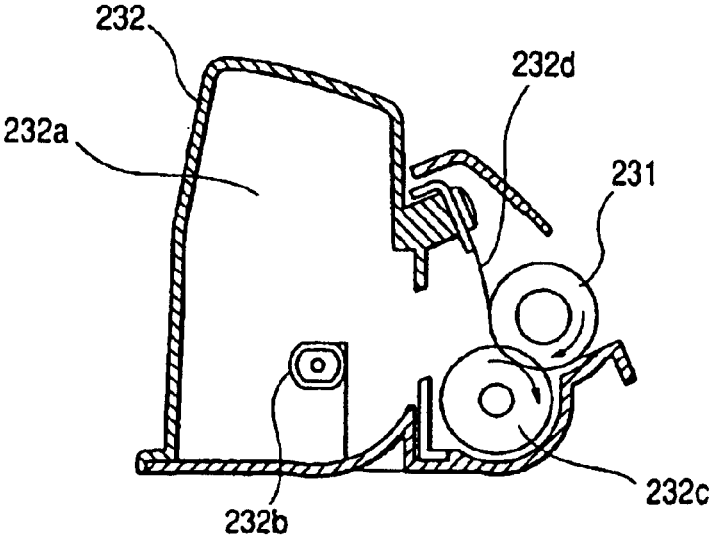
Figure 21A:
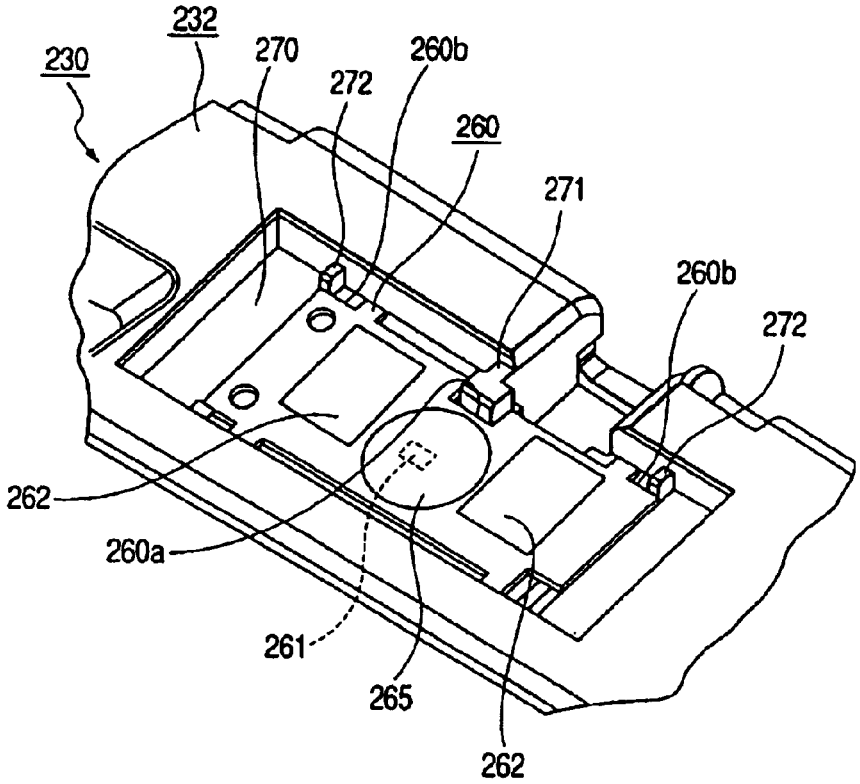
FIGS. 21A and 21B show a memory tag of the developing cartridge, with FIG. 21A being a perspective view showing a state where the memory tag is attached to the developing cartridge and FIG. 21B being a plan view showing only the memory tag.
Figure 21B:
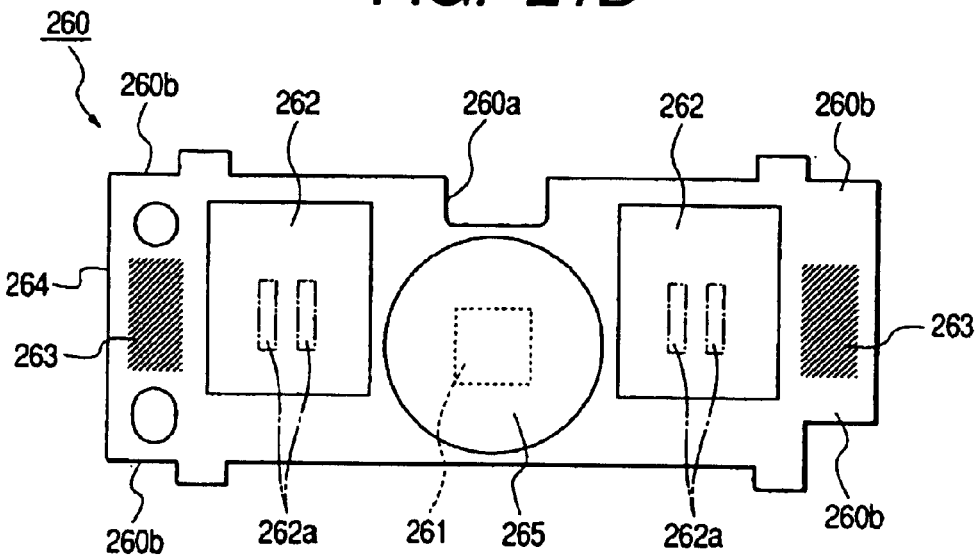

As shown in FIGS. 20A and 20B, each developing cartridge 230 includes a developing roller 231 that is a developing means and a toner container 232 comprising toner container 232*a*. Toner of a predetermined color is charged in each toner container 232*a* and a required amount of the toner is carried to the developing portion by the rotation of an agitating means 232*b*. The carried toner is supplied to the surface of the developing roller 231 by the rotation of a sponge-like toner supplying roller 232*c* in the developing portion. Further, the supplied toner is given electrical charges and is converted into a thin layer by friction between a thin plate-like developing blade 232*d* and the developing roller 231. The toner on the developing roller 231 that has been converted into a thin layer is carried to the developing portion by rotation and is given a predetermined developing bias, thereby visualizing the electrostatic latent image on the photosensitive body drum 221 as a toner image.

Residual toner, out of the toner on the surface of the developing roller 231, that did not contribute to the visualization of the latent image on the photosensitive body drum 221 is scraped off by the toner supplying roller 232*c* again. Concurrently with this operation, new toner is supplied onto the developing roller 231, so that a new developing operation is performed in succession.

{Construction of Process Cartridge}

Figure 35:
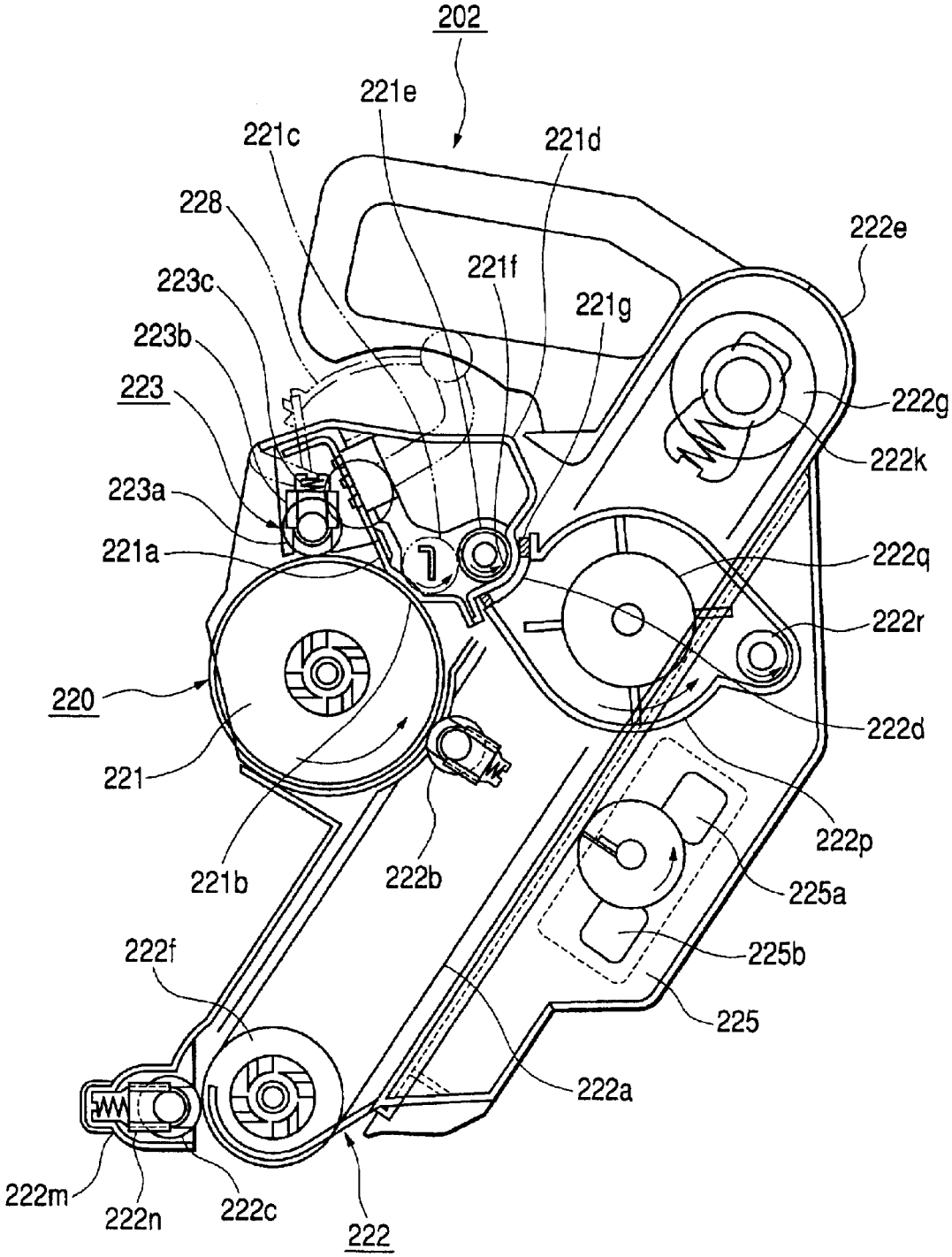
FIG. 35 illustrates a process cartridge of the electrophotographic image forming apparatus in FIG. 19.

As shown in FIG. 35, in this embodiment, there is mounted a process cartridge 202 in which the photosensitive body drum 221, the intermediate transferring belt 222*a*, a waste toner box 225, and the like are combined with each other. FIG. 35 is a vertical cross-sectional view taken from the left side of the cartridge 202, FIG. 36 is a perspective view taken from the left side of the cartridge 202, and FIG. 37 is a perspective view taken from the right side.

The cartridge 202 is constructed of two units that are a photosensitive body drum unit 220 including the photosensitive body drum 221 and an intermediate transferring body unit 222 including the intermediate transferring belt 222*a* and the waste toner box 225. There is realized a construction where the photosensitive body drum unit 220 is arranged on an upper side in a projection direction of the intermediate transferring body unit 222, plates on the left and right sides or side cover 226 and 227 of the intermediate transferring body unit 222 extend to both sides of the photosensitive body drum unit 220 and holds the photosensitive body drum unit 220 from the sides.

{Construction of Photosensitive Body Drum Unit}

Figure 36:
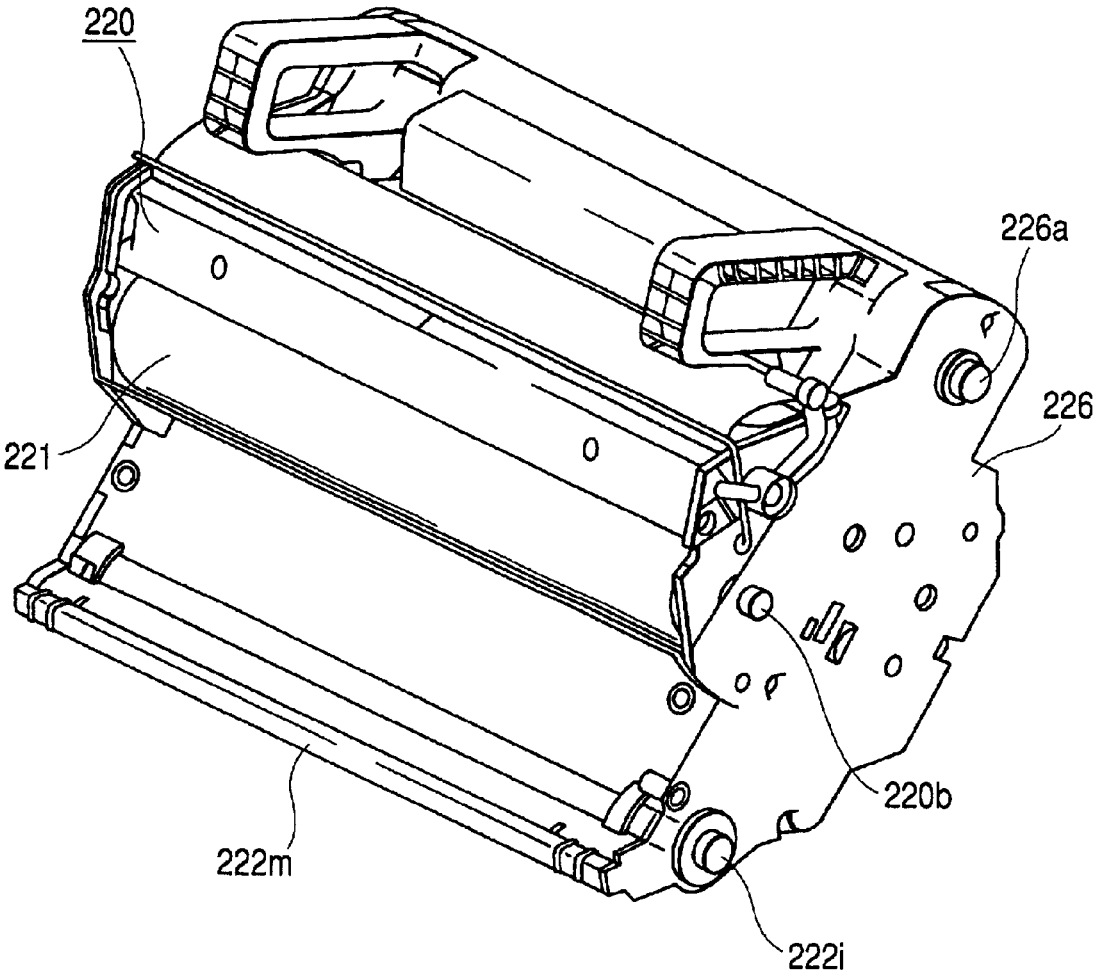
FIG. 36 is a perspective view of the process cartridge in FIG. 35 as viewed from the left side.
Figure 37:
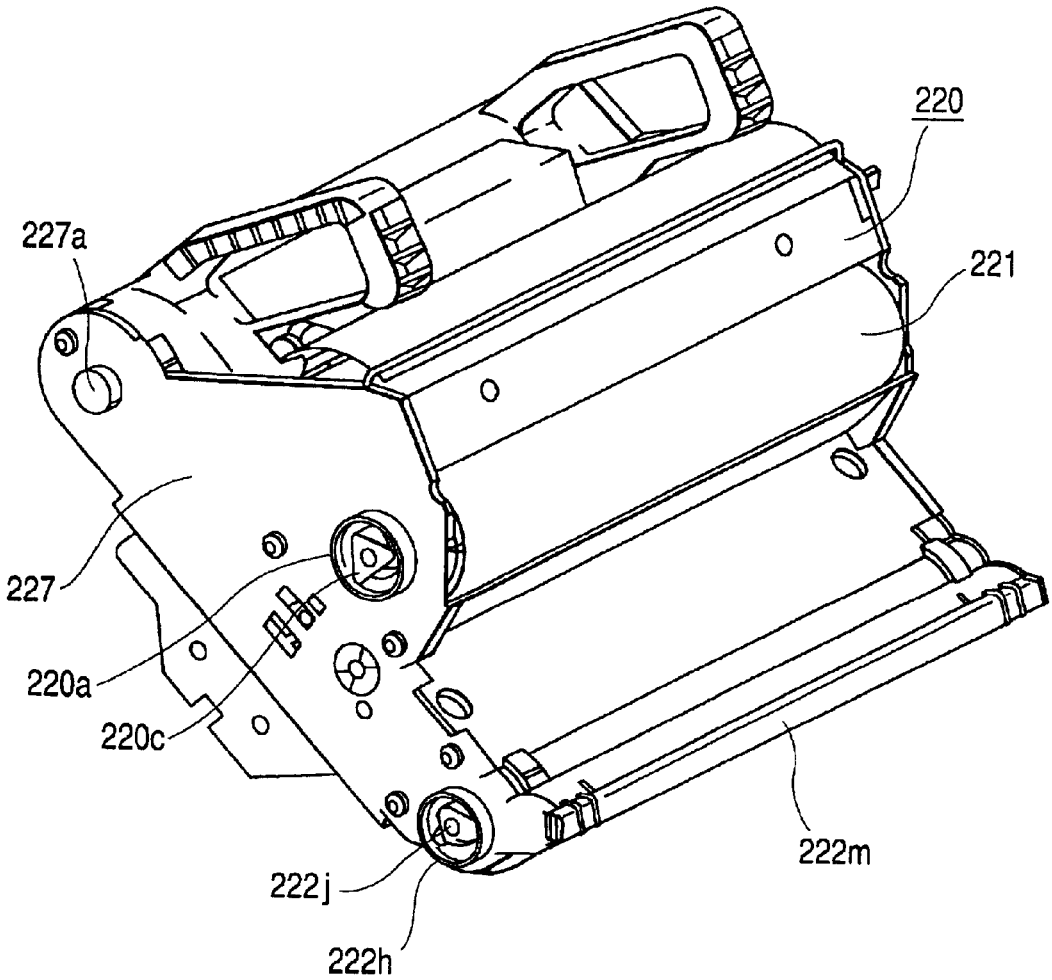
FIG. 37 is a perspective view of the process cartridge in FIG. 35 as viewed from the right side.

As shown in FIGS. 36 and 37, in the photosensitive body drum unit 220, both ends of the photosensitive body drum 221 are freely rotatably held by a bearing 220*a* on the right side and a rotation axis 220*b* on the left side. Also, a predetermined rotation driving force is transmitted from the apparatus main body 300 via a coupling 220*c* in the end portion on the right side.

As shown in FIG. 35, the charging roller 223*a* is brought into pressure contact with the photosensitive body drum 221 with a predetermined force given by compression springs 223*c* via bearings 223*b* on both sides. With this construction, the charging roller 223*a* is driven and rotated.

At least one of the bearings 223*b* is constructed using a conductive material and, by the application of a predetermined charging bias voltage to the charging roller 223*a*, the surface of the photosensitive body drum 221 is uniformly charged. Note that the charging device adopting a contact electric charging system like this is disclosed in JP 63-149669 A.

The photosensitive body drum unit 220 is also provided with a drum shutter 228 that is opened and closed in synchronization with operations for attaching the cartridge 202 to and detaching the cartridge 202 from the apparatus main body 300.

The photosensitive body drum 221 is provided with the cleaning blade 221*a* at a predetermined position. With this construction, residual toner on the intermediate transferring belt 222*a* given the opposite electrical charges described above is collected onto the photosensitive body drum 221 and is scraped off along with residual toner on the photosensitive body drum 221.

The dropping of the scraped-off waste toner onto the intermediate transferring belt 222*a* is prevented by a scoop sheet 221*b*. Also, residual toner accumulated between the cleaning blade 221*a* and the scoop sheet 221*b* is swept out to the back of a photosensitive body drum container 221*d*, that is, in a direction, in which a distance from the photosensitive body drum 221 is increased, by the rotation of a feeding blade 221*c*.

Also, a first screw 221*e* is provided further backward with reference to the feeding blade 221*c* and, by the rotation of this first screw 221*e*, waste toner is carried to the left side when viewed from the front side of the apparatus (in the frontward direction in FIG. 35).

In the photosensitive body drum container 221*d*, there is provided an opening 221*f* in a left end lower portion of a groove portion in which the first screw 221 e is arranged. The waste toner is carried to the left end by the first screw 221*e*, drops from the opening 221*f*, and is sent to a receiving opening 222*d* of the intermediate transferring unit 222. On the lower surface of the opening 221*f*, there is provided a seal member 221*g*, thereby preventing the leakage of toner at a connection portion with the receiving opening 222*d*.

{Construction of Intermediate Transferring Unit}

The intermediate transferring unit 222 transfers an image transferred from the photosensitive body drum 221 by the intermediate transferring belt 222*a* onto a transferring material, and waste toner is collected and accumulated in the waste toner box 225.

The intermediate transferring belt 222*a* is wound and stretched around an intermediate transferring body frame 222*e* by two rollers that are a driving roller 222*f* and a driven roller 222*g*. Both ends of the driving roller 222*f* are freely rotatably held by the right side bearing 222*h* and the left side bearing 222*i*, and a predetermined rotation driving force is transmitted thereto from the apparatus main body via a coupling 222*j* in the right side end portion (see FIGS. 36 and 37).

Bearings 222*k* at both ends of the driven roller 222*g* are provided with compression springs. With this construction, a predetermined tension is given to the intermediate transferring belt 222*a*.

At a position opposing the photosensitive body drum 221 with the intermediate transferring belt 222*a* being sandwiched therebetween, there is provided the primary transferring roller 222*b* that is brought into pressure contact with a predetermined force by compression springs via the bearings at both end. With this construction, the primary transferring roller 222*b* is driven and rotated.

At least one of the bearings of the primary transferring roller 222*b* is constructed using a conductive material and, by the application of a predetermined transferring bias voltage to the primary transferring roller 222*b*, toner on the surface of the photosensitive body drum 221 is primarily transferred onto the intermediate transferring belt 222*a*.

At a position opposing the driving roller 222*f* of the intermediate transferring belt 222*a*, there is provided a cleaning charging roller portion 222*m* that applies a predetermined bias voltage to residual toner on the intermediate transferring belt 222*a* and diselectrifies residual electrical charges. The cleaning charging roller 222*c* is brought into pressure contact with a predetermined force by compression springs via the bearings 222*n* at both ends. With this construction, the cleaning charging roller 222*c* is driven and rotated.

At least one of the bearings 222*n* is constructed using a conductive material and the cleaning charging roller 222*c* applies a predetermined bias voltage to diselectrify residual electrical charges. Then, residual toner is electrostatically re-transferred onto the photosensitive body drum 221, is removed and collected by the cleaning blade 221*a*, and is accumulated in the waste toner box 225 as described above.

The waste toner box 225 is formed to have a box shape by connecting a partition plate to a part of the intermediate transferring body frame 222*e* and residual toner on the photosensitive body drum 221 is ultimately contained in this waste toner box 225.

An impeller cover 222*p* is bonded to the left side surface of the intermediate transferring body frame 222*e*, with a seat member 221*g* being sandwiched therebetween. This impeller cover 222*p* includes an opening on its upper side, and this opening is bonded to the opening 221*f* provided in the left end lower portion of the photosensitive body drum container 221*d* so that the seal member 221*g* is sandwiched therebetween. With this construction, waste toner dropped from the opening 221*f* drops to the inside of the impeller cover 222*p*.

In the impeller cover 222*p*, an impeller 222*q* rotates in a counterclockwise direction when viewed from the left side, thereby carrying waste toner in this cover to the waste toner box 225. The impeller cover 222*p* overlaps the left side surface of the waste toner box 225, and a hole communicating with the inside of the impeller cover 222*p* is provided in the overlapping portion.

Further, a second screw 222*r* is provided at a position on a line extending from the hole in the longitudinal direction, and waste toner carried by the impeller 222*q* is carried from the left side to the back and right side of the waste toner box 225 by the rotation of the second screw 222*r*.

The waste toner box 225 is divided into several small spaces by a plurality of partition walls vertical to the second screw 222*r* and the waste toner is filled first into the small space at the left end and then into its adjacent small space on the right side in succession. Also, the small space on the rightmost side is provided with detecting portions 225*a* and 225*b* that detect a situation where the waste toner box 225 is filled with the waste toner.

{Method of Positioning Process Cartridge against Apparatus Main Body}

Next, there will be described the attachment/mount of the process cartridge 202 to/from the apparatus main body 300 and a method of fixing the process cartridge 202 to a predetermined position.

Figure 38:
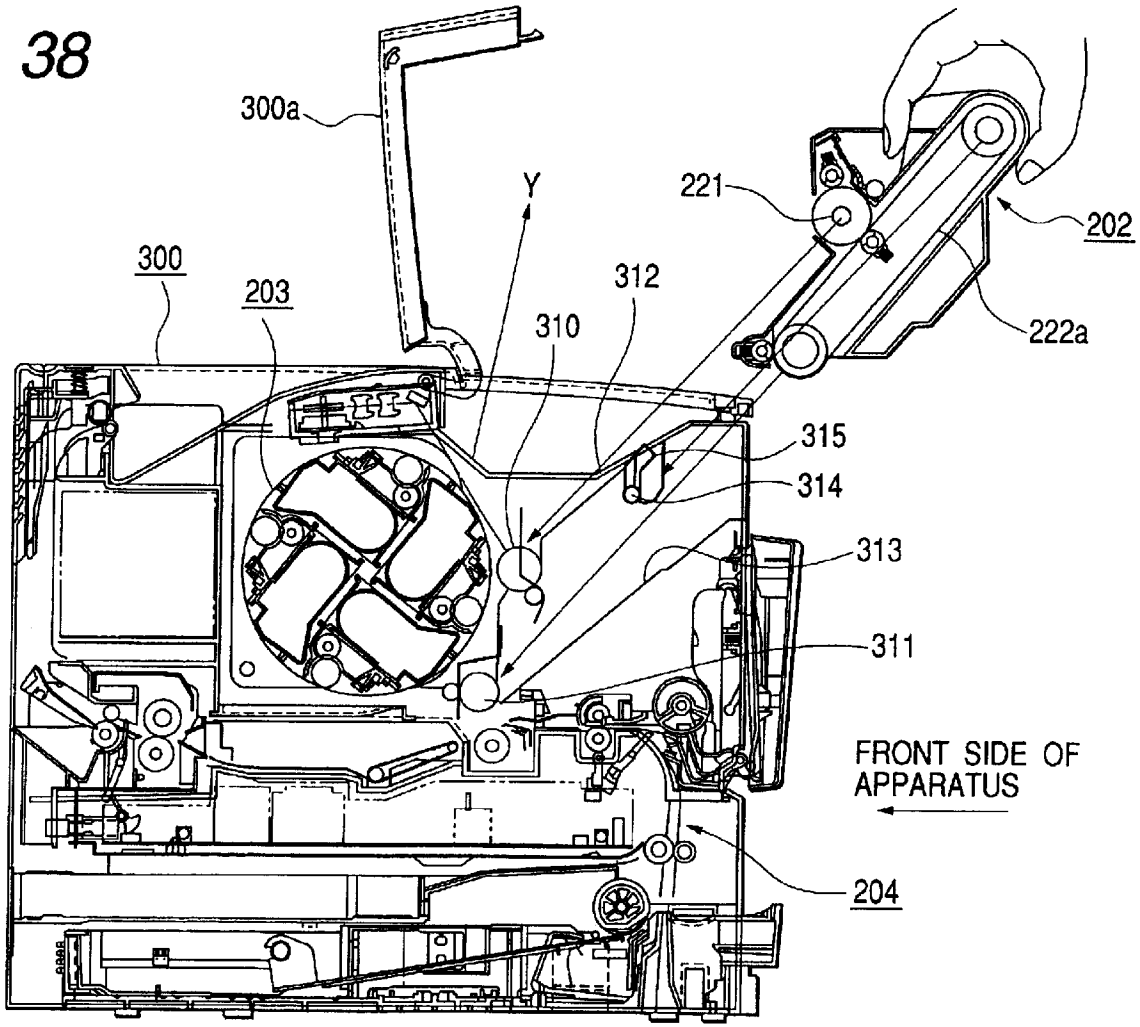
FIG. 38 illustrates a guide portion for the process cartridge in FIG. 35.

As shown in FIG. 38, when an upper lid 300*a* of the apparatus main body 300 is opened, a coupling, which is provided in a supporting portion 310 supporting the right side bearing 220*a* of the photosensitive body drum 221 and transmits a rotation driving force to the photosensitive body drum 221, and a coupling, which is provided in a supporting portion 311 supporting the right side bearing 222*h* of the driving roller 222*f* of the intermediate transferring belt 222*a* and transmits a rotation driving force to the driving roller 222*f* of the intermediate transferring belt 222*a*, slide in an axial direction and are retracted (coupling released state).

The retracting method and coupling mechanism of the couplings are disclosed, for instance, in JP 11-109836 A and therefore are not described here.

Within the apparatus main body, a photosensitive body drum guide rail 312 and an intermediate transferring unit or body guide rail 313 are provided on both sides so that a step-forming section is obtained.

The right side bearing 220*a* and the left rotation axis 220*b* supporting the photosensitive body drum 221 of the cartridge 202 are inserted while sliding on the photosensitive body drum guide rail 312. Also, both of the bearings 222*h* and 222*i* of the driving roller 222*f* of the intermediate transferring belt 222*a* and protruding portions 226*a* and 227*a* provided on both of the side covers 226 and 227 are inserted while sliding on the intermediate transferring body guide rail 313.

Ultimately, the bearing 220*a* and the rotation axis 220*b* of the photosensitive body drum 221 drop into the supporting portion 310 of the apparatus main body 300, and the bearings 222*h* and 222*i* of the intermediate transferring belt 222*a* and the driving roller 222*f* drop into the supporting portion 311. The protruding portions 226*a* and 227*a* provided on both of the side covers 226 and 227 drop into positioning grooves 314 and are pressed against and fixed to positioning portions of the main body frame 300 by helical coil springs 315.

{Attachment and Detachment of Developing Cartridge}

The developing cartridges 230 (230Y, 230M, 230C, and 230K) containing toner in the respective colors of yellow, magenta, cyan, and black are fixed at predetermined positions in the rotary device 203*a*. A method of positioning each developing cartridge 230 to the rotary device 203*a* will be described in detail with reference to FIGS. 31 to 34.

As described above, the rotary device 203*a* revolves about the axis 320 and disk-shaped rotary flanges 321 are fixed on both sides of the axis 320 (see FIG. 32).

Figure 33:
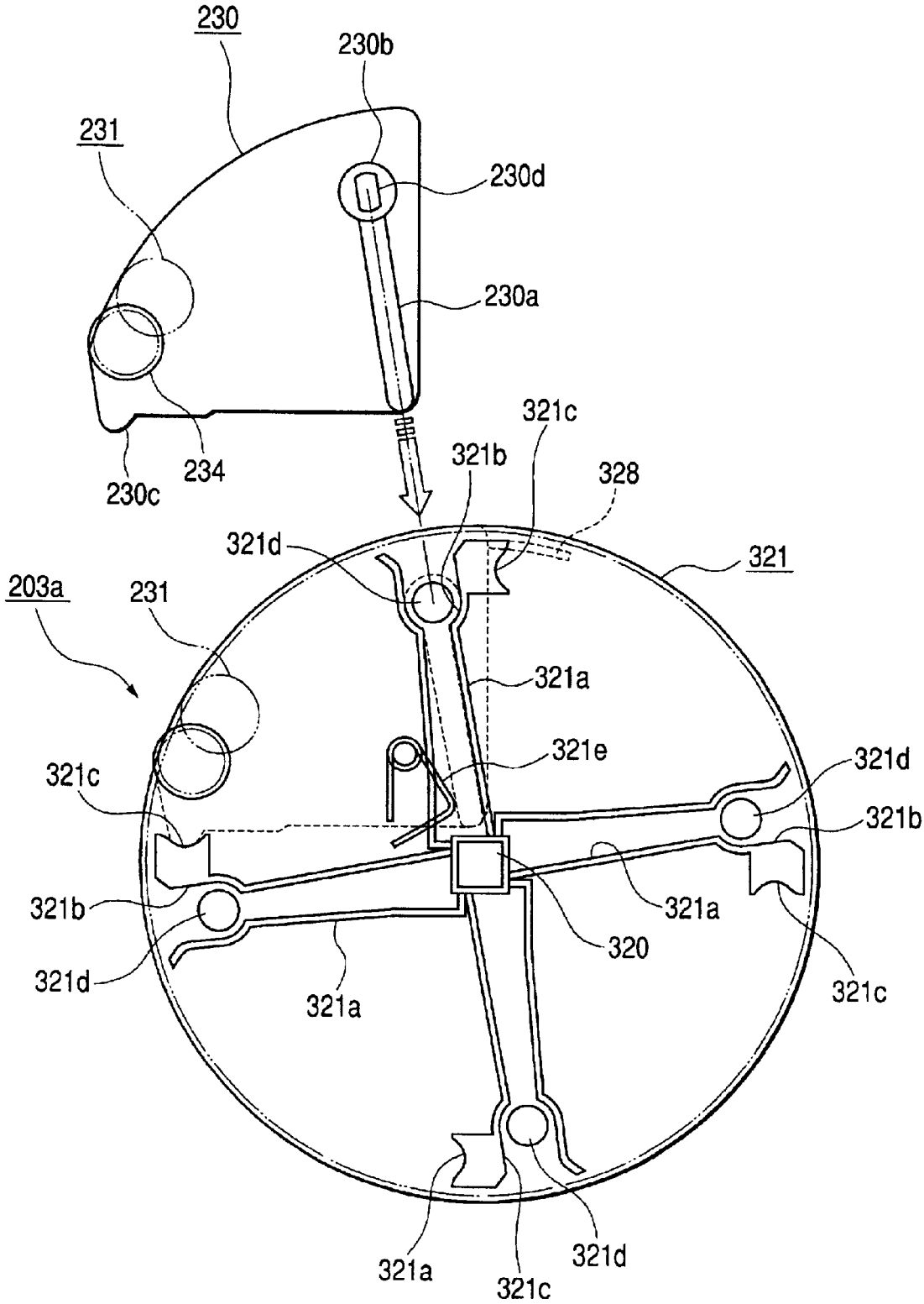
FIG. 33 illustrates a construction for attaching the developing cartridge to the rotary device.

For each rotary flange 321, as shown in FIG. 33, there are formed a guide groove 321*a* that guides the attachment and detachment of the developing cartridge 230, a first receiving portion 321*b* that is the center of the positioning of the developing cartridge 230, and a second receiving portion 321*c* that performs detent of the developing cartridge 230. Also, on a side of the first receiving portion 321*b* in the longitudinal direction, a hole 321*d* is provided on a central axis for positioning. This hole 321*d* functions as a hooking hole that prevents the dropping of the developing cartridge 230 from the rotary device 203*a*.

On the other hand, on the surfaces on the left and right sides of the developing cartridge 230, there are formed a guide rib 230*a* that guides the attachment and detachment of the developing cartridge 230, an arc-shaped first protruding portion 230*b* that is the center of the positioning of the developing cartridge 230, and an arc-shaped second protruding portion 230*c* that performs detent of the developing cartridge 230.

In the guide groove 321*a* of the rotary flange 321, there is arranged an energizing spring 321*e* that rotatably energizes the developing cartridge 230 in a counterclockwise direction on the plane of the drawing. The second protruding portion 230*c* of the developing cartridge 230 is brought into intimate contact with the second receiving portion 321*c* of the rotary flange 321 by this energizing spring 321*e*.

Also, a movable protruding portion 230*d* that is extensible in the longitudinal direction protrudes from an end surface of the first protruding portion 230*b* of the developing cartridge 230 (see FIG. 20). This movable protruding portion 230*d* is formed in an end portion of a rodlike slider whose length is about half of the length of the developing cartridge 230. By the sliding of this rodlike member, the movable protruding portion 230*d* protrudes from the end surface of the first protruding portion 230*b* and is retracted thereinto as described above.

As shown in FIGS. 20A and 20B, a grip 233 provided in the vicinity of the center of the developing cartridge 230 in the longitudinal direction has two hinges 233*a* on the left and right sides that are urged by helical coil springs in an opening direction. Each hinge 233*a* is coupled with the aforementioned slider and the slider moves back and forth in synchronization with the opening/closing operation of the hinges 233*a* of the grip 233.

Under a usual state, the hinges 233*a* are urged by the helical coil springs and are placed in an opened state. The movable protruding portion 230*d* of the slider protrudes from the end surface of the first protruding portion 230*b*. Also, there is obtained a construction where when a user grasps the grip 233, the hinges 233*a* are closed and the movable protruding portion 230*d* of the slider is retracted inward with reference to the end surfaces of the first protruding portion 230*b*.

Also, a gear tooth is formed for each hinge 233*a* on a side opposite to a grasped portion with a rotating portion being set as the center. These gears are engaged with each other. With this construction, even if only the hinge 233*a* on one side is closed, the hinge 233*a* on the other side is also closed. As a result, there is obtained a construction where the sliders on both sides simultaneously move back and forth at all times.

To insert the developing cartridge 230, the user grasps the hinges 233*a* of the grip 233 and inserts the cartridge by having the guide ribs 230*a* on both sides of the developing cartridge 230 slide along the guide grooves 321*a* of the rotary flanges 321. Next, at a point in time when the arc-shaped first protruding portion 230*b* formed on a side surface of the developing cartridge 230 is bumped against the first receiving portion 321*b* of the rotary flange 321, the user releases the grasped grip 233. As a result, the movable protruding portion 230*d* at each end protrudes from the end surface of the first protruding portion 230*b* and is hooked in the aforementioned hooking hole 321*d* provided on the side surface of the first receiving portion 321 of the rotary flange 321 in the longitudinal direction.

The first protruding portion 230*b* and the movable protruding portion 230*d* are coaxially provided, so that the developing cartridge 230 is swingable about the first protruding portion 230*b*. However, the energizing spring 321*e* for rotating and biasing the developing cartridge 230 in a counterclockwise direction on the plane of the drawing is arranged at the guide groove 321*a* of the rotary flange 321. The second protruding portion 230*c* of the developing cartridge 230 is brought into intimate contact with the second receiving portion 321*c* of the rotary flange 321 by this energizing spring 321*e*. In this manner, the position of the developing cartridge 230 is fixed.

On the other hand, to detach the developing cartridge 230, the user grasps the grip 233. As a result, the movable protruding portion 230*d* retracts and is disengaged from the hooking hole 321*d*, thereby making it possible to detach the developing cartridge 230 in an upward direction.

As described above, it is possible to detach and attach the developing cartridge by a user's operation. With the fixation method described above, it is also possible to perform the rotation of the rotary device without causing a situation where the developing cartridge is dropped from the rotary device.

{Construction for Driving Developing Cartridge}

Next, a construction for driving the developing cartridge 230 will be described in detail. As shown in FIGS. 31 and 32, on a side surface of each rotary flange 321, there is arranged a rotary side plate 322 and the axis 320 is locked so as to pass through both of the rotary flange 321 and the rotary side plate 322. In other words, the rotary flange 321 and the axis 320 are supported and revolvably held by the rotary side plate 322.

Figure 34:
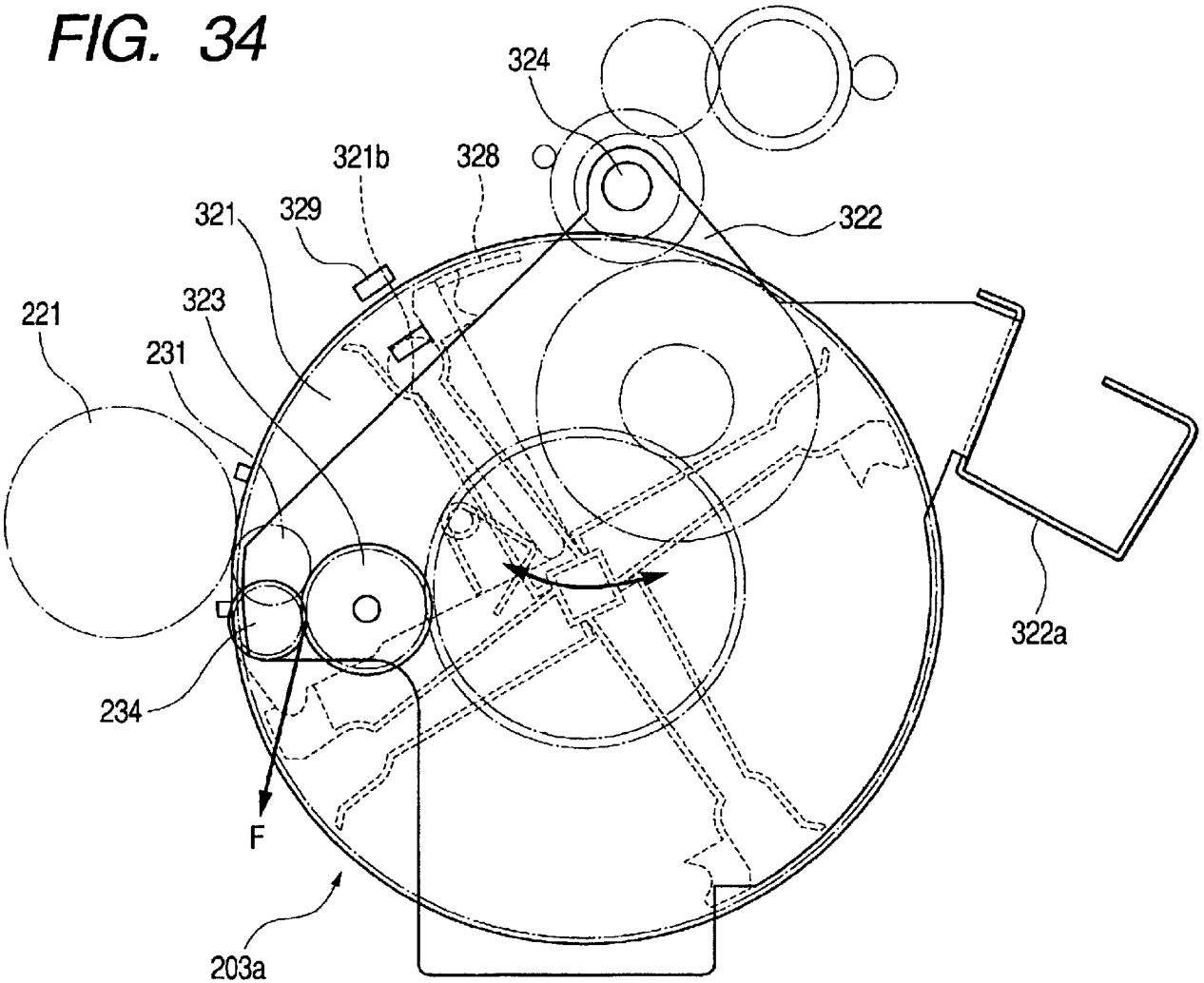
FIG. 34 illustrates the rocking mechanism of the rotary device.

A plurality of gears are fixed to one of the rotary side plates 322 so that these gears are able to be engaged with each other. As shown in FIG. 34, an input gear 234 of the developing cartridge 230 is engaged with an end gear 323 on the most downstream side among the gears arranged in a row on this rotary side plate 322, thereby rotatably driving rotational members such as the developing roller 231.

The developing cartridge 230 revolves by a predetermined angle along with the rotary flange 321 and therefore is connected to the end gear 323 of the rotary side plate 322. Here, when the developing cartridge 230 is rotated and moved along with the revolving of the rotary device 203*a*, there is the possibility that the tooth tip of the end gear 323 of the rotary side plate 322 collides with the tooth tip of the input gear 234 of the developing cartridge 230 and therefore these teeth are not correctly engaged with each other. In such a case, the developing cartridge 230 slides about the first receiving portion 321*b* of the rotary flange 321 and is temporarily retracted. In this manner, there is realized a construction where the engagement between these teeth is established with reliability.

To elaborate, in the case where the tooth tip of the end gear 323 of the rotary side plate 322 collides with the tooth tip of the input gear 234 of the developing cartridge 230, the developing cartridge 230 slides to some extent due to the impact in a radius direction of the rotary device 203*a* about the first receiving portion 321*b* of the rotary flange 321. As a result of this sliding of the developing cartridge 230, there is solved the problem in that the tooth tips collide with each other. In this manner, the developing cartridge 230 is positioned at a predetermined position by the energizing spring 321*e* of the rotary flange 231 described above.

Also, in the case where the driving of the developing cartridge 230 is finished and the developing cartridge 230 is revolved to the next position, even if the end gear 323 of the rotary side plate 322 is not opened to a through state, the rocking mechanism of the developing cartridge 230 allows the developing cartridge 230 and the rotary flange 321 to be detached from the engagement portion of the end gear 323.

When receiving a driving force from the end gear 323 of the rotary side plate 322, the input gear 234 of the developing cartridge 230 receives an engagement force F, as shown in FIG. 34. As a result of this engagement force F, the developing cartridge 230 receives an angular moment in the counterclockwise direction on the plane of the drawing about the first receiving portion 321*b* of the rotary flange 321, as indicated by the arrow.

As a result of this angular moment, the second protruding portion 230*c* of the developing cartridge 230 is pressed against the second receiving portion 321*c* of the rotary flange 321 (see FIG. 33), which prevents a situation where the developing cartridge 230 is displaced from the positioning portion of the rotary flange 321 during driving. Note that this engagement force is a closed force system within the rotary device 203*a*, so that there is reduced the influence on a pressurizing force to be described below that is exerted by the developing cartridge 230 onto the photosensitive body drum 221.

{Construction of Memory Tag}

As shown in FIGS. 20A, 20B, 21A and 21B, a memory tag (information recording medium) 260 that is an information storing medium attached to the developing cartridge 230 is a tag-shaped member obtained by arranging a storing element 261, contact points 262, and abutting portions 263 on a substrate (printed board) 264 that is a base body.

Figure 26:
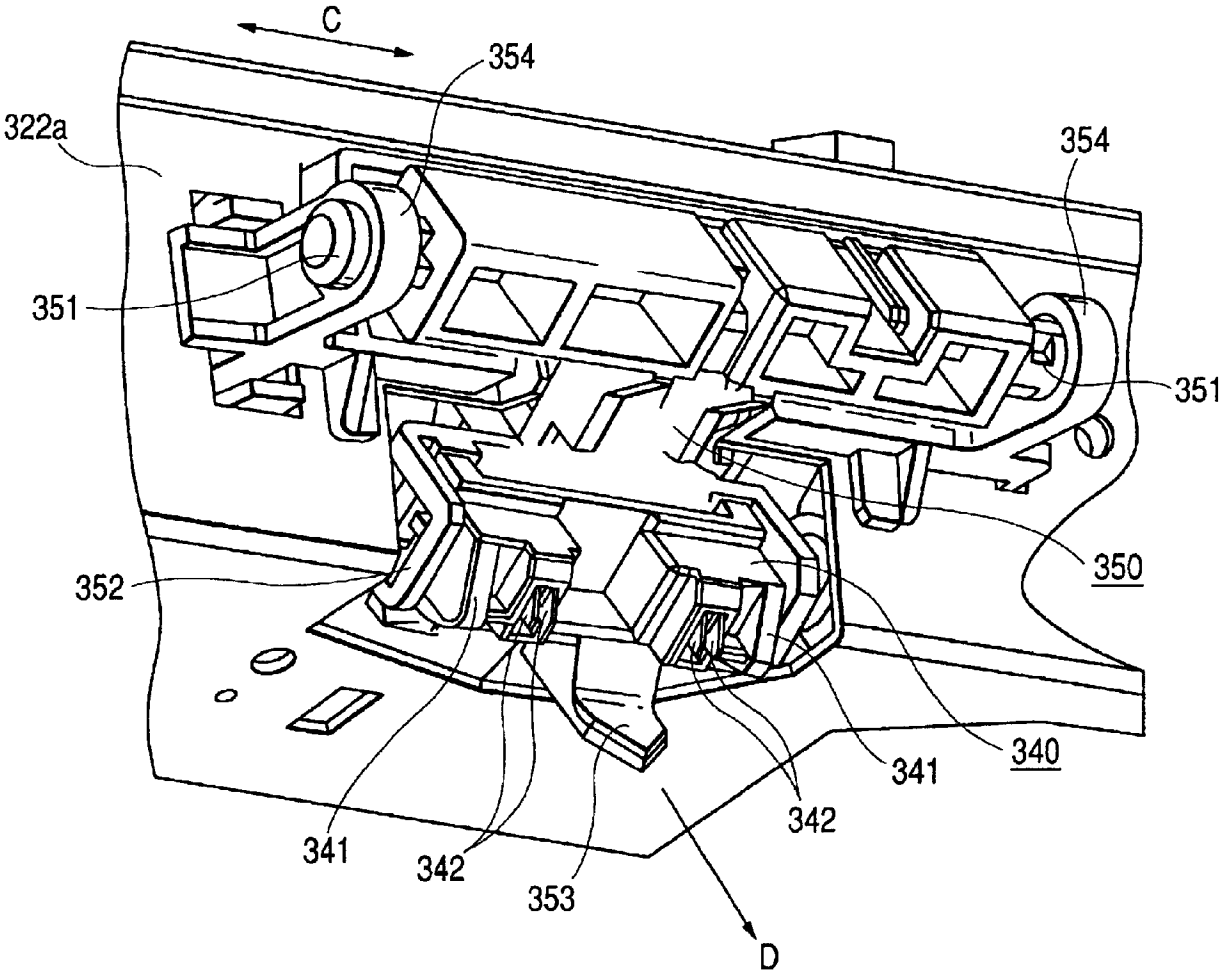
FIG. 26 is a perspective view showing the connector and a connector holder.
Figure 27:
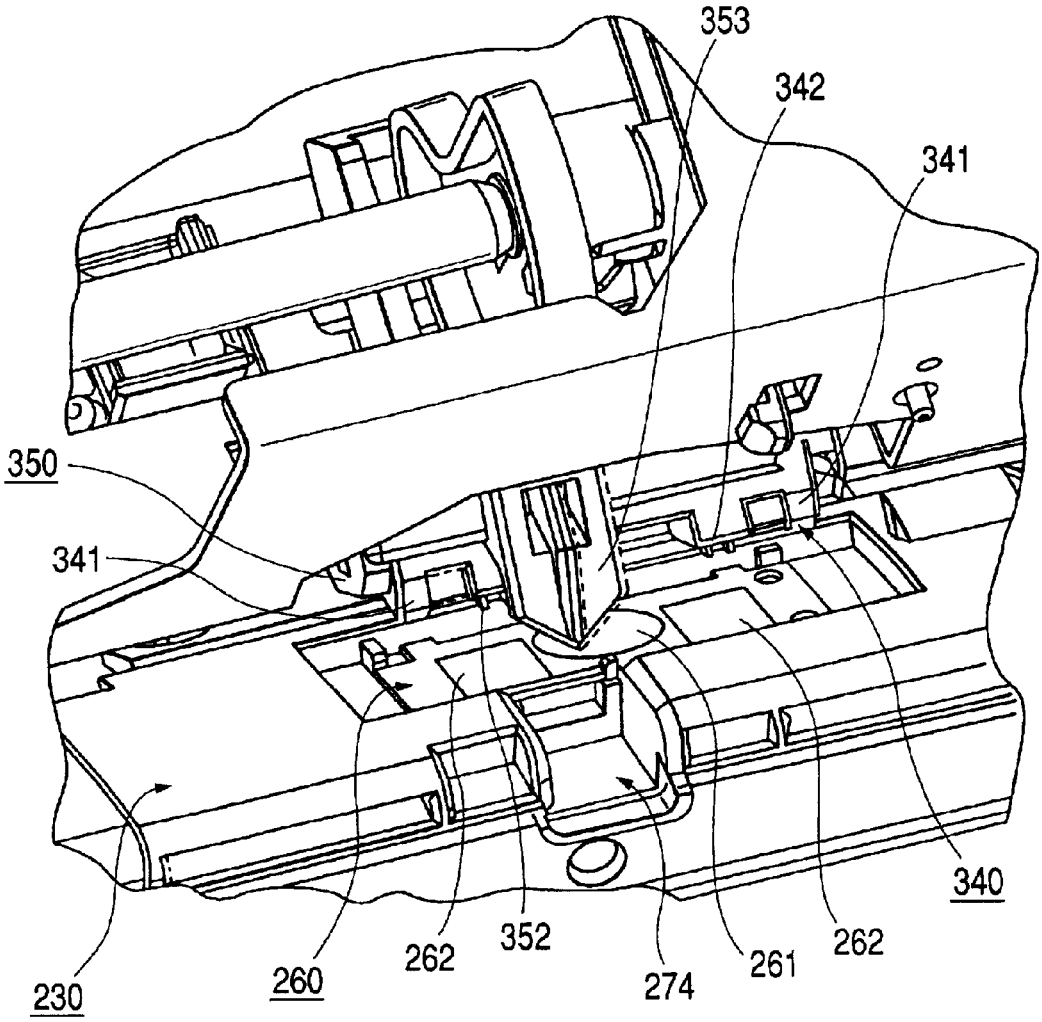
FIG. 27 is a perspective view showing the arrangement of the connector, the connector holder, and the memory tag.

In the memory tag 260, there are stored information concerning the usage of the developing cartridge 230 and various kinds of setting information and history information for controlling an image formation process. An engine controller of the apparatus main body performs reading/writing (hereinafter referred to as the "R/W") of data from and into the memory tag 260 at the appropriate times, thereby detecting the information concerning the usage of the developing cartridge 230. The R/W from and into the memory tag 260 is performed by the engine controller via electrical contact points (main body electrical contact points) 342 of the connector 340 to be described below (see FIG. 26).

The storing element 261 used for the memory tag 260 is arranged at the center of the substrate and is protected with a coating layer (protective member) 265 made of a resin. One contact point 262 is arranged on each side of the storing element 261, which means that two contact points 262 are arranged in total. Further, the abutting portion 263, against which a bumping portion (main body side bumping member) 341 of the connector 340 is bumped, is provided on a side of each contact point 262. Also, the two contact points 262 and the two abutting portions 263 are arranged in a row in the longitudinal direction of the memory tag 260.

As the base material of the printed board used for the memory tag 260, it is possible to use, for instance, glass fabric epoxy, glass base epoxy, glass paper epoxy, paper epoxy, paper polyester, paper phenol, or the like. Also, it is possible to manufacture both of a single-sided substrate and a double-sided substrate.

The area of each contact point 262 of the memory tag 260 has a rectangular shape and ensures the minimum width with which it is possible to cope with the displacements of the abutting position of the connector 340 of the apparatus main body 300. As to the contact point 262 of the memory tag 260 of this embodiment, a copper foil surface is given Ni plating and is further given gold plating. By providing a multi-layered plating in this manner, there is prevented the corrosion and the abrasion of the contact point 262.

Also, by ensuring that the gold plating that is a surface layer has a thickness that is at least equal to 0.05 $\mu$m (preferably at least equal to 0.3 $\mu$m), it becomes possible to maintain a low and stable contact resistance during a test by which the connector 340 of the apparatus main body is subjected to at least one thousand mating/disengaging operations.

The abutting portion 263 of the memory tag 260 exists on a resist surface of the substrate 264, that is, on the same plane as the contact point 262. That is, the resist surface of the end portion of the substrate is used as the abutting portion. Also, manufacturing has been performed so that the height of the contact point becomes the same as that of the abutting portion.

Next, there will be described a construction for attaching the memory tag 260.

Figure 22:
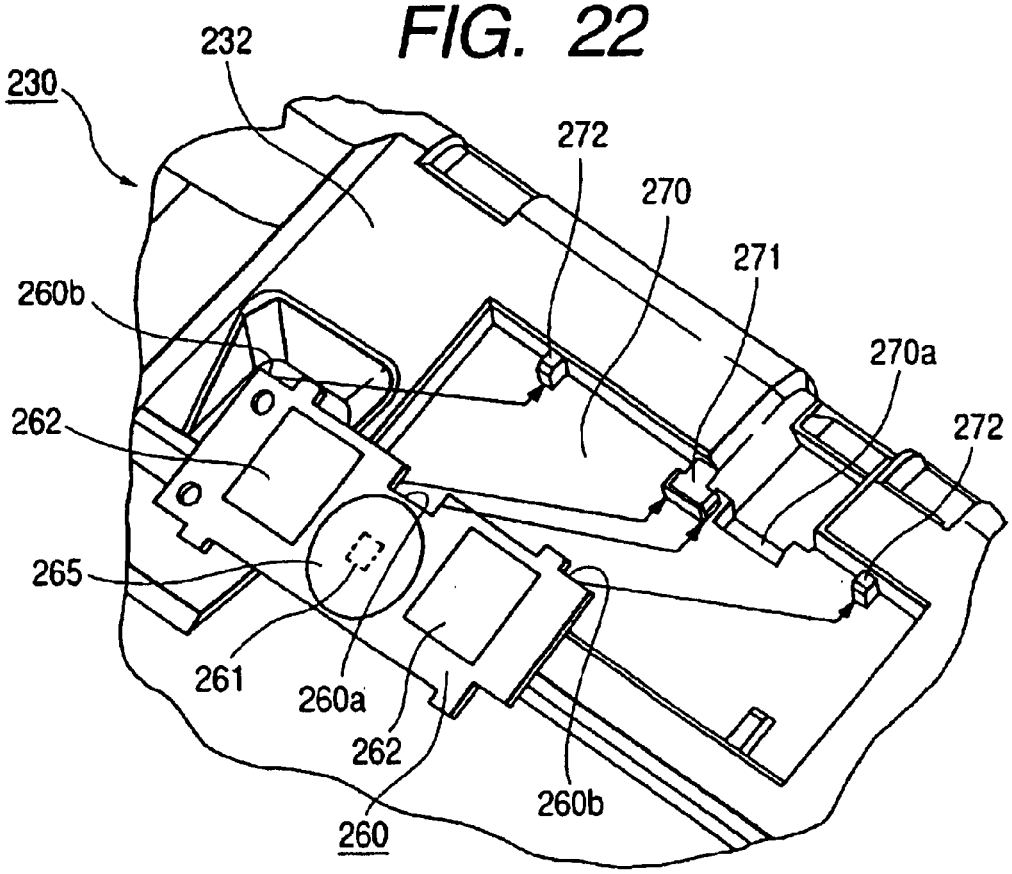
FIG. 22 is a disassembled perspective view showing the memory tag and attaching portions therefor.

As shown in FIG. 22, a dented flange (concaved flange) 270 (information recording medium mounting portion), to which the memory tag 260 is attached, is formed on an external surface of the developing cartridge 230, with the flange 270 being a concave flange that is formed vertical to a segment in a radius direction, whose center is the axis 320 of the rotary device 203*a*, and is depressed inward in a diameter direction. That is, the memory tag 260 is fixed so as to be parallel to a tangent plane in the rotation direction of the rotary device 203*a*.

As a result, at a stop position for the R/W to be described later, the connector 340 of the apparatus main body is capable of being vertically bumped against the memory tag 260, which makes it possible to perform a stable wiping operation and to establish a stable electrical connection.

The flange 270, to which the memory tag 260 is attached, is a concave portion formed for the toner container 232. At the center of the flange 270, there is arranged a rib 271 to be engaged with a groove portion 260*a* of the memory tag 260. Also, on each of the left and right sides of the rib 271 at the center, there is formed a positioning portion 272 for determining the position of a corresponding bumping portion 260*b* of the memory tag 260 in the widthwise direction by bumping the bumping portion 260*b*.

As a result of the engagement of the groove portion 260*a* with the rib 271, the positioning of the memory tag 260 in the longitudinal direction is performed. Also, the positioning in the widthwise direction is performed by bumping the bumping portion 260*b* on a long side of the memory tag 260 against the positioning portion 272.

Also, the rib 271 is provided at a position where even if the memory tag 260 is erroneously rotated by 180 and an attempt is made to attach the memory tag by mixing-up the left and right sides, the rib 271 is abutted against the substrate 261 and it becomes impossible to attach the memory tag 260.

In the case where the positioning portion in the longitudinal direction has a hole shape, the positioning portion on the cartridge side is a boss and the hole and the boss are engaged with each other. In this case, if the attachment is not performed straight with respect to the attachment surface of the cartridge, there is the possibility that there occurs prying between the hole of the memory tag and the boss of the cartridge and the assembly performance is degraded.

However, the positioning groove portion of the memory tag of this embodiment has a rectangular concave groove shape, so that even if bumping is not performed straight with respect to the attachment surface of the cartridge, it is possible to establish engagement between the positioning portions and to suppress the degradation of the assembly performance.

Also, in the case where the positioning portion in the longitudinal direction formed for the memory tag has a hole shape, the width of the memory tag is increased. However, in this embodiment, the positioning portion has a rectangular concave groove shape, so that it becomes possible to suppress the increase of the width of the memory tag.

Further, the groove portion for positioning the memory tag in the longitudinal direction has a concave groove shape, so that the positioning portion on the toner container side, to which the memory tag is attached, is not required to be parallel to the direction in which a mold is pulled out, which makes it possible to easily cope with the positioning of other models of cartridges having different container designs.

By the way, the memory tag 260 of this embodiment is detachably fixed to the developing cartridge 230 with an adhesive agent such as a double-faced tape. Also, for the flange 270 to which the memory tag 260 is attached, as shown in FIG. 22, there is formed a concave portion 270*a* through which commercially available tools like a minus screwdriver are inserted to assist in detachment of the memory tag 260.

As a result of this construction, in the case where a breakdown or flaw of the memory tag 260 is found during shipment inspection at a factory, it is possible to insert a tool into the concave portion 270*a* and to detach and replace the memory tag 260 without difficulty.

Also, in the same manner as above, it is possible to easily detach a memory tag from each cartridge collected at a recycling plant by a well-known collecting system or from each cartridge returned to a manufacturer due to a breakdown or the like. As a result, it is not required to prepare devices for performing memory tag R/W operations for respective kinds of cartridges, which makes it possible to check history information in all kinds of cartridges with a single tool.

Also, by checking the history information of a memory tag, it becomes possible to precisely grasp problems concerning the product quality occurring in the market. Also, by analyzing the history information, it becomes possible to develop a cartridge that gives more satisfaction to a customer.

As described above, the memory tag of this embodiment has a small size, excels in assembly and disassembly thereof, and is capable of being attached to a plurality of products having different application purposes, which increases the commonality of memory tags. Also, the advantage generated by mass production of memory tags is increased, which makes it possible to reduce the costs of the memory tags.

{Construction of Connector}

Next, there will be described the construction of the connector 340 that is arranged in the apparatus main body 300 for performing the R/W from and into the memory tag 260.

Figure 23:
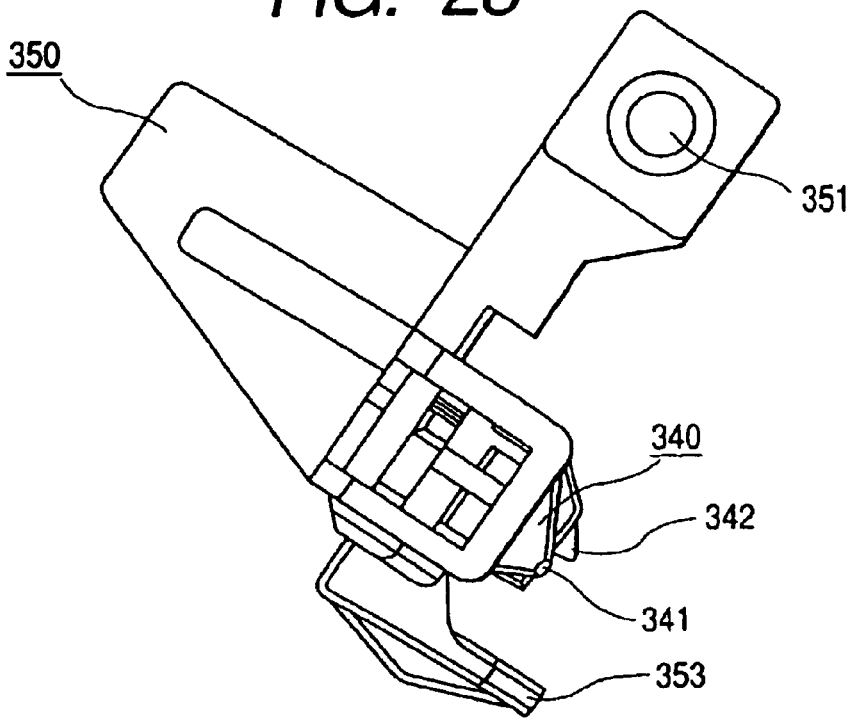
FIG. 23 is a side view showing a connector.
Figure 24A:
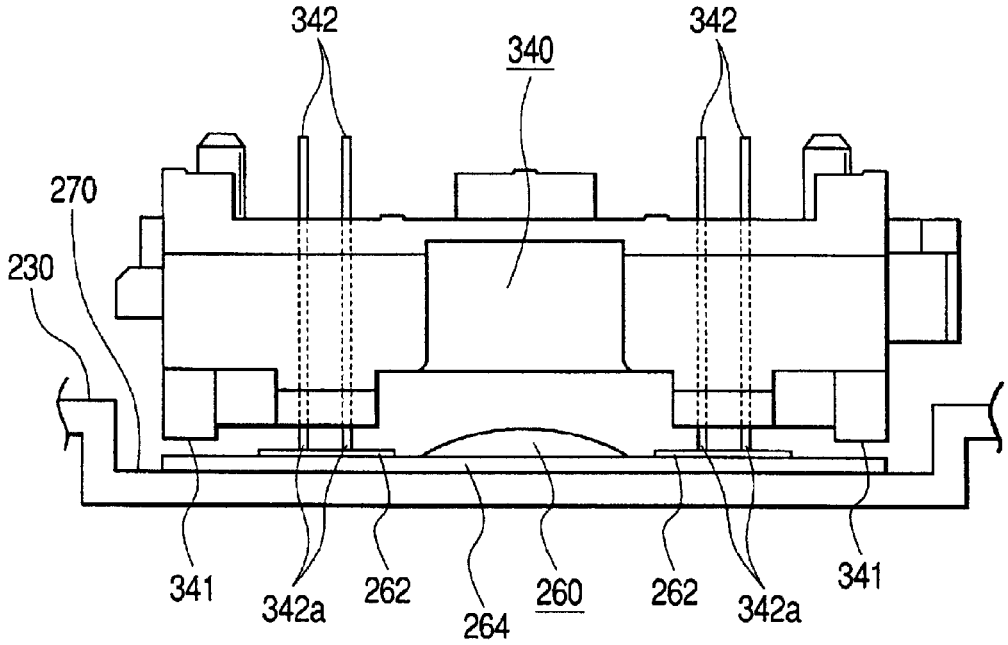
FIGS. 24A and 24B show abutting portions of the memory tag and the connector, with FIG. 24A being a partial view showing a state where the connector is not yet completely abutted against the memory tag and FIG. 24B being a partial view showing a state where the connector is completely abutted against the memory tag.

The connector 340 is fixed to the developing cartridge 230 within the apparatus main body 300 by a mechanism to be described later, with the connector 340 being fixed so as to be freely retracted. As shown in FIGS. 23, 24A and 25B, the bumping portion 341 is formed at each end of the connector 340 and four electrical contact points 342 (main body electrical contact points) made of a metal are arranged within these bumping portions 341. Also, the leading end portion 342*a* of each electrical contact point 342 and the bumping portion 341 are arranged in a row along the longitudinal direction of the connector 340.

Two leading end portions 342*a* contact each contact point 262*a* arranged at two positions of the memory tag 260, thereby establishing the electrical connection of the connector 340.

As described above, redundant designing has been done by having a plurality of electrical contact points contact each connection point of the memory tag. As a result, even in the case where there occurs poor conduction for one of the two electrical contact points for any reason, it is possible to ensure electrical connection using the remaining electrical contact points.

Each electrical contact point 342 is manufactured by cutting a thin plate made of a copper alloy or the like and subjecting the cut thin plate to bending. Like the contact point 262 of the memory tag, the leading end portion 342*a* of each electrical contact point 342 is given Ni plating and is further given gold plating, thereby improving its durability and reliability.

Also, the leading end portion 342*a* is bent by 90° with reference to a cut direction and a cutting edge portion contacts the contact point 262 of the memory tag.

Figure 24B:
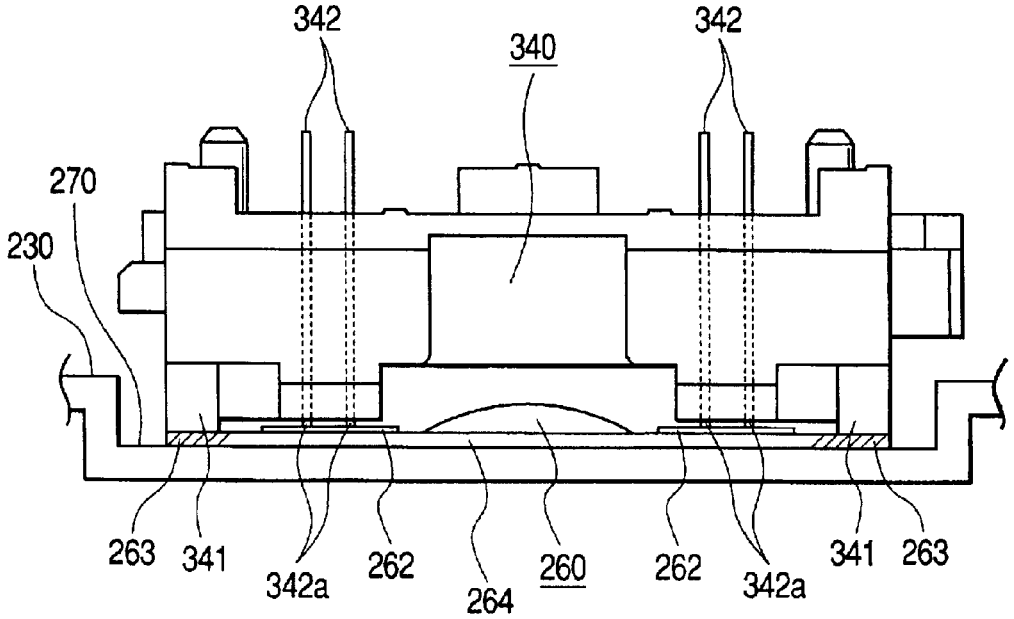
Figure 25A:
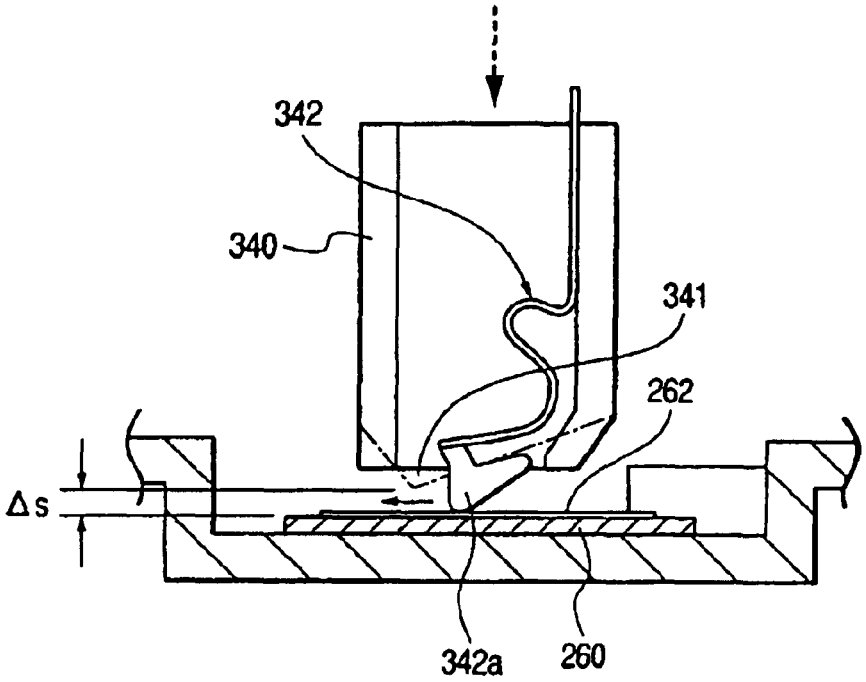
FIGS. 25A and 25B illustrate the deformation of a contact pin.
Figure 25B:
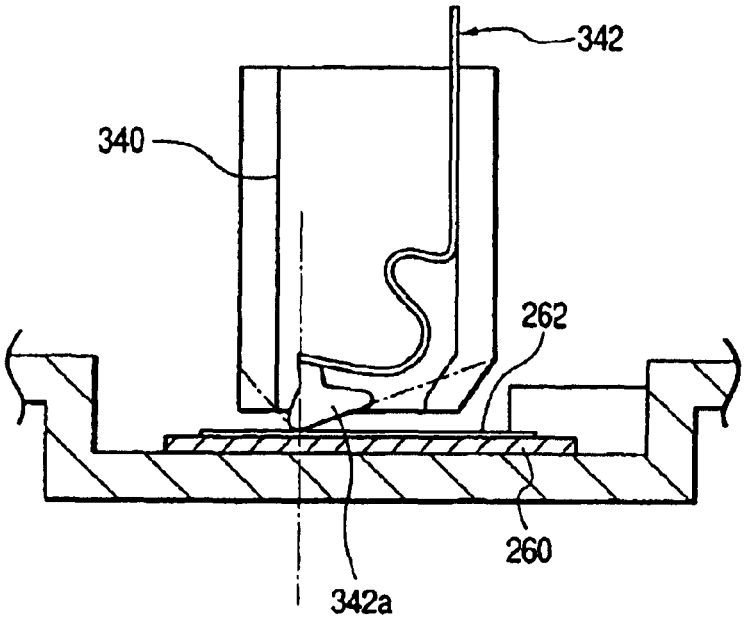

FIGS. 24A and 25A show a state where the connector 340 is not yet completely abutted against the memory tag 260, while FIGS. 24B and 25B show a state where the connector 340 is completely abutted against the memory tag 260. There is performed the same operation as in FIGS. 12A, 12B, 13A, and 13B described in the first embodiment.

{Mechanism for Controlling Abutment and Spacing of Connector}

Next, a mechanism for controlling the abutment and spacing of the connector 340 will be described with reference to FIGS. 26 to 31.

The connector 340 is detachably fixed to the connector holder 350. It is possible to detach only the connector 340 from the connector holder 350 to replace it in the event of an abnormality occurring to the contact point of the connector 340.

The connector holder 350 includes a rotation axis 351 parallel to the longitudinal direction of the connector 340, a connector attaching portion 352, and a longitudinal positioning lever 353. The rotation axis 351 is supported by bearings 354, and the connector 340 and the connector holder 350 are integrally rotated and moved about the rotation axis 351. The rotation axis 351 of the connector holder 350 is held by a fixing arm extending from a rotary stay 322*a* and is rotatably supported by the bearings 354.

Figure 28:
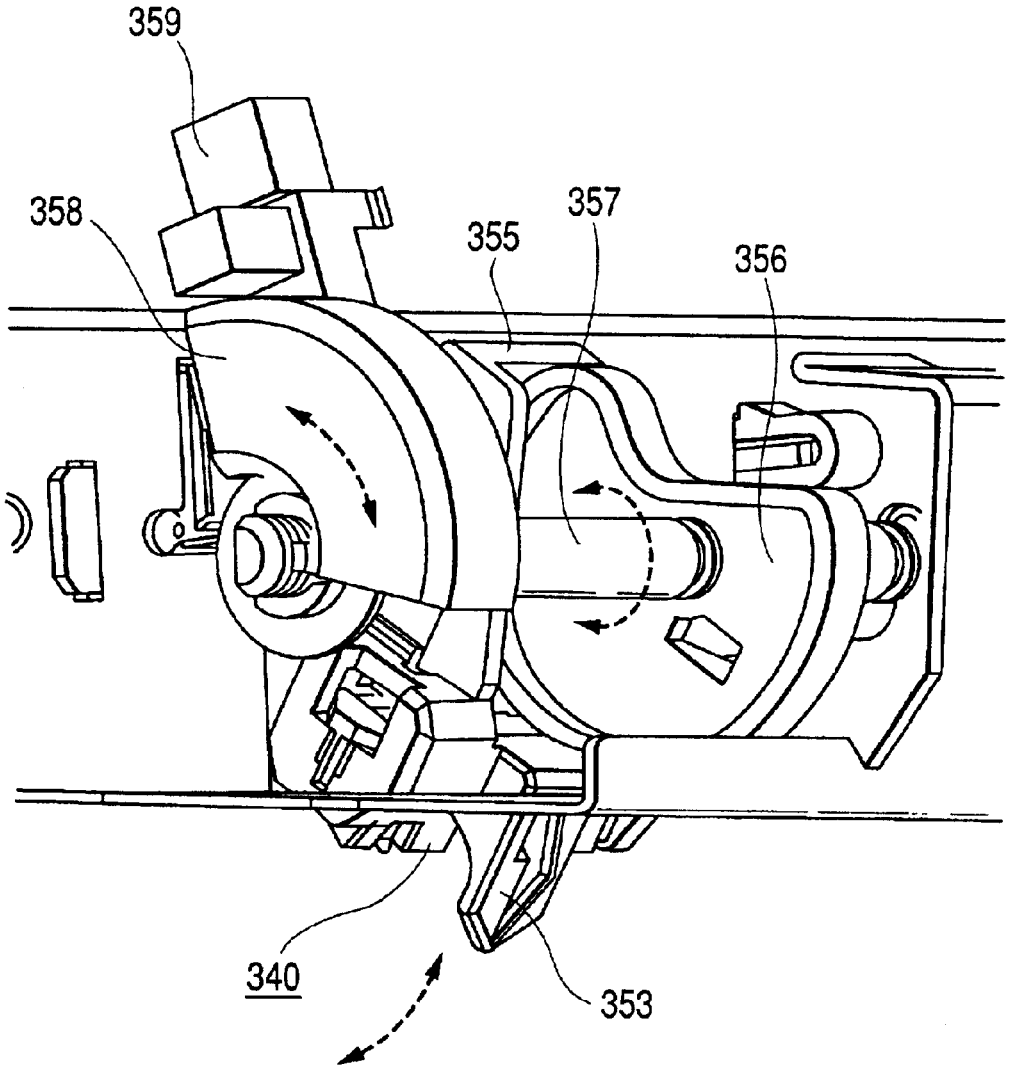
FIG. 28 illustrates a drive portion of the connector.
Figure 29:
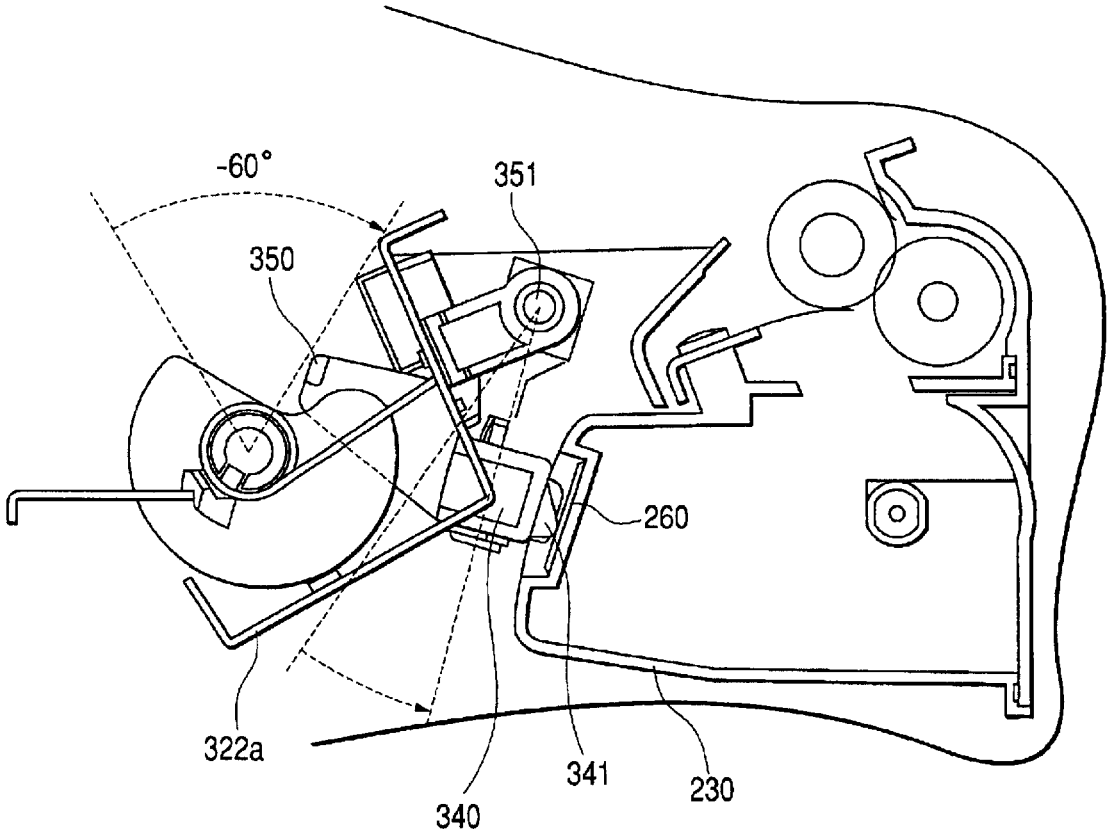
FIG. 29 is a cross-sectional view showing a state where the connector is abutted against the memory tag.
Figure 30:
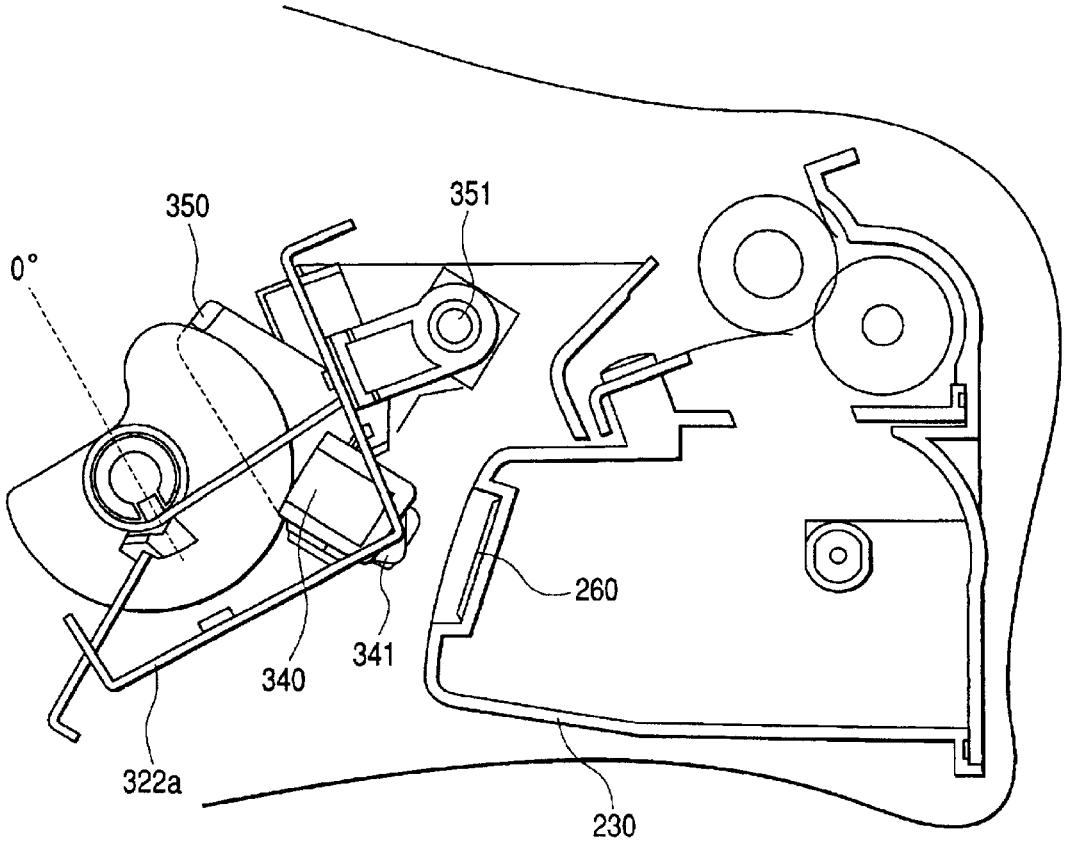
FIG. 30 is a cross-sectional view showing a state where the connector is spaced from the memory tag.

On the undersurface of the connector holder 350, as shown in FIG. 28, there is formed a retracting arm 355 extending outward vertical to the rotation axis 351. The spacing and pressurizing operations of the connector 340 and the connector holder 350 are controlled by the abutment and retracting of an end rib of the retracting arm 355 with respect to an abutting/spacing cam 356.

The connector bolder 350 is rotatably urged by an unillustrated connector pressurizing spring. Under a condition where the retracting arm 355 does not contact the abutting/spacing cam 356, the connector 340 is pressurized in a direction in which the connector 340 is abutted against the memory tag 260. In the case where the retracting arm 355 contacts the abutting/spacing cam 356, the connector 340 is retracted with respect to the memory tag 260. The spacing and pressurizing operations of the connector holder 350 and the connector 340 are performed by rotating the abutting/spacing cam 356 for a predetermined time period.

A rotation flag 358 is attached to an end of a rotation axis 357 of the abutting/spacing cam 356. Detection of a direction in which the abutting/spacing cam 356 rotates is performed by sensing the timing at which the rotation flag 358 blocks a spacing detection sensor 359.

The abutting/spacing cam 356 is rotated and driven by an unillustrated abutting/spacing motor, and this abutting/spacing motor also controls the abutting/spacing of the rotary device 203*a* to be described later. In more detail, by switching the direction in which the abutting/spacing motor rotates, the connector 340 is moved to one of two positions, that is, a pressuring position at which the connector 340 contacts the memory tag 260, and a spaced position at which the connector 340 is retracted.

The pressurizing for having the connector 340 contact the memory tag 260 is performed by rotating the abutting/spacing motor backward for a predetermined time period. Also, by rotating the abutting/spacing cam 356 by a predetermined angle, the retracting arm 355 of the connector holder 350 is separated from the abutting/spacing cam 356, and the connector 340 is thrust out and is abutted against the memory tag 260, as described above (see FIG. 29).

The spacing for retracting the connector 340 from the memory tag 260 is performed by rotating the abutting/spacing motor frontward for a predetermined time period. Opposite to the pressuring, the retracting arm 355 of the connector holder 350 is retracted by the abutting/spacing cam 356 and the connector 340 is spaced apart from the memory tag 260 (see FIG. 30).

It should be noted here that by monitoring the spacing detection sensor 359, positional detection is performed concerning the pressurizing/retracting of the connector 340. This control is also applied to the abutting/spacing operations of the rotary device to be described later.

At the center of the connector holder 350, as described above, the longitudinal positioning lever 353 is arranged so as to enter into a guide groove 274 that is a longitudinal positioning means of the developing cartridge 230. By having the longitudinal positioning lever 353 engaged with the guide groove 274 in this manner, there is obtained a construction where there are suppressed positional deviations of the connector 340 with respect to the memory tag 260 in a thrust direction.

{R/W from and into Memory Tag}

Each developing cartridge 230 performs the R/W from and into the memory tag 260 on a 90° downstream side from the dismounting position, at which it is possible to mount the developing cartridge 230 to the rotary unit 203*a*, as shown in FIG. 31.

In contrast to a general cartridge fixed to the apparatus main body, the developing cartridge 230 repeatedly revolves and moves using the rotary device. Accordingly, the contact between the memory tag 260 of the developing cartridge 230 and the connector 340 of the apparatus main body is repeated an extremely large number of times.

Supposing that the lifetime of a cartridge for each color expires when 5,000 copies have been made. In this case, if the R/W from and into the memory tag is performed each time a job is finished, 5,000 R/W operations are performed for the memory tag for each color at the maximum.

On the other hand, the connector of the apparatus main body contacts the memory tags for four colors of yellow, magenta, cyan, and black, which means that there is repeated contact twenty thousand times at the maximum for each set of cartridges. In the case where the lifetime of the apparatus main body expires when one hundred thousand copies have been made, it can be calculated that the connector performs the contact four hundred thousand times at the maximum.

Also, in the case where the printing ratio of a cartridge is set as low, this cartridge may be used to make copies whose number is more than twice as many as the prescribed lifetime. In this case, it may be conceived that the number of contact operations with the memory tags of the cartridges is linearly increased.

The ensuring of such an extremely large number of contacts becomes a technically high hurdle concerning both the memory tags and the connector. The memory tag and connector of this embodiment are designed to ensure reliability at a low cost and the following control is performed to reduce the number of contact operations during the R/W.

Reading is performed (1) when power is turned on, (2) when a cartridge door is closed, and (3) when an instruction is issued from a video controller.

On the other hand, writing is performed (1) when the number of copies specified by a job has been made or (2) when an instruction is issued from the video controller.

In this embodiment, the writing into the memory tag is performed each time 50 copies have been made, thereby updating usage information. Note that in the case where 50 or more copies are outputted in succession, after a number of copies specified by the job are made, the writing into the memory tag is performed. In the case where a cartridge is replaced midway through its lifetime or is replaced with a new cartridge, an unillustrated panel button is pushed, thereby performing writing to update the usage information of the cartridge to be replaced and this cartridge is rotated and moved to a dismounting position.

A mirror memory for storing the memory contents of the cartridge is embedded into a DC controller and the confirmation of the usage information of the cartridge is performed by reading the information in the mirror memory of the apparatus main body. That is, the operation for reading information from the memory tag of the cartridge is not performed each time the confirmation is performed.

When power is turned off or in the case where the cartridge door is opened, there is the possibility that a cartridge is replaced with another one, so that it is required to confirm the memory contents of the cartridge each time such a situation happens.

Also, in this embodiment, when power is turned on and when the cartridge door is closed, the operation for reading a memory tag is performed only for a cartridge existing at the dismounting position.

After a predetermined job is finished, the cartridge is moved to the dismounting position. In this embodiment, the cartridges for four colors are moved to the dismounting position in succession in a rotatable manner.

For instance, in the case where the cartridge for yellow was positioned at the dismounting position when a previous job was finished, a cartridge for magenta that is the second color in a chromatic order is moved to the dismounting position after the next job is finished. Then, after the still next job is finished, a cartridge for cyan that is the third color in the chromatic order is moved to the dismounting position. After the next job is finished, a cartridge for black that is the fourth color in the chromatic order is moved to the dismounting position.

That is, each time a job is finished, the cartridge positioned at the dismounting position is changed in a rotatable manner in the chromatic order of yellow, magenta, cyan, and then black.

Aside from the replacement of the developing cartridge, the cartridge door is also opened and closed in the case where jam clearance or the replacement of a process cartridge is performed.

As described above, there is prevented a situation where a cartridge for a specific color is positioned at the dismounting position, so that in the case where the cartridge door is opened for a purpose other than the replacement of the developing cartridge described above, there is reduced the possibility that access is almost exclusively performed to the memory tag of a cartridge for a specific color each time the access is performed.

Also, there is enough chance that the power of the apparatus main body is turned off every day. However, even in the case where the power is turned on every day, there is prevented a situation where a cartridge of a specific color exists at the cartridge dismounting position, which makes it possible to reduce the possibility that access is almost exclusively performed to the memory tag of a specific cartridge each time the power is turned on.

As has been described above, by setting conditions concerning the R/W access to the memory tag of each cartridge and changing the color of the cartridge existing at the dismounting position in a rotatable manner, it becomes possible to significantly reduce the number of R/W operations between the memory tag and connector.

It should be noted here that needless to say, as to the developing cartridge of this embodiment, there is obtained a construction where it is impossible to dismount the developing cartridge from the rotary device at a position other than the dismounting position.

Also, in the case where a prenotification that the lifetime of toner of a cartridge will expire is detected, a cartridge whose remaining lifetime is the shortest among cartridges for four colors, is given a high priority and is moved to the dismounting position.

{Construction for Pressurizing Developing Cartridge}

In this embodiment, the developing cartridges for four colors are contained in the rotary device. The pressurizing of these developing cartridges against the photosensitive body drum is performed as follows.

As shown in FIG. 32, in the above description, the rotary flange 321 is revolvably held with respect to the rotary side plate 322. Here, the rotary side plate 322 on each side is positioned and fixed to a side plate of the apparatus main body by a rocking axis 324 that is rotatably arranged in an upper portion thereof In other words, there is obtained a construction where the developing cartridge 230, the rotary flange 321, and the rotary side plate 322 are integrally rocked. That is, there is obtained a construction where, by the rocking motion in which the developing cartridge 230 and the rotary device 203*a* are integrally rocked, the developing cartridge 230 is pressurized against and is spaced from the photosensitive body drum 221.

The abutting/spacing operation of the rotary device 203*a* is performed by rotating a pressurizing cam. This pressurizing cam is arranged coaxially with the abutting/spacing cam 356 of the connector 340 described above. By switching the rotation direction of the abutting/spacing motor, the rotary device 203*a* is moved to two position, that is, a pressurizing position and a spaced position.

The pressurizing of the rotary device is performed by rotating the abutting/spacing motor frontward for a predetermined time period. By this frontward rotation, the pressurizing cam is rotated by a predetermined amount and the rotary device is thrusted against the photosensitive body drum.

The spacing of the rotary device is performed by an operation opposite to the operation performed during the pressurizing. To do so, the abutting/spacing motor is rotated backward.

It should be noted here that in this embodiment, it is possible to select one of a half spacing and a full spacing as a spacing position of the rotary device. In more detail, there is maintained a distance of around 2 mm between the photosensitive body drum and the developing cartridge at the half spacing position, while there is maintained a distance of around 4 mm therebetween at the full spacing position.

As a result, the rotary device can be moved to three positions of the pressurizing position, the half spacing position, and the full spacing position. The setting of the rotary device at these three stopping positions is performed by rotating the pressurizing cam in three steps of 0, 90°, and 180° using the abutting/spacing motor.

During image formation, the rotary device is revolved and the abutting/spacing operation is performed at the half spacing position. The full spacing of the rotary device is performed when the developing cartridge is placed at the dismounting position and when the R/W is performed for the memory tag of the developing cartridge.

In comparison with a case where the developing cartridge is abutted against the photosensitive body drum from the full spacing position, in the case where the developing cartridge is abutted from the half spacing position, it becomes possible to pressurize the rotary device with a short moving distance, which makes it possible to approximately halve the shock to the photosensitive body drum and the operation noise.

{Control of Rotation of Rotary}

As shown in FIGS. 31 and 32, a gear is integrally formed on the outer peripheral surface of the rotary flange 321 on each side and a one-pair driven gear 325 engaging with this gear is arranged on each side. The driven gear 325 on each side is coupled to each other through a rotation axis, which realizes a construction where when the rotary flange 321 on one side is rotated, the rotary flange 321 on the other side is rotated in the same phase via this driven gear 325.

With this driving construction, there is prevented a situation where one of the rotary flanges 321 is twisted during the revolving of the rotary flanges 321 or the driving of the developing roller 230.

At the center of the rocking of the rotary side plates 322, that is on the rocking axis 324, there is arranged a rotary driving gear for rotating the rotary flanges 321, with this rotary driving gear being connected to a rotary driving motor 326.

A well-known encoder 327 is attached to an end of the rotation axis of the rotary driving motor 326, and controls the number of rotations by detecting the amount of rotations of the rotary driving motor 326. On the other hand, a protruding flag 328 is formed on a side of the outer periphery of the rotary flange 321 and rotates so as to pass through a photo-interrupter 329 fixed to the rotary side plate 322.

In this embodiment, using the timing when the flag 328 blocks the photo interpreter 329 as a reference, control is performed so that the rotary device 203*a* revolves by a predetermined angle. The control of this revolving angle is performed by detecting the amount of rotations using the encoder 327.

Also, the number of rotations of the rotary device has conventionally been controlled using a pulse motor or the like and thus a grating higher harmonic wave is generated by excitation. In this embodiment, however, the drive control is performed using a DC motor, so that it becomes possible to perform the driving of the rotary device more quietly.

There is the danger that the rotary device is rotated and displaced during the driving of the developing cartridges, so that it is required to lock the rotation of the rotary device. It is possible to lock the rotation of the rotary device by applying electrical braking to the DC motor that is a driving motor for the rotary device, although there is a high possibility that the temperature of the DC motor is increased and this motor is burned up if the braking is applied for a long time period.

In this embodiment, a brake groove is arranged on the rotation axis of the driven gear that rotates along with the rotary device, and a stopper claw is inserted into the brake groove at each position at which the developing cartridges will stop. The ascending/descending of this stopper claw is performed by turning on/off a solenoid at predetermined timings.

As described above, with a mechanical brake, there are prevented the displacements of the position at which the rotary device stops.

With the technique of this embodiment, the memory tag that is an information storing medium is provided with abutting portions against which the connector of the apparatus main body is abutted. Therefore, the amount of elastic deformation and contact pressure of the contact pins arranged for the connector, with respect to the contact points of the memory tag, become constant and there is obtained a stable electrical connection, which makes it possible to perform favorable communications at all times.

Further, the contact points of the memory tag and the abutting portions exist on a plane having the same height. This construction improves the dimensional precision of the abutting portions and the contact points of the memory tag in a height direction, which stabilizes the amount of elastic deformation and contact pressure of the contact pins.

Also, the contact points and abutting portions of the memory tag are provided separately from each other and only the electrical contact points of the contact pins contact the surface of the contact points. This precludes the possibility that powder generated by the abrasion of the connector pollutes the contact points when abutting is performed. As a result, it becomes possible to perform communication operations with stability.

The notched portion for positioning the memory tag has a rectangular concave groove shape, so that even if it does not bump straight against the attaching surface of the cartridge, it is possible to establish engagement with the positioning portions and to diminish the degradation of the ability to assemble the apparatus.

Also, each positioning portion in the longitudinal direction which is formed for the memory tag has a rectangular concave groove shape, so that it becomes possible to suppress the increase of the width of the memory tag. It also becomes possible to reduce the sizes of the cartridge and the apparatus main body.

Further, the positioning portion of the memory tag on the cartridge side is not required to be parallel to the direction in which a mold is pulled out, which makes it possible to easily cope with the positioning of other models of cartridges having different container designs. As a result, it becomes possible to commonly use the memory tag for many models and to reduce costs due to the advantages generated by mass production.

The connector is abutted against the memory tag under a condition where the bumping portions and the electrical contact points in the leading end portions of the contact pins are arranged on a straight line, which makes it possible to ensure stabilized contact pressure and to reduce variations of contact resistance.

It is also possible to commonly use the connector of the apparatus main body for many models, so that it is possible to reduce the cost of the connector due to the advantages generated by mass production.

It is further possible to precisely position the thrust direction of the connector with reference to the memory tag, so that it is possible to reduce the size of each contact point of the memory tag and to contribute to the reduction of the size of the apparatus by reducing the width of the memory tag.

Third Embodiment

Figure 39:
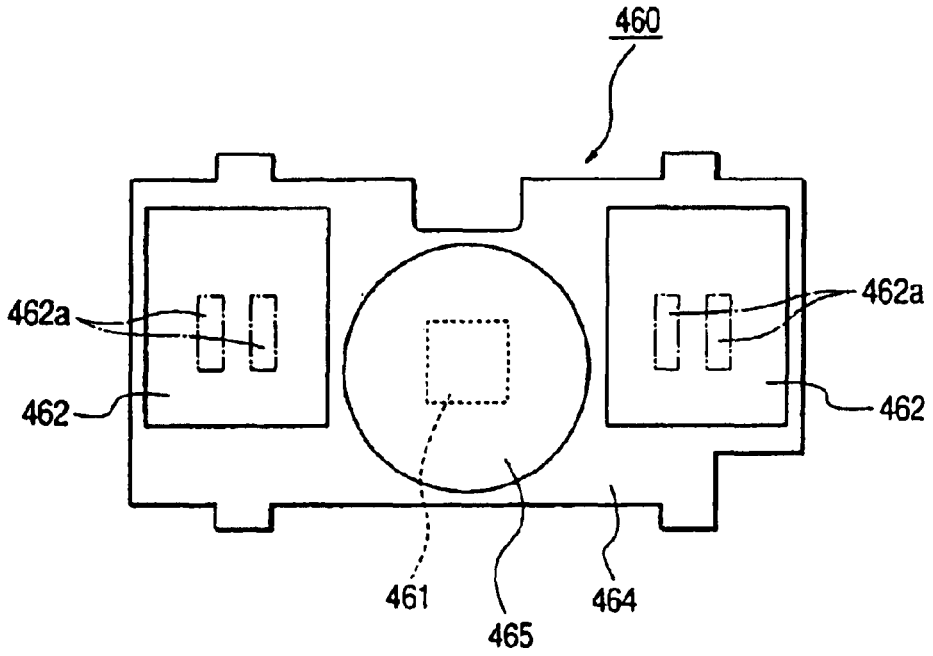
FIG. 39 shows a memory tag according to a third embodiment of the present invention.

FIG. 39 shows the third embodiment. In this embodiment, only items differing from the first embodiment described above will be described and the description of the same construction as in the first embodiment will be omitted.

(Construction of Memory Tag)

Figure 40:
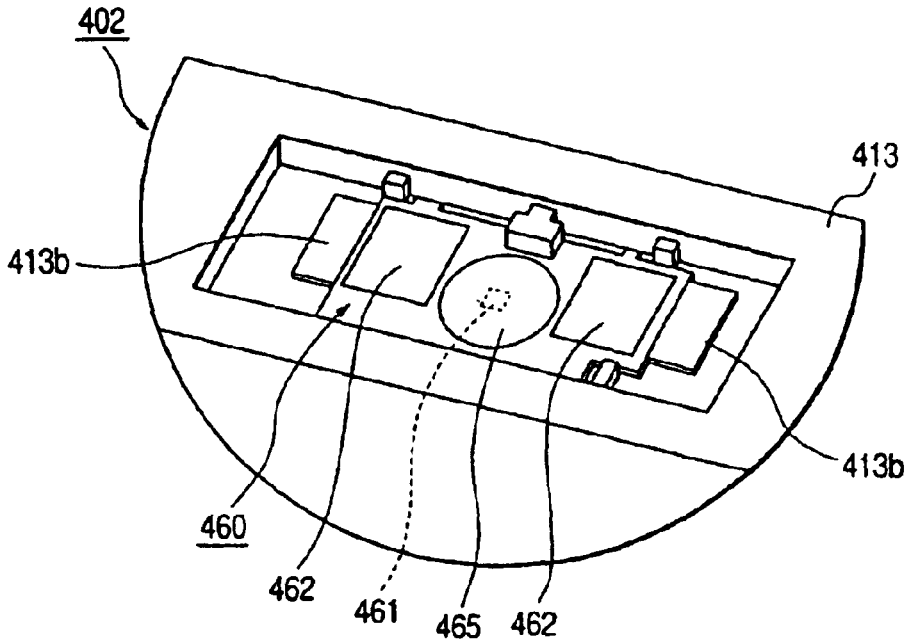
FIG. 40 is a perspective view showing a state where the memory tag in FIG. 39 is attached to a drum frame.

As shown in FIGS. 39 and 40, a memory tag 460 (an information storing medium) that is an information storing medium is attached to the surface of a drum frame 413 of a process cartridge 402. The memory tag 460 is a tag-shaped member obtained by arranging a storing element 461 and contact points 462 on a substrate (printed board) 464 that is a base body.

The storing element 461 is arranged at the center and is coated with a resin. Also, the contact points 462 are arranged on the same plane as the storing element 461 and on both sides of the coating layer (protective member) 465 protecting the storing element 461.

In this embodiment, an abutting portion 413*b*, against which the bumping portion (main body electrical contact point) 141 of the connector 140 shown in FIG. 10 is abutted, is provided outside of the memory tag contact point 462 of the drum frame 413 of the cartridge 402. The bumping portion 141 of the connector 140 described above is abutted against this abutting portion 413*b*.

As described above, with the technique of this embodiment, the storing element 461 and the electrical contact point 462 of the memory tag are arranged on a virtually straight line, so that it becomes possible to reduce the size of the memory tag and increase the flexibility concerning its attaching position with respect to the process cartridge.

Also, by providing the abutting portion 413*b*, against which the bumping portion 141 of the connector 140 is abutted, for the drum frame 413, the deflection amount of the electrical contact point made of a metal that generates contact pressure by the elastic deformation on the connector side becomes constant and it becomes possible to stabilize the contact pressure between the connector and the memory tag. It also becomes possible to further reduce the size of the memory tag 460.

There is obtained a construction where the abutting portion 413*b* provided parallel to the electrical contact point 462 is arranged on an extension line of each electrical contact point 462. With this construction, each of the distances between the electrical contact points 462 and the bumping portions 141 of the connector become equal to each other, and the pressure balance of the electrical contact points 142 becomes even. As a result, it becomes possible to prevent poor conduction due to insufficient contact pressure or the like with more reliability.

Also, like in the first embodiment, each contact point 462 is provided with two sliding regions 462*a* on each of which two electrical contact points 142 contact and slide. With this construction, there is improved the reliability of electrical connection between the contact points 462 and the electrical contact points 142.

Fourth Embodiment

Figure 41:
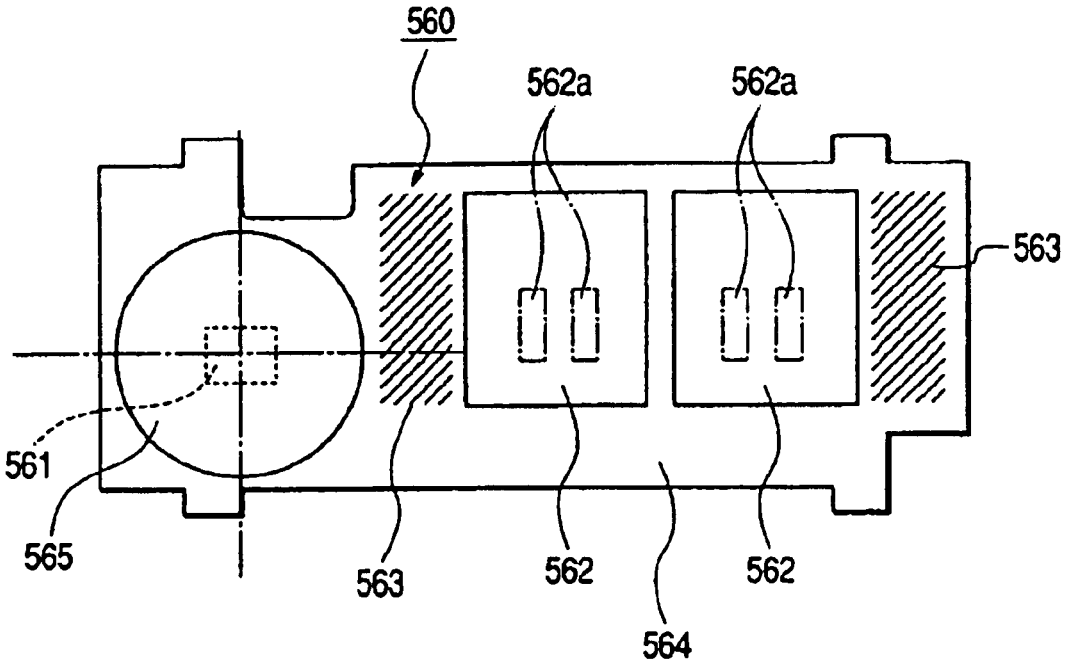
FIG. 41 shows a memory tag according to a fourth embodiment of the present invention.

FIG. 41 shows the fourth embodiment. In this embodiment, only items differing from the first embodiment described above will be described and the description of the same construction as in the first embodiment will be omitted.

(Construction of Memory Tag)

As shown in FIG. 41, a memory tag 560 (an information storing medium) is a tag-shaped member obtained by arranging a storing element 561 and contact points 562 on a substrate (printed board) 564 that is a base body.

The storing element 561 is arranged on one end and is protected with a coating layer 565 made of a resin. Also, the electrical contact points 562 are arranged on the same plane as the storing element 561 and substantially in alignment with the storing element 561 on one side thereof, and there is arranged an abutting portion 563 against which the bumping portion 141 of the connector 140 is abutted.

As described above, with the technique of this embodiment, the electrical contact point 562 and the coating layer 565 of the storing element of the memory tag is arranged on a virtually straight line, which makes it possible to reduce the size of the memory tag 560 and to increase the flexibility concerning the attaching position thereof with respect to the process cartridge.

Also, by providing the abutting portion 563, against which the bumping portion 141 of the connector 140 is bumped, on a side of each electrical contact point 562, the deflection amount of the electrical contact point 142 of the connector 140 becomes constant and it becomes possible to stabilize the contact pressure of the electrical contact point 142 of the connector 140. It also becomes possible to further reduce the size of the memory tag.

There is obtained a construction where the abutting portion provided parallel to the contact point is arranged on an extension line of the each contact points. With this construction, each of the distances between the bumping portions and the contact points of the connector becomes equal to each other and the pressure balance becomes even. As a result, it becomes possible to prevent poor conduction due to insufficient contact pressure or the like with more reliability.

Also, like in the first embodiment, each contact point 562 is provided with two sliding regions 562*a* on each of which two electrical contact points 142 contact and slide. With this construction, there is improved the reliability of electrical connection between the contact points 562 and the electrical contact points 142.

As has been described above in the first to fourth embodiments, in the contact energizing mechanism where transmission and reception of information is performed by having electrical contact points of the main body of the image forming apparatus contact contact points provided on the surface of the information storing medium that stores service information or the like of a unit such as a process cartridge, a developing cartridge, or the like, there is provided on the contact point of the information storing medium a portion in which the electrical contact point of the image forming apparatus main body slides. The electrical contact point of the communication means slides on the contact point of the information storing medium when the electrical contact point contacts the contact point (this sliding is referred to as the "wiping"). As a result of this wiping, adherents and an oxide film are scraped off, which makes it possible to establish electrical connection with reliability. Also, the storing element and its protective member are arranged in a row, so that it becomes possible to minimize the length of a short side of the substrate provided with the storing means, which makes it possible to arrange this substrate in a compact process cartridge. For information, the size of the process cartridge in its longitudinal direction is slightly larger than the maximum width of paper that passes through the image forming apparatus main body to which the process cartridge is mounted. Accordingly, if an attempt is made to arrange the information storing medium on the upper surface or the underside of the process cartridge, no limitation is imposed in the longitudinal direction. However, limitations are imposed in the widthwise direction because the width is reduced in accordance with the reduction of the size. As a result, as described above, the information storing means having the minimized length of a short side becomes mountable regardless of the kinds of process cartridges.

Also, an abutting portion, against which the bumping portion of the connector is abutted, is provided adjacent to the contact point of the information storing medium. The amount of displacement of the electrical contact point of a connector when the electrical contact point is pressed against the contact point of the information storing medium is determined by the protruding amount of the bumping portion of the connector or the like, so that it becomes possible to set the contact pressure of the electrical contact point of the connector, which is exerted on the contact point of the information storing medium, at a predetermined value. Contact pressure is determined by the abutting portion in this manner and is kept constant at all time, so that it becomes possible to stabilize electrical connection and to perform extremely favorable communications.

With the two-dimensional and simple construction where the contact point and abutting portion are arranged in parallel on one surface of the substrate including the storing element, it becomes easy to reduce the size and there is obtained the advantage brought by mass production because it is possible to commonly use the substrate for many models, which significantly contributes to the reduction of costs of components.

Also, at an edge of the substrate on one side, there is provided the notched portion that engages with the positioning portion of a unit such as the developing cartridge or the process cartridge. As a result, it becomes possible to simplify the attaching construction of the information storing medium. It also becomes possible to use this notched portion to prevent inverted attachment from occurring when the information storing medium is mounted to the developing cartridge, the process cartridge, or the like.

The present invention is constructed in the manner described above, so that there are obtained the following effects.

The main body electrical contact point provided on the main body of an electrophotographic image forming apparatus contacts the electrical contact point of an information storing medium with stability and reliability, thereby ensuring reliable electrical connection.

Also, when the electrical contact point of the information storing medium contacts the main body electrical contact point provided on the apparatus main body, it is possible to maintain the contact in a stable manner.

Also, even if scattered toner or the like adheres to the main body electrical contact point or the electrical contact point, it is possible to ensure reliable electrical connection by removing these adherents.

Also, it becomes possible to realize the reduction of the size of the information storing medium and to save space.

What is claimed is:

1. An information storing medium to be mounted to a main body of an electrophotographic image forming apparatus, comprising:

a substrate;

a storing element, provided on said substrate, configured to store information;

an electrical contact point provided on said substrate and electrically connected to said storing element, wherein when said information storing medium is mounted on the main body of the apparatus, said electrical contact point contacts a main body electrical contact point provided on the electrophotographic image forming apparatus; and a sliding region that is provided on said electrical contact point, wherein in the case that said electrical contact point and the main body electrical contact point contact each other, the main body electrical contact point contacts said electrical contact point with sliding in said sliding region, wherein, in the case that said electrical contact point contacts the main body electrical contact point, a contact pressure caused by contact of said electrical contact point and the main body electrical contact point is regulated by a main body abutting member provided in the main body of the electrophotographic image forming apparatus.

2. An information storing medium according to claim 1, wherein said substrate is provided with an abutting portion that is abutted against the main body abutting member, and wherein the regulation of the contact pressure is effected by abutting of the main body abutting member and said abutting portion.

3. An information storing medium according to claim 2, wherein said abutting portion includes a first abutting portion and a second abutting portion, wherein said electrical contact point includes a first electrical contact point and a second electrical contact point, and wherein said first abutting portion, said first electrical contact point, said second electrical contact point, and said second abutting portion are arranged in a row in this order from one end side to the other end side of said substrate in a longitudinal direction of said substrate.

4. An information storing medium according to any one of claims 1 to 3, wherein in a sliding direction in which the main body electrical contact point slides, said sliding region is provided at two locations in parallel, with a length thereof being in a range of from 0.2 mm to 5 mm.

5. An information storing medium according to claim 2, wherein said abutting portion includes a first abutting portion provided at an end of said substrate in a longitudinal direction of said substrate and a second abutting portion provided at another end of said substrate in the longitudinal direction of said substrate, wherein said electrical contact point includes a first electrical contact point and a second electrical contact point, and wherein said electrical contact point is provided between said first abutting portion and said second abutting portion.

6. A unit detachably mountable to a main body of an electrophotographic image forming apparatus, comprising:

an information storing medium including:

a substrate;

a storing element, provided on said substrate and configured to store information;

an electrical contact point that is provided on said substrate, and is electrically connected to said storing element, wherein when said unit is mounted on the main body of the electrophotographic image forming apparatus, said electrical contact point contacts a main body electrical contact point provided on the main body of the electrophotographic image forming apparatus; and a sliding region that is provided on said electrical contact point, wherein in the case that said electrical contact point and the main body electrical contact point contact each other, the main body electrical contact point contacts said electrical contact point with sliding in said sliding region; and an information storing medium mounting portion in which said information storing medium is mounted, wherein, in the case that said electrical contact point contacts the main body electrical contact point, a contact pressure caused by contact of said electrical contact point and the main body electrical contact point is regulated by a main body abutting member provided in the main body of the electrophotographic image forming apparatus.

7. A unit according to claim 6, wherein said substrate is provided with an abutting portion that is abutted against the main body abutting member, and wherein the regulation of the contact pressure is effected by abutting of said main body abutting member and said abutting portion.

8. A unit according to claim 6, further comprising a frame of said unit, wherein said frame includes an abutting portion on which the main body abutting member abuts, and wherein the regulation of the contact pressure is effected by abutting of the main body abutting member and said abutting portion of said frame.

9. A unit according to claim 7, wherein said abutting portion includes a first abutting portion and a second abutting portion, wherein said electrical contact point includes a first electrical contact point and a second electrical contact point, and wherein said first abutting portion abutting against the main body abutting member provided on the apparatus main body, said first electrical contact point, said second electrical contact point, and said second abutting portion, are arranged in a row in this order from one end side to the other end side in a longitudinal direction of said substrate.

10. A unit according to any one of claims 6 to 9, wherein in a sliding direction in which the main body electrical contact point slides, said sliding region is provided at two locations in parallel, with a length thereof being in a range of from 0.2 mm to 5 mm.

11. A unit according to claim 7, wherein said abutting portion includes a first abutting portion provided at an end of said substrate in a longitudinal direction of said substrate and a second abutting portion provided at another end of said substrate in the longitudinal direction of said substrate, wherein said electrical contact point includes a first electrical contact point and a second electrical contact point, and wherein said electrical contact point is provided between said first abutting portion and said second abutting portion.

12. A process cartridge that is detachably mountable to a main body of an electrophotographic image forming apparatus, comprising:

an electrophotographic photosensitive body;

a process device configured and positioned to act on said electrophotographic photosensitive body;

an information storing medium including:

a substrate;

a storing element provided on said substrate, configured to store information;

an electrical contact point provided on said substrate, and electrically connected to said storing element, wherein when said process cartridge is mounted on the electrophotographic image forming apparatus, said electrical contact point contacts a main body electrical contact point provided on the electrographic image forming apparatus; and a sliding region that is provided on said electrical contact point, wherein when said electrical contact point and the main body electrical contact point contact each other, the main body electrical contact point slides on said electrical contact point in said sliding region; and an information storing medium mounting portion in which said information storing medium is mounted, wherein, in the case that said electrical contact point contacts the main body electrical contact point, a contact pressure caused by contact of said electrical contact point and the main body electrical contact point is regulated by a main body abutting member provided in the main body of the electrophotographic image forming apparatus.

13. A process cartridge according to claim 12, wherein said substrate is provided with an abutting portion that is abutted against the main body abutting member, and wherein the regulation of the contact pressure is effected by abutting of the main body abutting member and said abutting portion.

14. A process cartridge according to claim 13, wherein said abutting portion includes a first abutting portion and a second abutting portion, wherein said electrical contact point includes a first electrical contact point and a second electrical contact point, and wherein said first abutting portion, said first electrical contact point, said second electrical contact point, and said second abutting portion are arranged in a row in this order from one end side to the other end side of said substrate in a longitudinal direction of said substrate.

15. A process cartridge according to claim 12, further comprising a frame, wherein said frame includes an abutting portion on which the main body abutting member abuts, and wherein the regulation of the contact pressure is effected by abutting of the main body abutting member and said abutting portion of said frame.

16. A process cartridge according to any one of claims 12 to 14, wherein in a sliding direction in which the main body electrical contact point slides, said sliding region is provided at two locations in parallel, with a length thereof being in a range of from 0.2 mm to 5 mm.

17. A process cartridge according to claim 13, wherein said abutting portion includes a first abutting portion provided at an end of said substrate in a longitudinal direction of said substrate and a second abutting portion provided at another end of said substrate in the longitudinal direction of said substrate, wherein said electrical contact point includes a first electrical contact point and a second electrical contact point, and wherein said electrical contact point is provided between said first abutting portion and said second abutting portion.

18. A developing cartridge detachably mountable to a main body of an electrophotographic image forming apparatus, comprising:

a developing device configured and positioned to develop an electrostatic latent image formed on an electrophotographic photosensitive body with a developer;

an information storing medium including:

a substrate;

a storing element provided on said substrate, configured to store information;

an electrical contact point that is provided on said substrate, and is electrically connected to said storing element, wherein in the case that said developing cartridge is mounted on the main body of the electrophotographic image forming apparatus, said electrical contact point contacts a main body electrical contact point provided on the main body of the electrophotographic image forming apparatus; and a sliding region that is provided on said electrical contact point, wherein when said electrical contact point and the main body electrical contact point contact each other, the main body electrical contact point contacts said electrical contact point with sliding in said sliding region; and an information storing medium mounting portion in which said information storing medium is mounted, wherein in the case that said electrical contact point contacts the main body electrical contact point, a contact pressure caused by contact of said electrical contact point and the main body electrical contact point is regulated by a main body abutting member provided in the main body of the electrophotographic image forming apparatus.

19. A developing cartridge according to claim 18, wherein said substrate is provided with an abutting portion that is abutted against the main body abutting member, and wherein the regulation of the contact pressure is effected by abutting of the main body abutting member and said abutting portion.

20. A developing cartridge according to claim 19, wherein said abutting portion includes a first abutting portion and a second abutting portion, wherein said electrical contact point includes a first electrical contact point and a second electrical contact point, and wherein said first abutting portion, said first electrical contact point, said second electrical contact point, and said second abutting portion are arranged in a row in this order from one end side to the other end side of said substrate in a longitudinal direction of said substrate.

21. A developing cartridge according to claim 18, further comprising a frame, wherein said frame includes an abutting portion on which the main body abutting member abuts, and wherein the regulation of the contact pressure is effected by abutting of the main body abutting member and said abutting portion of said frame.

22. A developing cartridge according to any one of claims 18 to 20, wherein in a sliding direction in which the main body electrical contact point slides, said sliding region is provided at two locations in parallel, with a length thereof being in a range of from 0.2 mm to 5 mm.

23. A developing cartridge according to claim 19, wherein said abutting portion includes a first abutting portion provided at an end of said substrate in a longitudinal direction of said substrate and a second abutting portion provided at another end of said substrate in the longitudinal direction of said substrate, wherein said electrical contact point includes a first electrical contact point and a second electrical contact point, and wherein said electrical contact point is provided between said first abutting portion and said second abutting portion.

24. An electrophotographic image forming apparatus, to which a process cartridge is detachably mountable and which forms an image on a recording medium, comprising:

(i) a main body electrical contact point;

(ii) a main body abutting member;

(iii) a mounting device configured and positioned to dismountably mount the process cartridge, the process cartridge including an electrophotographic photosensitive body, a process device configured and positioned to act on the electrophotographic photosensitive body, an information storing medium having a substrate, a storing element provided on the substrate and configured to store information, an electrical contact point that is provided on the substrate and is electrically connected to the storing the substrate, and is electrically connected to the storing element, wherein when the process cartridge is mounted on a main body of said electrophotographic image forming apparatus, the electrical contact point contacts said main body electrical contact point, and a sliding region that is provided on the electrical contact point, wherein in the case that the electrical contact point and said main body electrical contact point contact each other, said main body electrical contact point contacts the electrical contact point with sliding in the sliding region, and an information storing medium mounting portion in which the information storing medium is mounted; and (iv) a convey device configured and positioned to convey the recording medium, wherein, in the case that the electrical contact point contacts said main body electrical contact point, a contact pressure caused by contact of the electrical contact point and said main body electrical contact point is regulated by said main body abutting member provided in the main body of said electrophotographic image forming apparatus.

25. An electrophotographic image forming apparatus, to which a developing cartridge is detachably mountable and which forms an image on a recording medium, comprising:

(i) a main body electrical contact point;

(ii) a main body abutting member;

(iii) a mounting device configured and positioned to dismountably mount the developing cartridge, the developing cartridge including a developing device configured and positioned to develop an electrostatic latent image formed on an electrophotographic photosensitive body with a developer, an information storing medium having a substrate, a storing element provided on the substrate, configured to store information, an electrical contact point that is provided on the substrate, and is electrically connected to the storing element, wherein when the developing cartridge is mounted on a main body of said electrophotgraphic image forming apparatus, the electrical contact point contacts said main body electrical contact point, and a sliding region that is provided on the electrical contact point, wherein when the electrical contact point and said main body electrical contact point contact each other, said main body electrical contact point slides on the electrical contact point in the sliding region, and an information storing medium mounting portion in which the information storing medium is mounted; and (iv) a convey device configured and positioned to convey the recording medium, wherein, in the case that the elctrical contact point contacts said main body electrical contact point, a contact pressure caused by contact of the electrical contact point and said main body electrical contact point is regulated by said main body abutting member provided in the main body of said electrophotographic image forming apparatus.

26. An information storing medium to be mounted to a main body of an electrophotographic image forming apparatus, comprising:

a substrate;

a storing element, provided on said substrate, configured to store information;

an electrical contact point electrically connected to said storing element, wherein said electrical contact point contacts a main body electrical contact point provided in the main body of the electrophotographic image forming apparatus in the case that said information storing medium is attached onto the main body of the electrophotographic image forming apparatus;

a first sliding area provided within said electrical contact point, wherein, in the case that said electrical contact point contacts the main body electrical contact point, the main body electrical contact point slides on said electrical contact point in said first sliding area; and a second sliding area provided within said electrical contact point substantially parallel to said first sliding area, wherein, in the case that said electrical contact point contacts the main body electrical contact point, the main body electrical contact point slides on said electrical contact point in said second sliding area.

27. A unit to be mounted to a main body of an electrophotographic image forming apparatus, comprising:

a developing device configured and positioned to develop an electrostatic latent image formed on an electrophotographic photosensitive body with developer;

an information storing medium including:

a substrate;

a storing element, provided on said substrate, configured to store information;

an electrical contact point electrically connected to said storing element, wherein said electrical contact point contacts a main body electrical contact point provided in the main body of the electrophotographic image forming apparatus in the case that said unit is attached onto the main body of the electrophotographic image forming apparatus;

a first sliding area provided within said electrical contact point, wherein, in the case that said electrical contact point contacts the main body electrical contact point, the main body electrical contact point slides on said electrical contact point in said first sliding area; and a second sliding area provided within said electrical contact point substantially parallel to said first sliding area, wherein, in the case that said electrical contact point contacts the main body electrical contact point, the main body electrical contact point slides on said electrical contact point in said second sliding area; and an information storing medium attachment part into which said information storing medium is attached.

28. A process cartridge to be mounted to a main body of an electrophotographic image forming apparatus, comprising:

an electrophotographic photosensitive member;

a process device configured and positioned to act on said electrophotographic photosensitive member;

an information storing medium including:

a substrate;

a storing element, provided on said substrate, configured to store information;

an electrical contact point electrically connected to said storing element, wherein said electrical contact point contacts a main body electrical contact point provided in the main body of the electrophotographic image forming apparatus in the case that said process cartridge is attached onto the main body of the electrophotographic image forming apparatus;

a first sliding area provided within said electrical contact point, wherein, in the case that said electrical contact point contacts the main body electrical contact point, the main body electrical contact point slides on said electrical contact point in said first sliding area; and a second sliding area provided within said electrical contact point substantially parallel to said first sliding area, wherein, in the case that said electrical contact point contacts the main body electrical contact point, the main body electrical contact point slides on said electrical contact point in said second sliding area; and an information storing medium attachment part into which said information storing medium is attached.

29. A developing cartridge to be mounted to a main body of an electrophotographic image forming apparatus, comprising:

a developing device configured and positioned to develop an electrophotographic latent image formed on an electrophotographic photosensitive body with developer;

an information storing medium including:

a substrate;

a storing element, provided on said substrate, configured to store information;

an electrical contact point electrically connected to said storing element, wherein said electrical contact point contacts a main body electrical contact point provided in the main body of the electrophotographic image forming apparatus in the case that said developing cartridge is attached onto the main body of the electrophotographic image forming apparatus;

a first sliding area provided within said electrical contact point, wherein, in the case that said contact point contacts the main body electrical contact point, the main electrical contact point slides on said electrical contact point in said first sliding area; and a second sidling area provided within said electrical contact point substantially parallel to said first sliding area, wherein, in the case that said electrical contact point contacts the main body electrical contact point, the main body electrical contact point slides on said electrical contact point in said second sliding area; and an information storing medium attachment part into which said information storage medium is attached.

* * * * *

UNITED STATES PATENT AND TRADEMARK OFFICE

CERTIFICATE OF CORRECTION

PATENT NO. : 6,826,380 B2
DATED : November 30, 2004
INVENTOR(S) : Karakama et al.

It is certified that error appears in the above-identified patent and that said Letters Patent is hereby corrected as shown below:

Title page,
Item [56], References Cited, FOREIGN PATENT DOCUMENTS,
"JP 02144571 A 6/1990" should read -- JP 02-144571 A 6/1990 --.

Column 6,
Line 54, "a-polygon" should read -- a polygon --.

Column 14,
Line 2, "As." should read -- Δs. --.
Line 38, "As" should read -- Δs --.

Column 18,
Line 29, "blade 221 a" should read -- blade 221a --.

Column 20,
Line 14, "screw 221 e" should read -- screw 221e --.

Column 21,
Line 9, "seat" should read -- seal --.

Column 30,
Line 67, "thereof" should read -- thereof. --.

Column 37,
Line 50, "said" should read -- the --.

Column 38,
Line 4, "side" should read -- side of said substrate --.

Column 40,
Line 57, "the substrate, and is electrically con-" should be deleted.
Line 58, "nected to the storing" should be deleted.

UNITED STATES PATENT AND TRADEMARK OFFICE

CERTIFICATE OF CORRECTION

PATENT NO. : 6,826,380 B2
DATED : November 30, 2004
INVENTOR(S) : Karakama et al.

It is certified that error appears in the above-identified patent and that said Letters Patent is hereby corrected as shown below:

Column 44,
Line 13, “sidling” should read -- sliding --.

Signed and Sealed this

Tenth Day of May, 2005

JON W. DUDAS
*Director of the United States Patent and Trademark Office*